US007061518B2

(12) United States Patent
Ueda et al.

(10) Patent No.: US 7,061,518 B2
(45) Date of Patent: Jun. 13, 2006

(54) LED PRINT HEAD AND PRODUCTION METHOD OF LED PRINT HEAD AND METHOD OF PRODUCING LED SUBSTRATE AND METHOD OF PASTING LED SUBSTRATE

(75) Inventors: Shunsuke Ueda, Mie (JP); Takao Takagi, Mie (JP); Setsuo Suzuki, Mie (JP); Takeyoshi Horiuchi, Mie (JP); Hideyuki Ikoma, Mie (JP); Hiromu Ono, Mie (JP); Takashi Toyoda, Mie (JP); Sayuri Natsui, Mie (JP)

(73) Assignee: Suzuka Fuji Xerox Co., Ltd., Mie (JP)

( * ) Notice: Subject to any disclaimer, the term of this patent is extended or adjusted under 35 U.S.C. 154(b) by 0 days.

(21) Appl. No.: 10/477,740

(22) PCT Filed: May 15, 2002

(86) PCT No.: PCT/JP02/04717

§ 371 (c)(1),
(2), (4) Date: Nov. 14, 2003

(87) PCT Pub. No.: WO02/092349

PCT Pub. Date: Nov. 21, 2002

(65) Prior Publication Data

US 2004/0135876 A1 Jul. 15, 2004

(30) Foreign Application Priority Data

May 16, 2001 (JP) ..... 2001-147143
May 24, 2001 (JP) ..... 2001-156188
Dec. 28, 2001 (JP) ..... 2001-401864
Mar. 20, 2002 (JP) ..... 2002-077582

(51) Int. Cl.
*B41J 27/00* (2006.01)

(52) U.S. Cl. ..... 347/242; 347/257

(58) Field of Classification Search ..... 347/137–138, 347/238, 241–245, 251–254, 256–261, 263
See application file for complete search history.

(56) References Cited

U.S. PATENT DOCUMENTS 6,169,564 B1 * 1/2001 Tsukagoshi et al. ..... 347/238
6,249,296 B1 * 6/2001 Nemura ..... 347/138

FOREIGN PATENT DOCUMENTS

JP 2001038952 A * 2/2001
JP 2001080110 A * 3/2001

* cited by examiner

*Primary Examiner*—Hai Pham
(74) *Attorney, Agent, or Firm*—Donald S. Dowden; Cooper & Dunham LLP

(57) ABSTRACT

An LED print head is arranged opposite to a photosensitive body, consisting of a base body, which is arranged parallel to the axis of the photosensitive body and consists of a large volume base part having an upper face opposite to the photosensitive body and a small volume projection part extending upward from a part of the upper face of the base part, and having a narrow width in the path of the photosensitive body. An LED base panel is fitted on the upper face of the base part, and a lens array is on the part of a side of the projecting part, being arranged between the opposing face of the photosensitive body, and the upper face of the LED base panel. Manufacturing and attaching methods relating to the print head are also disclosed.

11 Claims, 48 Drawing Sheets measured with laser scale (non-contact type measuring instrument)

Fig.12
PRIOR ART
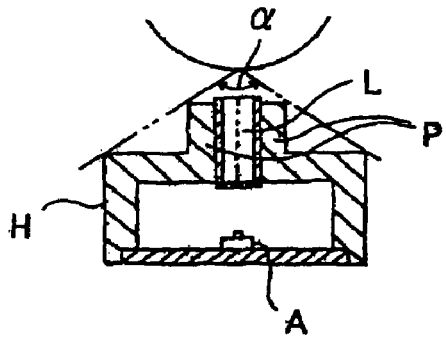
Fi.13
PRIOR ART
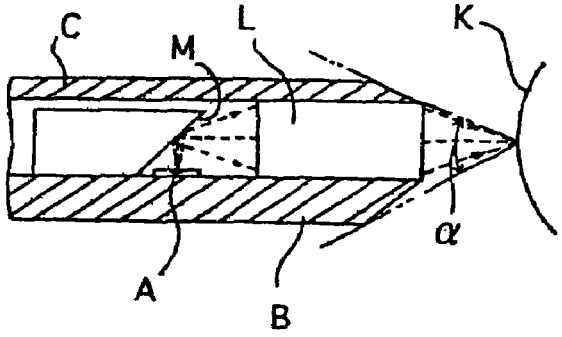
Fig.14
PRIOR ART
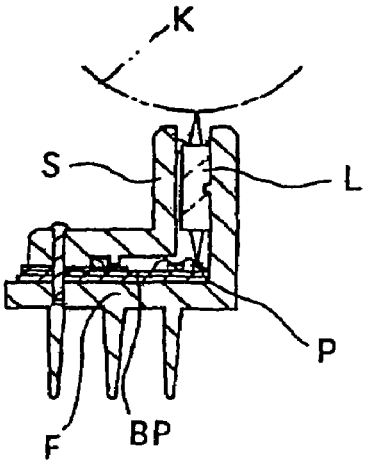

LED PRINT HEAD AND PRODUCTION METHOD OF LED PRINT HEAD AND METHOD OF PRODUCING LED SUBSTRATE AND METHOD OF PASTING LED SUBSTRATE

FIELD OF INVENTION

The present invention relates to 'a Light-Emitting Diode (LED) print head and production method of LED print head and method of producing LED substrate and method of pasting LED substrate, said LED print head being used in an electro photographic copying machine, or printer.

BACKGROUND OF THE INVENTION

In a conventional LED writing head, a rod lens is placed by fixing both sides of said rod lens L to a pair of protrusions P projecting from the center of the upper face of a housing H cross sectional view of which having a U-shape in cross section as shown in FIG. 12 (Tokkai Hei 7-108709). Said LED writing head has a problem in that since the occupied angle $\alpha$ for the photosensitive body is wide, it is difficult to design a thin enough writing head, so that said writing head is unsuitable for a tandem system color copying machine wherein photosensitive drums for each color, (cyan, magenta, yellow and black) are arranged in a line to form the color image.

In the other conventional LED writing head it is possible to reduce occupied angle a and design a thinner writing head as shown in FIG. 13, nevertheless since in said LED writing head a reflecting mirror M at an incline of 45° for an imaging lens L being opposite to said mirror M, is arranged, said imaging lens L being opposite to a photosensitive body K and arranged at the end of a supporting base panel B, on which an LED light emission part A is arranged, and said reflection mirror M and said imaging lens L are protected by a dust proof cover C, there is a problem in that many kinds of parts are necessary and the structure becomes complicated, so that the cost of materials and assembly increases, and further since said supporting base panel B on which said imaging lens L, said reflecting mirror M, and LED light mission part A are supported is settled to be thin and of small volume to make an occupied angle narrower and, to provide a thin LED writing head, said supporting base panel B has little mechanical and heat capacity so that said supporting base panel B is apt to deform with temperature change when said LED writing head generates heat during use, and there is a further problem in that the thermal stability and strength of said supporting base panel B degrades, resulting in picture, distortion.

Further, in a conventional print head, the LEDs P are arranged on a broad heat radiating member F whose sectional view is an L-shape and from whose under side a plural number of fins are extended and a supporting member S whose sectional view has a L-shape is arranged being opposite to said heat radiating member F so as to put a lens array L between said supporting member S and said heat radiating member F as shown in FIG. 14 Tokkai Hei 6-320790) resulting in a problem, being that the occupied angle $\alpha$ for a photosensitive drum K becomes wide, making it is difficult to provide a thin enough photo print head.

Furthermore, in the conventional fixing structure of the lens array, an adhesive gun G is inserted at an angle into the notched ditches K of the housing, and a fixed intervals are located between said notched ditches to facilitate the application of a silicone adhesive to the L-shaped corner part where the bottom faces KB of said notched ditches and the side face L of said lens array cross together, as shown in FIG. 14 (Tokkai Hei 6-320790).

In said photo print head no sealing agent is used.

Still further in a conventional LED print head, the lens array L is attached to the side face of the upper end part of the base body B, after which a sealing agent is applied to the gap between the crank-shaped upper edge part of said base body B and said lens array L, said upper edge consisting of a plural number of upper and lower side horizontal edge parts H and a plural number of vertical edge parts V connecting said upper and lower side horizontal edge parts and respectively as shown in FIGS. 25 and 26.

In said conventional LED print head, when said sealing agent is applied automatically to said gap between the crank shaped upper edge part of said base body B and said lens array L, said upper edge part consisting of a plural number of upper and lower side horizontal edge parts, and a plural number of vertical edge parts connecting said upper and lower side horizontal edge part respectively, a coating nozzle N is inclined at a fixed angle, to apply said sealing agent to said gap between said upper side and lower side horizontal upper edge parts of said vertical base body B as shown FIG. 25. Nevertheless in this situation, since the direction of said coating nozzle is fixed, said upper edge part can not be wholly covered with said sealing agent so that said base body B is horizontally put and turned at 90° as it is, and said gap between said vertical edge parts arranged intermediating by at fixed intervals each other and the side face of said lens array L are applied with said sealing agent. Or said sealing agent can be applied to said gap without fixing the direction of said nozzle N, and fixing said base body B and changing inclination angle of said nozzle.

Nevertheless in each case, there is a problem in that working steps and working time increase and so production cost becomes expensive. Further, since said upper edge part of said base body B discontinues having said upper and lower side horizontal edge parts, and vertical edge parts, it is necessary to toggle the ON-OFF control when applying said sealing agent to each gap between said upper side and lower side horizontal edge parts and vertical edge parts so that there are problems in that a complicated control is necessary and said sealing agent can not be applied uniformly. Namely, the control of angle and position of said base body B is necessary in applying said sealing agent to upper side, lower side, and vertical edge parts each so that the control of applying becomes complicated.

Still further, in a conventional assembly method of an LED print head, the horizontal and vertical warping direction of the lens array is left as it is and only the imaging focus is adjusted by optical position control, as a means to fix said lens array to said base body (Tokkai Hei 9-226168).

Or in another conventional assembly method of an LED print head, only the imaging focus is adjusted by the optical position control of the lens array L which is corrected to be straightened by pressing and profiting said lens array to a supporting plate P without warping, said supporting plate P being supported by a spring (Tokkai Hei 8-214111).

In said assembly method of an LED print head, there is a problem in that printing quality degrades by shifting of LED chip fitting position and a partial shifting of the position of the imaging point of the light from LED caused by the lens warping of said lens array. Further, there is a problem in that printing quality degrades with the dispersion of the imaging point caused by lens warping. Herein lens warping means angular dispersion of the plural number of rod lenses composing said lens array. When the angle of each rod lens composing said lens array disperses respectively, the optical axis of each points in to a slightly different direction respectively, resulting in dispersion of the imaging point of the light from the LED.

Still further in a conventional method of attaching the substrate, a base panel B on which LED chips C are fitted is attached to a base panel supporting member B as is shown in FIG. 53 (Tokkai Hei 9-226168).

In said conventional attaching method, in a case where said base panel B on which said LED chips are fitted, has a long; narrow strip shape, extending to a full whole length of 390 mm, full width of from 6 to 10 mm, and thickness of 1 mm, said base panel B is not firm, resulting a problem when said LED chips are fitted on to said base panel B or said base panel B is attached to said base panel supporting member B, said base panel B is apt to warp, causing a shifting of the light emitting point, degrading print quality.

DISCLOSURE OF THE INVENTION

In said LED print head having the structure described above in Claims 1 and 2, said LED print head being arranged opposite to a photosensitive body, since a base part composing a base body arranged parallel to the axis of said photosensitive body and having a upper face which is opposite to said photosensitive body and on which an LED base panel is arranged, is settled to have a large volume, and a small volume projecting part having a narrow width in a moving direction of said photosensitive body is extended upward from a part of said upper face of said base part, said projecting part composing said base body on which lens array is arranged between the opposing face of said photosensitive body and to upper face of said LED base panel so that said lens array is supported by only said small volume and narrow projecting part, occupied angle for said photosensitive body can be settled to be small to give a base part having a narrow width in a moving path direction of said photosensitive body and as a result, said head can be settled to be thin and colorization can be put into practice.

Further, since said base part is settled to be of large volume and united with said small volume projecting part to improve the condition of heat to said large volume base part, thermal deformation by heating is suppressed to prevent the degradation of thermal stability and thermal strength to avoid to have a bad influence on image.

In said LED print head having above described structure of Claim 3, since the vertical length of said base part of Claims 1 and 2 is sufficiently greater than the vertical length of said projecting part, the strength of said whole base body against bending and heating is improved and vertical thermal deformation becomes small.

In said LED print head having above described structure of Claim 4, since a notched dent is formed from the bottom face of said base part, heat radiation area is expanded to suppress temperature ascending of said head.

In said LED print head having above described structure of Claim 5, since the vertical length of said base body consisting of said base part and said projecting part is settled to be sufficiently greater than the width of said base part in Claim 4, the occupied angle for said sensitive body can be settled to be narrow and give a thin head by settling to be a small width of said base part in a moving direction of said photosensitive body.

In said LED print head having above described structure of Claim 6, since a side of said lens array is stuck to the side of said projecting part so that said lens array is supported on one side in Claims 4 or 5, there is no-supporting means to support the other side of said lens array, the size of the top of said LED print head can be settled to be narrow so that the occupied angle for said photosensitive drum can be settled to be narrow and the width of said base part along the moving direction of said photosensitive body also can be settled to be narrow to give a thin head.

In said LED print head having above described structure of Claim 7, since both sides of a closing member made of a thinner material than said projecting part are fixed to the outside of said lens array and the side wall of said base part respectively to close the space between said lens array and said LED base panel in Claims 4 to 6, dust and toner are prevented to go in said space between said lens array and said LED base panel to stick said lens array and said LED base panel. In said LED print head having above described structure of Claim 8, since said closing member is made of a sheet material in Claim 7, dust and toner are prevented from going in said space between said lens array and said LED base panel to stick to said lens array and said LED base panel unless the occupied angle for said photosensitive body becomes large.

In said LED print head having above described structure of Claim 9, since the joint between one side of said closing member and the outside of said lens array is said LED by a sealing agent and the joint between the other side of said closing member and the side wall of said base part is said LED by a tape in Claim 8, said closing member made of a thin cover member has an enough strength to improve reliability of said closing member.

In said LED print head having above described structure of Claim 10, since the depth of said notched dent being formed from the bottom face of said base part is more than 50% of the vertical length of said base part to be at least one heat radiating part to increase heat radiation area in Claims 4 to 9, the temperature of said base body can be lowered by heat radiation from said heat radiating part to suppress effectively thermal deformation by heating.

In said LED print head having above described structure of Claim 11, since the width of said base part is settled to be a little greater than the sum of the width of said lens array and the width of said projecting part, but settled to be minimized as much as possible by settling the width of said base part in a moving direction of said photosensitive body to be narrow, a thin head can be provided and colorization can put into practice.

In said LED print head having above described structure of Claim 12, since the opposing face of said photosensitive body and the center of said lens array in a crosswise direction, said lens array being fitted to the side of said projecting part, and the center of said LED base panel in a crosswise direction, said LED base panel being fitted on the upper face of said base part, are arranged essentially in a straight line so that emitting point of light of said LED base panel converges to the opposite face of said photosensitive body, the simple optical system can be provided and the reliability is improved, and because a few parts are necessary so that structure can be simplified and the cost can be reduced and further problems caused by heating can be solved.

In said LED print head having above described structure of Claim 13, since said projecting part of said base body has a crank shaped upper edge consisting of a plural number of upper side horizontal edge parts, a plural number of lower side horizontal edge parts, and inclining edge parts connecting the ends of said upper side horizontal edge parts and the ends of said lower side horizontal edge parts respectively to form a trapezoid shaped unit in Claims 4 to 12, in the case where the side of said lens array is adjacent to the side of the upper part of said projecting part and a sealing agent is applied between the side of said lens array and said crank shaped upper edge of said projecting part, said sealing agent can be wholly applied continuously to the side of said crank shaped upper edge so that working progress and working time can be reduced to reduce production cost.

In said LED print head having above described structure of Claim 14, wherein since said inclining edge parts is straight line shaped in Claim 13, position control of said coating nozzle can be simplified, so that since a constant position control of said coating nozzle of said sealing agent can be applied.

In said LED print head having above described structure of Claim 15, wherein since said inclining edge parts are essentially s-shaped respectively in Claim 13, position of said coating nozzle of said sealing agent changes smoothly, so that said sealing agent can be applied uniformly.

In said method for manufacturing LED print head having above described structure of Claim 16, since sealing agent is applied between said lens array and the side of said projecting part by said coating nozzle moving along said crank-shaped upper edge of said projecting part continuously in one process, said upper edge consisting of the plural number of upper side horizontal edge parts, and the plural number of lower side horizontal edge parts and the plural number of inclining edge parts connecting the ends of said upper side horizontal edge parts and the ends of said lower side horizontal edge parts respectively to form a trapezoid-shaped unit, working progress and working time can be reduced to reduce production cost and said sealing agent can be applied by a constant control so that control of coating can be simplified and said sealing agent is applied uniformly and attitude controls of said base body and inclining angle of said coating nozzle are not necessary.

In the method having above described structure of Claim 17, since said coating nozzle is controlled by a robot so as to move along crank shape of said upper edge of said projecting part in Claim 16, said sealing agent can be automatically applied on the side of the upper part of said projecting part and said print head can be automatically assembled.

In the method having above described structure of Claim 18, wherein a lens array and LED base panel on which the plural number of LED chips are fitted are assembled, since when said lens array is fixed to the side of said projecting part of said base body, fitting position shift of said LED chip to said LED base panel, fitting position shift of said LED base panel to the base part of a base body and imaging point position shift caused by warping of lens of said lens array are corrected by partially warping said lens array at the plural number of points of said lens array fitted to said projecting part of said base body, so that printing, quality can be improved by correcting said imaging point position shift.

In the method for manufacturing LED print head having above described structure of Claim 19, since the shift position of imaging point of said lens array is corrected by adjusting the vertical shift between the LED's standard imaging line of the light and the true imaging line of light from LED, passing through said lens array by moving each point of the position of said lens array vertically at each point and/or by adjusting the shift between the standard imaging line of the LED light and the center line of said lens array by the moving position of said lens array back and forth in a crosswise direction at each point of said lens array, by adjusting the vertical position shift of said imaging point and the position shift of said imaging point along the width direction, an LED print head giving a high quality printing can be manufactured.

In the method for manufacturing LED print head having above described structure of Claim 20, since wherein the distortion of said lens array is adjusting by twisting said lens array around the imaging point of said lens array in Claim 18 or 19, by adjusting position shift of said imaging point caused by lens deformation of said lens array; printing quality can be improved.

In the method for manufacturing LED print head having above described structure of Claim 21 since wherein said lens array is fixed to the side of said lens array by coating an adhesive along the crank shaped upper edge of said projecting part to the side of said projecting part and the side of said lens array and hardening said coated adhesive in Claims 18 to 20, said adhesive can be continuously coated to make coating of adhesive easy so that productivity is improved and said lens array is certainly fixed to said base body.

In the method for manufacturing LED print head having above described structure of Claim 22, since wherein said lens array is first fixed to a crank shape unit at the middle position of said crank shaped upper edge of said projecting part and then said lens array is fixed to crank shape units at both sides of said crank shape unit at the middle position in turn and then said lens array is finally fixed to crank shape units at both ends of said crank shaped upper edge of said projecting part in Claim 21, position shift can be prevented when said lens array is fitted to said projecting part of said base body.

In the method for manufacturing LED print head having above described structure of Claim 23, since said lens array is fixed to the side of said projecting part by re-adjusting position shifting each time when said lens array is fixed at each crank shape unit in Claim 22, position shift of said lens array can be uniformly adjusted along whole lengthwise direction of said lens array.

In the method for manufacturing LED print head having above described structure of Claim 24, since said lens array is fixed at the middle part of said projecting part by using an adhesive having a lower elasticity after hardening and said lens array is fixed at other parts excepting the middle part of said projecting part by using an adhesive having a higher elasticity after hardening in Claim 23, warping of said lens array and said projecting part of said base body caused by sticking rigidly said lens array and said projecting part together, said lens array and said projecting part having different thermal expansion coefficients respectively, is suppressed and position of the center of said lens array along the lengthwise direction of said lens array does not change since even if partial position shift(s) along the lengthwise direction of said lens array is caused, said partial position shift(s) move(s) toward both end of said lens array.

In said method for manufacturing an LED base panel used in said LED print head of Claims 1 to 15, since the plural number of lateral position indicators and a length position indicator are part on the horizontal face of a fitting jig used for fitting LED chips to said base panel, said lateral position indicator being put on the plural number of position of the horizontal fate of said fitting jig to indicate positions along the width direction of said base panel and said positions on the horizontal face of said fitting jig being arranged along, the lengthwise direction of said base panel and said length position indicator indicating a position along the lengthwise direction of said base panel, and an indicating part to indicate the position along the lengthwise direction of said base panel is formed at one end of said base panel and then said length position indicator is fit to said indicating part of said base panel accompanying setting said base panel contacting to said length position indicator and said base panel is pressed by a pressing member opposing to said length position indicator to fix said base panel on the horizontal face of said fitting jig and then said LED chips are fitted to said base panel, when said LED chips are adjusted by said position indicators and accuracy of fitting said LED chips to said base panel is improved.

In the method for manufacturing LED print head having above described structure of Claim 26, since said base panel is further pressed by said pressing member from upside and then said LED chips are fitted to said base panel in Claim 25, vertical warping of said base panel is corrected, accuracy of fitting said LED chips to said base panel is further more improved.

In said method for sticking LED base panel to said base body of Claim 27, said base body being assembled in said LED print head of Claims 1 to 15, since the plural number of lateral position indicating members and a length position indicating members are put on the horizontal face of a sticking jig used for sticking said LED panel to said base body, said lateral position indicators being put on the horizontal face of said sticking jig to indicate position along the direction of said LED base panel and said positions on the horizontal face of said sticking jig being arrange, along the lengthwise direction of said LED base panel and length position indication member indicating a position along the lengthwise direction of said LED base panel, and an indicating part to indicate the position along the lengthwise direction of said LED base panel is formed at one end of said LED base panel and then said length position indicating member is fit to said indication part of said LED base panel accompanying setting said LED base panel contacting to said length position indicating member and after said LED base panel is sucked and fixed on the upper face of said sticking jig, said upper face being a vertical standard face, a base plate is stuck to said LED base panel, accuracy to stick said LED base panel to said base plate can be improved.

In said method for sticking LED base panel to said base body of Claim 28, since said base body on shoes base panel fitting part an adhesive is coated is put on said LED base panel sucked and fixed on the upper face of said sticking jig coated is put on said LED base panel sucked and fixed on the upper face of said sticking jig and after the position of said base body on said LED base panel, said base body is pressed to fix said base body on said LED base panel in Claim 27, positions of said LED chips on said base panel can be maintained when said LED base panel is fitted to said base panel to improve printing quality by preventing position shift of emitting point after said base panel is stuck to said base body.

In said method for sticking LED base panel to said base body of Claim 29, since said lateral position indicating members being put of said sticking jig and lateral position indicator being put on said fitting jig for LED chips are composed by the same means in Claim 28, accuracy in sticking said LED chips to said base panel can be realized when said LED base panel is stuck to said base body so that the printing quality can be improved by preventing position shift of the emitting point after said LED chips are fitted to said base panel.

In method for sticking said LED base panel to said base body of Claim 30, since the contacting position of said LED base panel to said lateral position indicating members and the contacting position of said base panel to said length position indicator is substantially at the same position in Claim 29, accuracy in sticking said LED chips to said base panel can be realized when said LED base panel is stuck to said base body so that the printing quality can be improved by preventing position shift of the emitting point after said LED chips are fitted to said base panel.

In method for sticking said LED base panel to said base body of Claim 31, since different kinds of adhesives having different physical properties are coated on the different parts of the back side of said base panel along lengthwise direction of said base panel in Claim 28, thermal warping of said LED base panel and said base body, said LED base panel and said base body have different thermal expansion coefficients each other, caused by sticking rigidly said LED base panel to said base body can be suppressed to reduce to position shift of said LED chips.

BRIEF DESCRIPTION OF THE DRAWINGS

FIG. 12 is a cross-sectional view of the first conventional write head.

FIG. 13 is a cross-sectional view of the second conventional write head.

FIG. 14 is a cross-sectional view of a conventional light print head.

PREFERRED EMBODIMENTS

The embodiments of the present invention are described below using the drawings.

[The First Embodiment]

Figure 1:
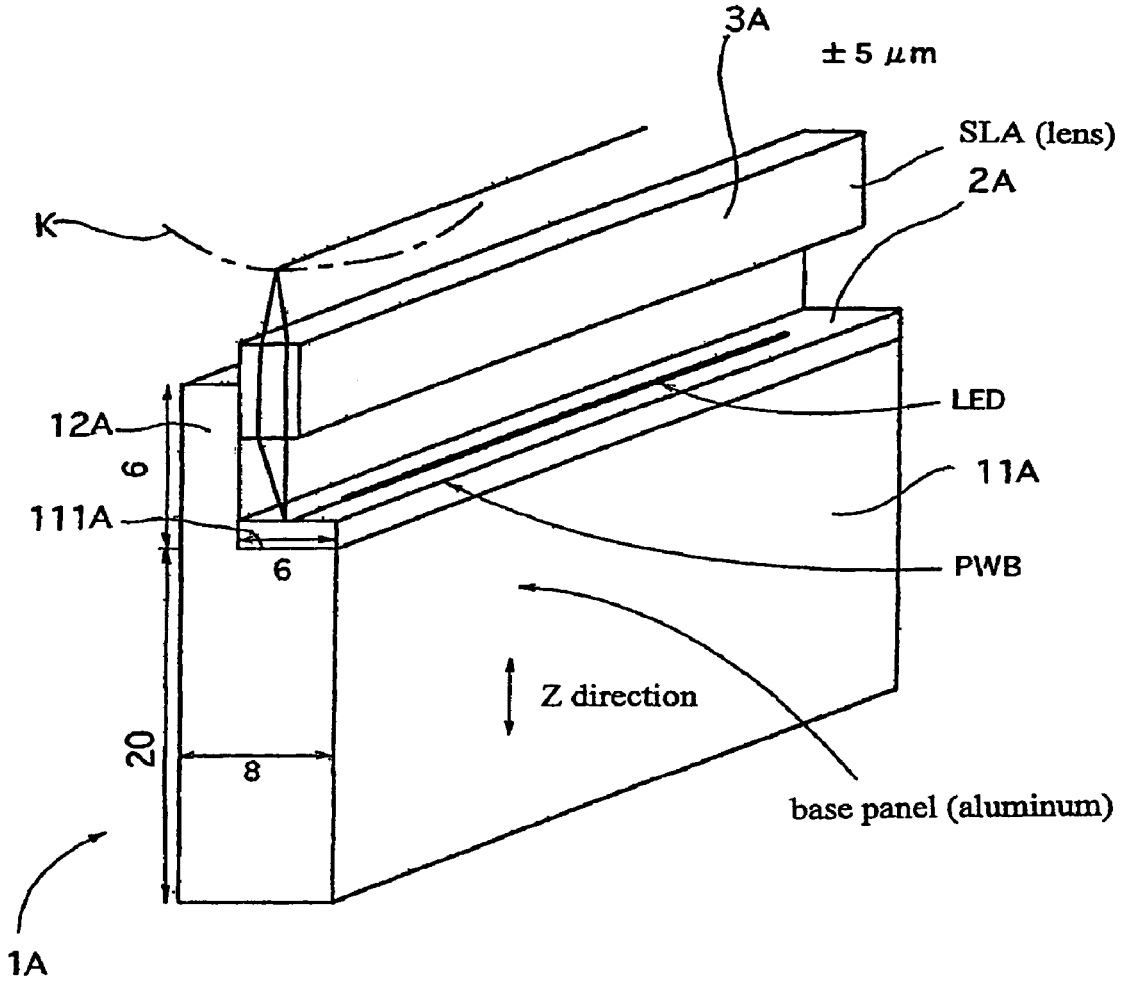
FIG. 1 is a perspective view of the LED print head in the first embodiment of the present invention.

An LED print head of the first embodiment consists of a base body 1A, being arranged opposite to a photosensitive drum K, and base panel 2A, and a lens array 3A fitted to said base body 1A, as shown in FIG. 1, wherein said base body 1A consists of a large volume base part 11A having an upper face 111A, being opposite to said photosensitive drum, a small volume projecting part 12A, extending upward from a part of said upper face 111A of said base part 11A, an LED base panel 2A is fitted on the upper face 111A of said base part 1A, and a lens array 3A is fitted to the upper end part of said projecting part, being arranged between the outside circumference of said photosensitive drum and the upper face of said LED base panel 2A, and the shape of the cross section of said base body 1A is a h-shape.

Said base part 11A is composed of a bar member made of aluminum, having a rectangular cross section, and said base part 11A is arranged, parallel to the axis of said photosensitive drum, and has an upper face 111A opposite to said photosensitive drum K, as shown in FIG. 1.

The width of said base part 11A in the circumference direction of said photosensitive drum K, is 8 mm, it is 4 times the width of said projecting part 12A (2 mm) and the height of said base part 11A in the radius direction of said photosensitive drum, is 20 mm, a little more than three times the height of said projecting part 12A (6 mm), and the cross sectional area of said base part 11A (160 $mm^2$), is a little more than 13 times that of the cross sectional area of said projecting part 12A (12 $mm^2$), so that said base part 11A has a greater mechanical and heat capacity as compared with that of said projecting part 12A so that the mechanical strength and heat capacity of said base body 1A, are decided basically by that said base part 11A.

Said projecting part 12A, extending vertically from one end of the width of the upper face 111A of said base part 11A which is made of aluminum is connected to said base part 11A, resulting in said base body 1A having a h-shaped cross section.

The width of said projecting part 12A in the direction of the circumference of said photosensitive drum K is settled to be ¼ of the width of said base part 11A and such that the narrow width of said projecting part 12A minimizes the occupied angle for said photosensitive drum K, the resulting apparatus can be miniaturized, and color print capable.

Said LED base panel 2A is fitted on the horizontal upper face of said base part 11A, said upper face being opposite to the lower end of the outer circumference of said photosensitive drum K, and a plural number of LED chips, corresponding to paper size and resolution, for instance in the case of A3 paper, 58 LED chips are fitted in a line on said LED base panel 2A. Each LED chip has 128 the emitting points. One side of said lens array 3A is attached to the upper edge part of the side of said projecting part 12A by an adhesive, so that said lens array is supported by said projecting part on one side, and is arranged between the lower end of the outer circumference of said photosensitive drum K, and the upper face of said LED base panel 2A. Said lens array 3A consists of a large number of rod lenses made of glass bar members being solid and cylindrical and said rod lenses arranged in a line and fixed between a pair of panels made of glass-epoxy resin, and silicon resin which is filled between said rod lenses, creating SLA (Self Focus Lens Array).

The arrangement of said lens array 3A is settled at a designated position along the optical axis and in the direction at which it crosses at right angles so that the emitting points of said LED chips converge along the surface of said photosensitive drum K.

In said LED print head of the first embodiment having above described structure, said LED print head being arranged opposite to a photosensitive drum, since a base part 11A is settled to have a large volume, composing the base body 1A arranged along the axis of said photosensitive drum K, and having a upper face 111A which is opposite to said photosensitive drum K and on which an LED base panel 2A, and a small volume projecting part 12A having a narrow width is extended upward from a section of said upper face 111A of said base part 11A, said projecting part 12A composing said base body 1A on which said lens array 3A is arranged between the opposite face of said photosensitive drum K and the upper face of said LED base 2A panel meaning said lens array 3A is supported by only said narrow and small volume projecting part 12A so that the occupied angle for said photosensitive drum K can be settled to be small, as a result, said LED print head can be settled to be thin and colorization of the tandem system can be put into practice. Further, in said LED print head of the first embodiment, said base part 11A is settled to have a large volume, and said projecting part 12A is settled to have a small volume and to be connected to said base part 11A, to improve heat transfer to said big volume base part 11A, so that average temperature of said base body 1A is lowered, reducing the temperature difference and as a result, the thermal deformation of said LED print head by heating is suppressed and degradation of thermal stability and thermal strength are prevented, avoiding damaging the image.

Furthermore, said LED print head of the first embodiment, since cross sectional area of said base part 11A of said base body 1A (160 $mm^2$) is a little more than 13 times that of cross sectional area of said projecting part 12A of said base body 1A (12 $mm^2$) to secure sufficiently great heat capacity of said base part 11A, thermal deformation by heating can be suppressed.

Still further, in said LED print heat of the first embodiment, since the width of said base part 11A of said base body 1A in the direction of the circumference of said photosensitive drum K (8 mm) is sufficiently greater than the width of said projecting part 12A, the heat capacity of said base part 11A increases, and since the width of said projecting part in the circumference of said photosensitive drum K is sufficiently narrower than the width of said base part 11A, the occupied angle for said photosensitive drum K can be settled to be small by reducing the width of said projecting part 12A, and by settling the width of said base part 11A in the moving direction of said photosensitive drum to be 8 mm, allowing for a thin LED print head, with color capability, to be provided.

[The First Embodiment]

In addition, in the LED print head of the first embodiment, since the height of the base part 11A along the radius of said photosensitive drum K is sufficiently greater than that of said projecting part 12A, the whole height of said base body 1A in a longitudinally bending direction is significant, so tat the force of the counter bending and thermal deformation in the vertical direction is increased, and the position shift reduced.

Additionally, in said LED print head of the first embodiment, since said projecting part 12A is extended upward vertically from an end of the upper face 111A of said base part 11A in the crosswise direction, the size of the upper end, namely the opposite part of said LED print head to said photosensitive drum K can be settled to be, small, so that the occupied angle for said photosensitive drum K becomes small.

Adding to this, in said LED print head of the first embodiment, since one side of said lens array 3A is fitted to the upper end of said projecting part 12A, so that said lens array 3A is supported at only one side and the other side of said lens array 3A is not supported by any supporting means, the size of the upper part of LED print head can be reduced to settle a small occupied angle for said photosensitive drum.

Namely, in said LED print head of the first embodiment, said lens array 3A is supported at only one side, and thereby deformation of said LED print head in the vertical direction by heating can be more suppressed than the conventional LED print head.

Further, in the conventional LED print head, other parts such as a cover is equipped in the vertical direction, and the lens array is fitted to LED print head through said parts, while in said LED print head, said lens array can be fitted directly to said base body 1A, so that shift in bonding face is hard to occur and relative position of said LED base panel 2A and said lens array is hard to shift.

[The Second Embodiment]

Figure 2:
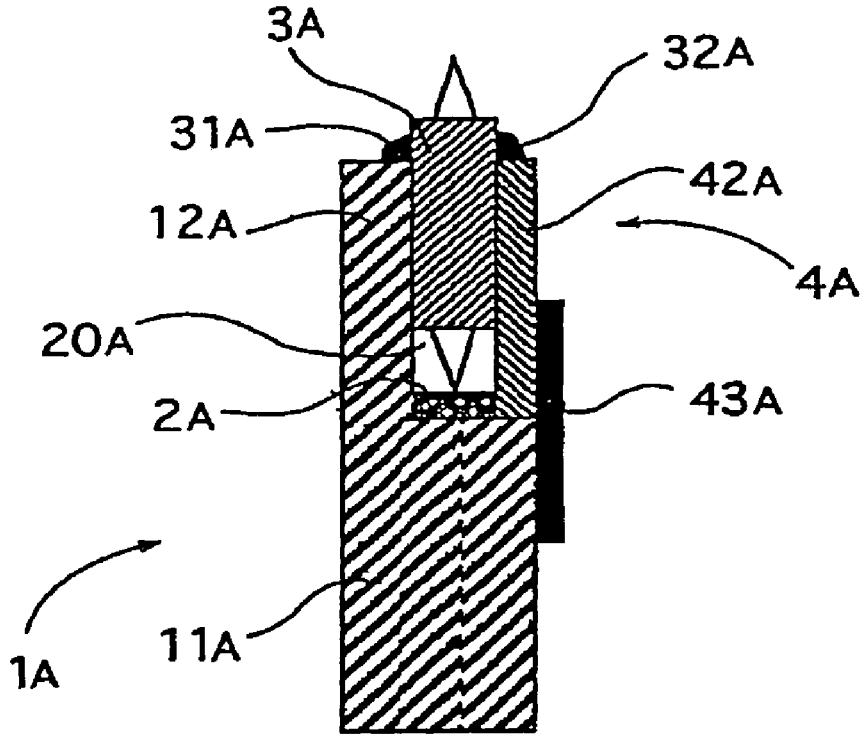
FIG. 2 is a cross-sectional view of the LED print head in the second embodiment of the present invention.

In an LED print head of the second embodiment, a, closing member 4A used to close the space 20A between the lens array 3A and the LED base panel 2A is added beside the structure of said LED print head of the first embodiment as shown in FIG. 2, so that in the second embodiment the difference between the structure of said LED print head of the first embodiment is mainly described and the same parts numbers as the first embodiment are used and size of each part is the same as the first embodiment in the second embodiment.

Said closing member 4A is composed of a thin cover part 42A made of a resin such as polycarbonate and one side end of said closing member 4A is fixed by the sealing agent 32A to the other side of said lens array whose one side is fitted to the side of the upper end part of said projecting part 12A and the other side of said closing member 4A is fixed to the side wall of said base part 11A by an aluminum tape 43A so that the necessary mechanical strength is provided to said closing member 4A composed of said thin cover parts 42A, improving the reliability of said closing member 4A.

[The Third Embodiment]

Figure 3:
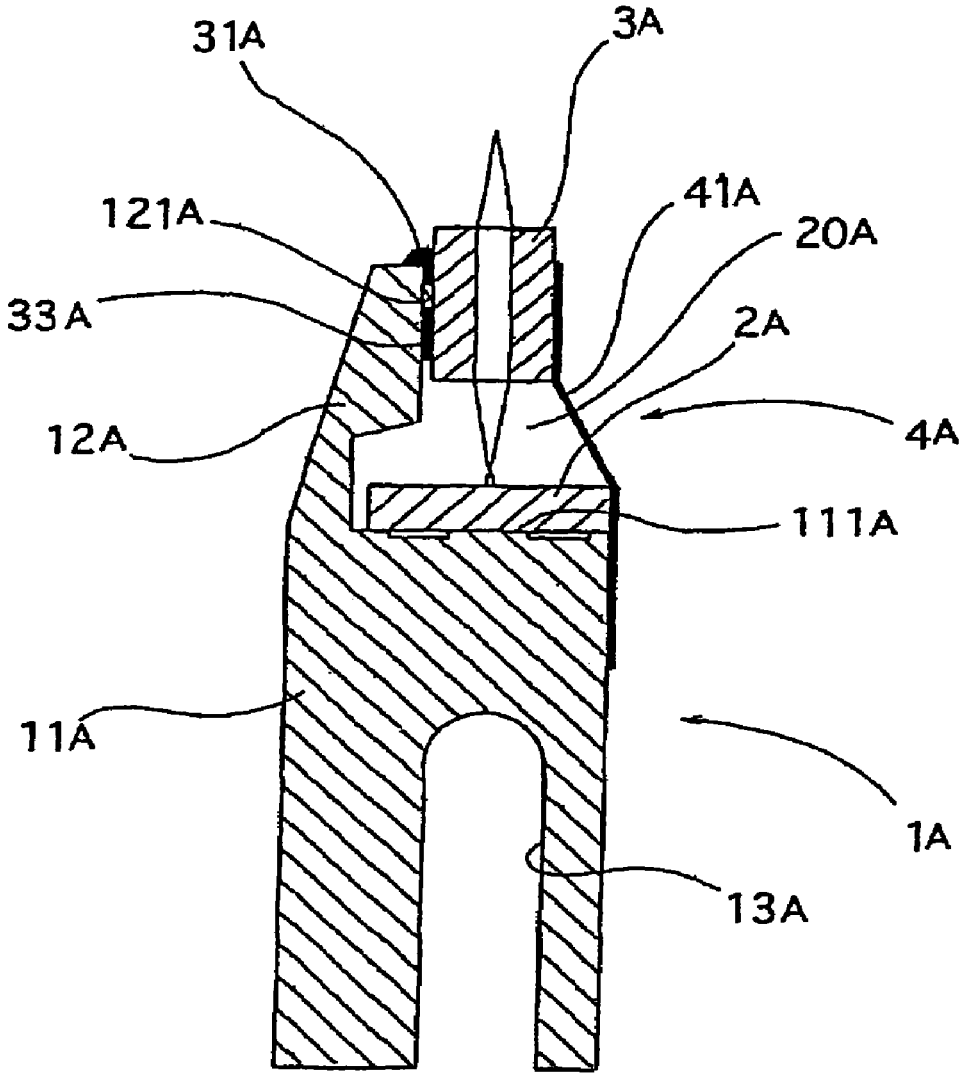
FIG. 3 is a cross-sectional view of the LED print head in the third embodiment of the present invention.

In an LED print head of the third embodiment a closing member 4A used to close the space 20A between a lens array 3A and an LED base panel 2A and substantially U-shaped notched dent 13A in a base part are added beside the structure of said LED print head of the first embodiment as shown in FIG. 3, and the above described differences from the structure of said LED print head of the first embodiment is mainly described, and the same numbers are given respectively to the same parts and the description of which are omitted.

Said base part 11A is composed of an aluminum bar shaped member and has a rectangular shape, a width of 13.8 mm, and height of 26.5 mm, and said base part 11A is arranged parallel to the axis of the photosensitive drum, and has an upper face 111A opposite to said photosensitive drum, an LED base panel 2A being fitted on said upper face 111A.

To increase heat radiation area, substantially U-shaped notched dent 13A is formed in under an area of said base part 11A, the depth of said notched dent 13A being 17.7 mm.

A projecting part 12A is extended upward from the edge part of the upper face 11A of said base part 11A in the crosswise direction and the width of the lower end of said projecting part 12A is 3.5 mm, its outer side face inclined toward the inside, and its height measuring 13.5 mm. As a result, the cross section of said base body 1A is substantially h-shaped.

Said lens array 3A is supported on one side by attaching one side of said lens array 3A to the projecting inside face, vertical upper end face 121A, by an adhesive 33A and the crevice between said vertical upper end face 121 and the side of said lens array 3A is sealed with a sealing agent 31A.

The width of said projecting part 12A in the direction of the circumference of said photosensitive drum (3.5 mm) is settled to be about ¼ of the width of said base part 11A (13.8 mm) to provide a small occupied angle for said photosensitive drum so that in the size in the direction of circumference of said photosensitive drum, said head can be thinned and colorization become possible by such a thin width.

Said closing member 4A is composed of a thinner parts than said projecting part 12A of said base body 1A, and said thinner parts is a sheet-like part 41A having a thickness of less than 1 mm, with both sides of said sheet-like part 41A being stuck respectively to the other side of said lens array 3A and the side wall of said base part 11A.

Said LED print head of the third embodiment is arranged parallel to the axis of said photosensitive drum, and since said base part 11A is settled to have a large volume, said base part, 11A composing said base body 1A having the upper face 11A on which said LED base panel 2A is fitted being opposite to the outer circumference of said photosensitive drum, and said projecting part 12A is settled to have a small volume, said projecting part being extended upward from a part of the upper face of said base part 11A and said lens array 3A being fitted to said projecting part 12A and arranged in a position between the outer circumference of said photosensitive drum and the upper face of said LED base panel 2A, and said lens array is supported only by said small volume projecting part 12A, making the occupied angle which is the minimum for said photosensitive drum.

Further, since said LED print head of the third embodiment uses said closing member 4A composed of said sheet-like parts 41A having a thickness of less than 1 mm, said sheet-like parts 41A do not increase the thickness of said LED print head substantially, the maximum width of said print head is substantially decided by the width of said base part 11A (13.8 mm) so that said LED print head can be thinned and the colorization in tandem system become possible.

Furthermore, since said base part 11A is settled to have a large volume (cross section area 365.7 $mm^2$) and said projecting part 12A is settled to have a small volume (cross section area about 47.25 $mm^2$, about 13 percent of said base part 11A) and said projecting part 12A is connected to said base part 11A to improve heat transfer to said big volume base part 11A in said LED print head of the third embodiment, the average temperature of said base body can be lowered to reduce the temperature difference, and the thermal deformation of said print head by heating is suppressed to prevent the degradation of heat stability and thermal strength to avoid bad influence on image.

Still further, said closing member 4A closes the space 20A between said lens array 3A and said LED base panel 2A, both sides of said closing member 4A being fixed respectively to the other side face of said lens array 3A and the side wall of said base part 11A in said LED print head of the third embodiment, dust and toner are prevented from entering said space to stick to said lens array 3A and said LED base panel 2A.

In addition, since a notched dent 13A is formed on said base part 11A to increase the heat radiation area in said print head in said LED print head of the third embodiment, the temperature of the whole base body 1A can be lowered by the heat-radiation from said notched dent 13A, to suppress the thermal deformation of said base body 1A by heating.

THE FIRST EXAMPLE

Figure 4:
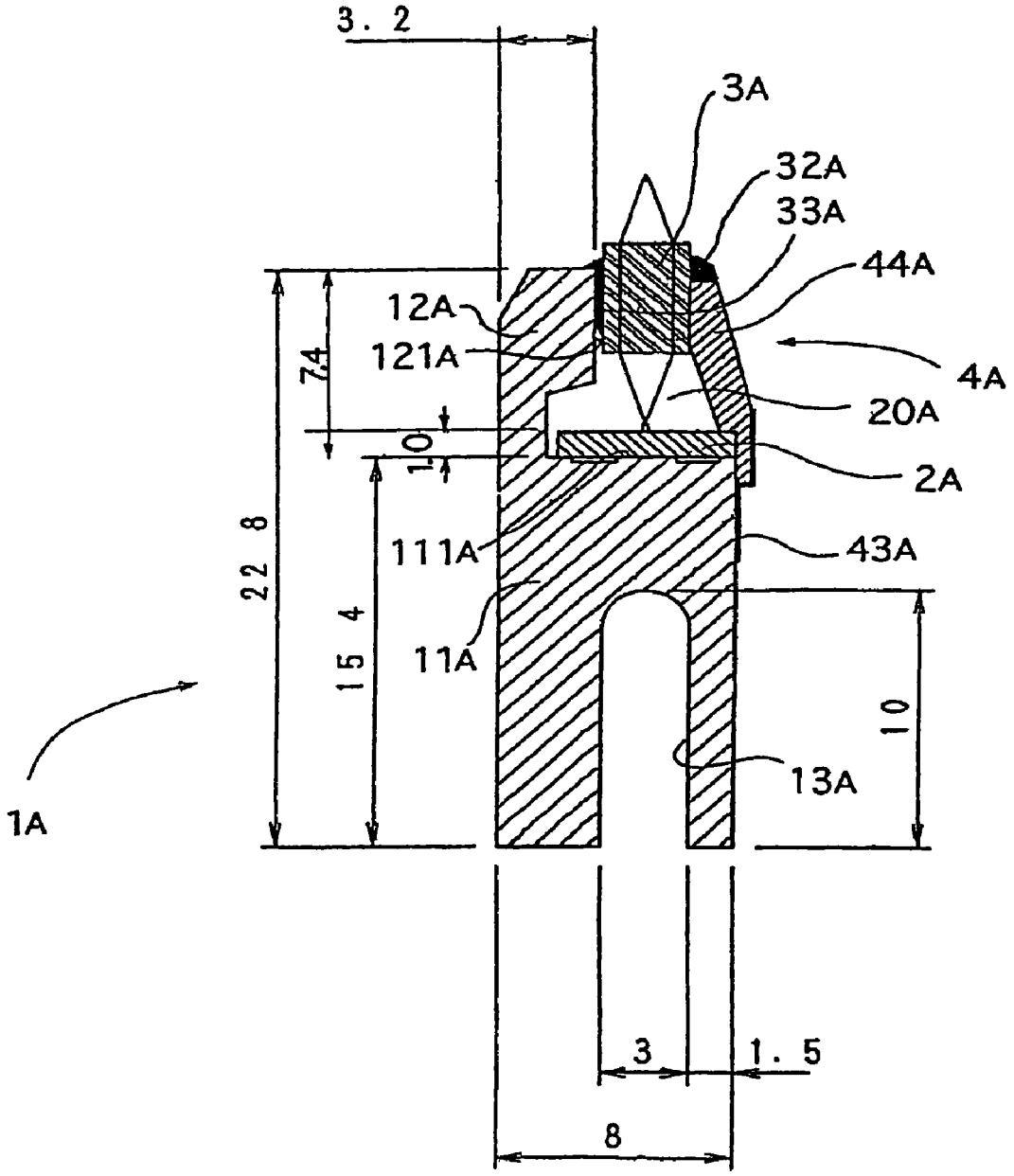
FIG. 4 is a cross-sectional view of the LED print head in the first example of the present invention.

In an LED print head of the first example, a closing member 4A is composed by a thin cover parts 44A and substantially U-shaped notched dent 13A is formed on said base part 11A differing from the second embodiment as shown in FIG. 4 and the above described different structures are mainly described comparing a comparison and the same numbers are respectively given to the same parts, omitting the description of said parts of said base body 1A.

A base body 1A consists of a base part 11A made of aluminum, said base part 11A having the width (along the circumference of said photosensitive drum) is 8 mm, the height 15.4 mm and having a rectangular cross section, and a projecting part 12A made of aluminum, said projecting part extending upward vertically from one side of the upper face 111A of said base part 11A in the crosswise direction and being connected to said base part 11A and the width of the lower end (contacting end with said base part) of said projecting part being 1.54 mm, the height being 7.4, and a U-shaped notched dent 13A having the width 3 mm, the height 10 mm, and the cross section area 29.03 $mm^2$ is formed from the bottom of said base part 11A so that the whole shape of said base body 1A has a substantially h-shaped cross section and the height of said base body 1A is 2.85 times of the width of said base body 1A.

The width (along the circumference direction of said photosensitive drum) of said base part 11A, is 8 mm and 5.2 times of the width of the lower end (contacting end with said base part) of said projecting part 12A (1.54 mm) and 2.5 times of the width of the upper part of said projecting part 12A (3.2 mm) and the height of said base part 11A (the length in the direction of the radius of said photosensitive drum) (15.4 mm) is a little greater than 2.1 times of the height of said projecting part 12A (7.4 mm), and the cross section area of said base part (123.2−29.03=94.17 $mm^2$) is a little bigger than 5.1 times, enough greater than the cross section area of said projecting part 12A (25×7.4=18.5 $mm^2$), so that said base part 11A has relatively a greater mechanical volume and thermal volume compared to that of said projecting part 12A, and the mechanical strength and heat volume of said base body 1A are basically decided by this structure.

The upper part of the outside face of said projecting part 12A is settled to incline to provide a small occupied angle for said photosensitive drum and the width (along the circumference of said photosensitive drum) of the lower end (contacting end with said base part) is settled to be about ⅕ that of the width of said base part 11A so that said print head can be thinner, and its narrow width allowing for colorization in tandem system.

A closing member 4A is composed of a thin cover parts 44A and one side end of said closing member 4A is fixed to the other side face of said lens array 3A with a sealing agent 32A and the other side of said closing member 4A is fixed to the side wall of said base part 11A with aluminum tape 43A.

Figure 5:
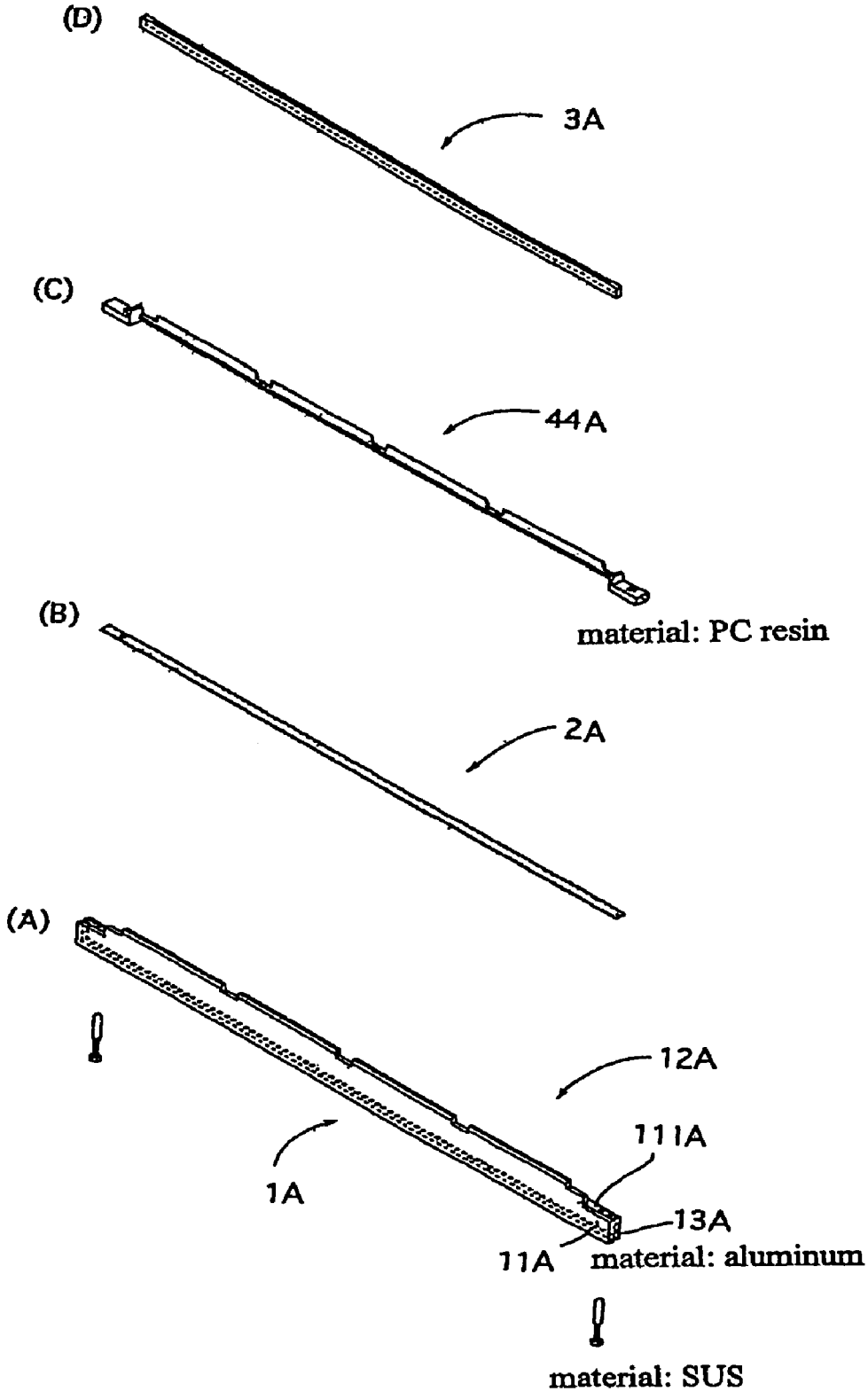
FIG. 5 is a developed perspective view of the LED print head in the first example showing the total of each element.

As shown in FIG. 5, said print head of the first example consists of a base body 1A, an LED base panel 2A, a lens array 3A, and a cover parts 44A, wherein said base body consists of said base part 11A and said projecting part 12A extending obliquely upward from one side (in the crosswise direction) of said base part 11A, so that said base body has a h-shaped cross section (FIG. 5(A)), said LED base panel 2A is fitted on the upper face 111A of said base body 1A (FIG. 5(B)), said lens array 3A is fixed to the upper part of the inside face of said projecting part 12A of said base body 1A with a sealing agent 32A (FIG. 5(D)), and the both sides of said cover parts 44A are fixed respectively to said lens array 3A and said base part 11A (FIG. 5(C)).

Figure 6:
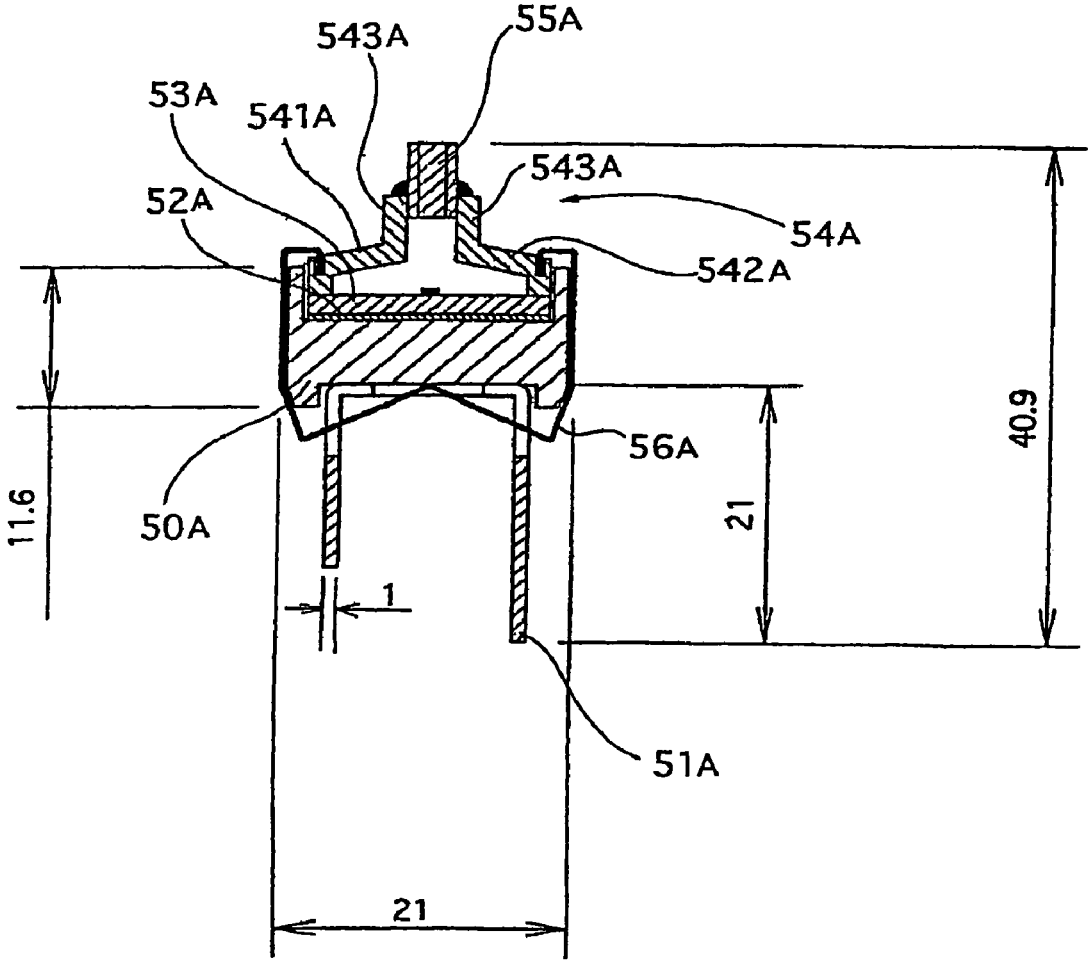
FIG. 6 is a cross-sectional view of the LED print head in a comparative example of the first example.
Figure 7:
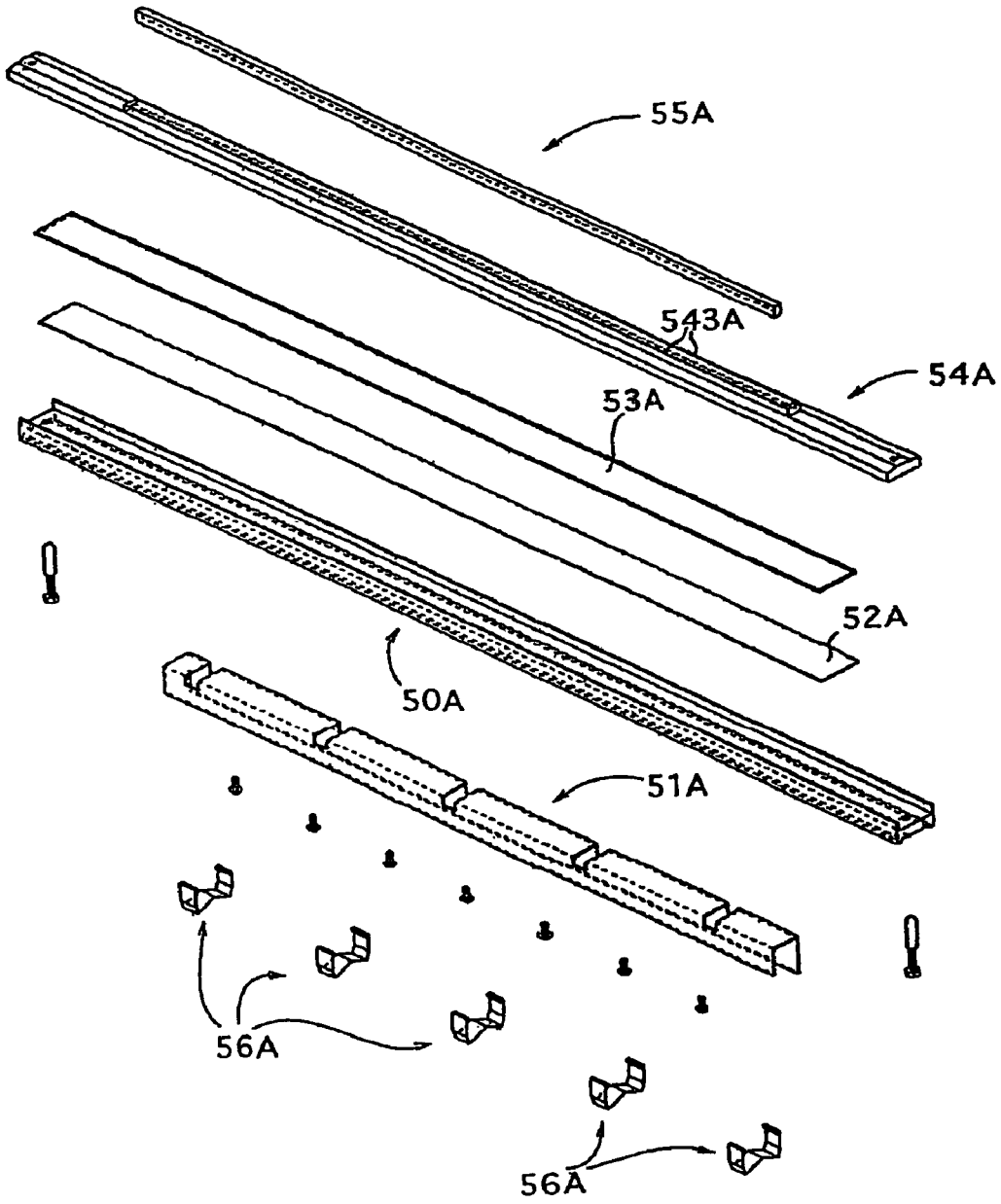
FIG. 7 is a developed perspective view of the LED print head in a comparative example of the first example showing the total of each element.

On the other hand, as shown in FIGS. 6 and 7 an LED print head of COMPARISON consists of a base 50A which is substantially I-shaped and has the width (along the lateral direction) of 21 mm and the height of 11.6 mm, a heat sink 51A arranged on the underside of said base 50A and the length of the longer leg of said heat sink 51A, being 21 mm, having substantially U-shape, an LED base panel 53A fitted to the upper face of said base 50A though an isolating sheet 52A, a cover 54A equipping a pair of substantially L-shaped parts 541A, 542A attached to said LED base panel 53A so as to contact both ends of said parts 541A, 542A with both sides of said base panel 53A, a lens array 55A fixed between the inside vertical edges 543A of said L-shaped parts 541A, 542A of said cover 54A, and a plural number of U-shaped wire springs 56A, and the whole height of said LED print head is 40.9 mm In said LED print head of the first embodiment having above described structure, said LED print head being arranged opposite to a photosensitive drum, since a base part 11A is arranged is settled to have a large volume, composing the base body 1A arranged along the axis of said photosensitive drum and having a upper face 111A which is opposite to said photosensitive drum and on which an LED base panel 2A, and a small volume projecting part 12A having a narrow width is extended upward from a section of said upper face 111A of said base part 11A, said projecting part 12A composing said base body 1A on which a lens array 3A is arranged between the opposing face of said photosensitive drum and the upper face of said LED base 2A panel, meaning said lens array 3A is supported by only said narrow and small volume projecting part 12A, so that the occupied angle for said photosensitive drum can be settled to be small.

Further, in said LED print head of the first embodiment, since said base body 11A has a slender h-shape and said closing member 4A is composed of a cover parts 44A being thinner than said projecting part 12A so that said closing member 4A little affects the width of said LED print head, the maximum of said print head is mostly decided by the width of said base part 11A (8 mm), and is 38% of the maximum width of said print head of the comparison (21 mm) shown in FIG. 6, said LED print head of the first embodiment can be settled to be thin and the colorization in tandem system can be put into practice.

Still further, in said LED print head of the first embodiment, since said base part 11A is settled to have a large volume (cross section area 123.2 $mm^2$) and said small volume projecting part 11A is formed being connected to said base part 11A to improve the heat transfer to said large volume base part 11A, and the average temperature of said base body 1A can be lowered to reduce the temperature difference in said base body 1A, the thermal deformation by heating can be suppressed to prevent the degradation of heat stability and thermal mechanical strength, so that the bad influence on image can be avoided.

Now, thermal deformation quantity of light emitting elements on said LED base in said body was considered compared to the first embodiment and said COMPARISON.

Figure 8:
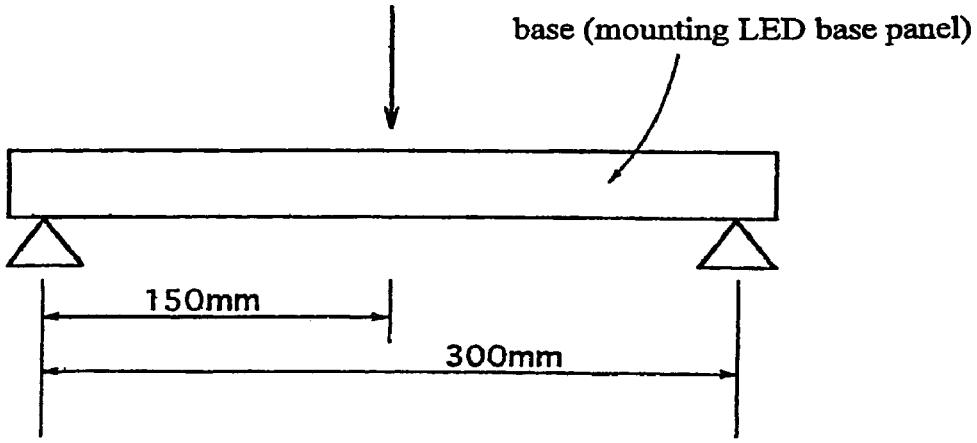
FIG. 8 is an illustration describing a method for measuring with a laser scale the changing amount of the base body's middle point in Z direction, caused by the heat deformation, said base body composing the LED print head in the first and its comparative examples.

The length of said base body on which an LED base panel is fitted is 300 mm, on said LED base panel a large numbers of light emitting elements being arranged in a line. Both ends of said LED base panel were supported as shown in FIG. 8 and all light-emitting elements on said LED base panel were lighted up for affixed time and then turned off.

Figure 9:
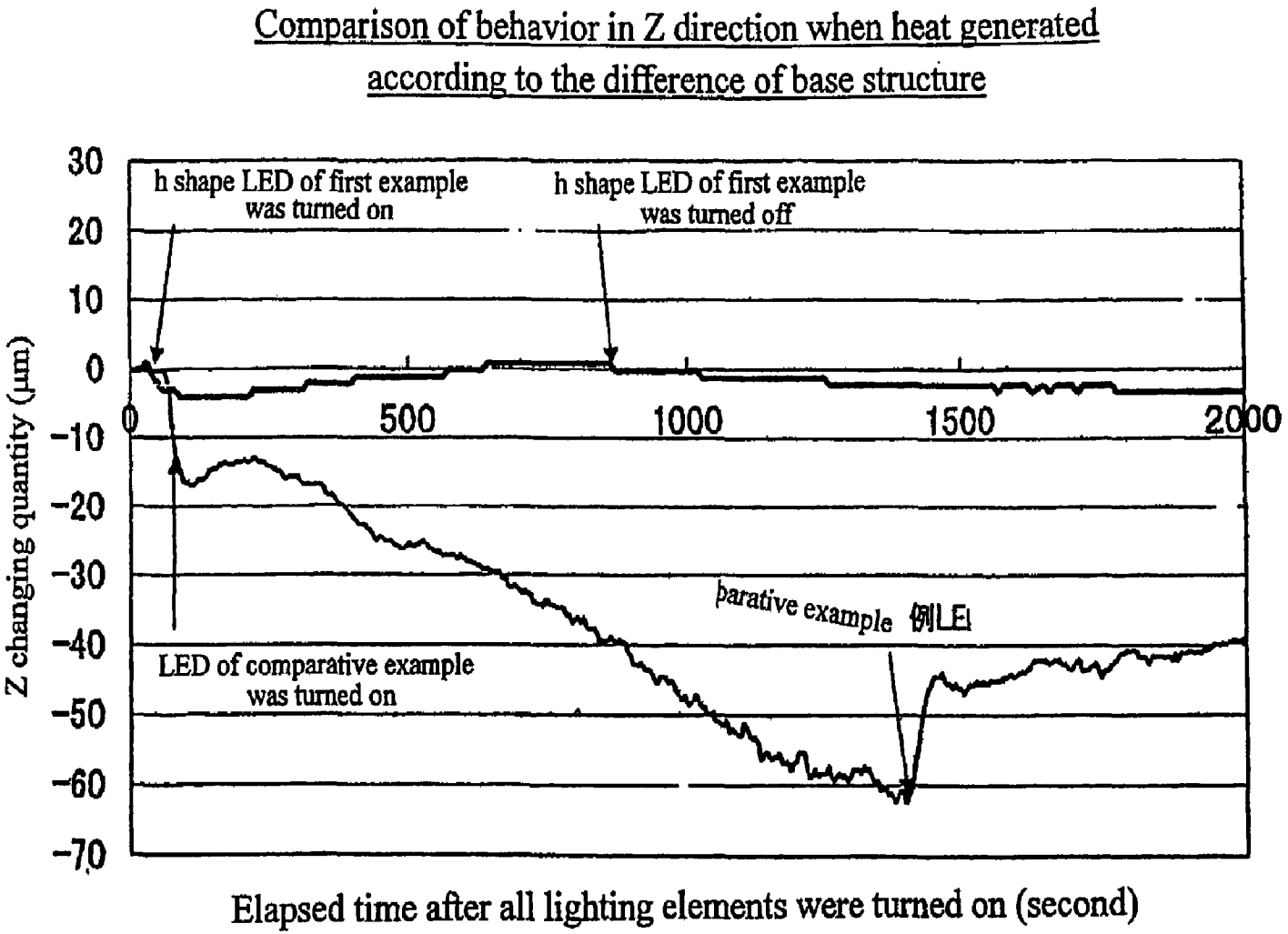
FIG. 9 is a diagrammatic view showing the changing amount of the base body's middle point in Z direction in a time series caused by the heat deformation of said base body in the first and its comparative examples.

After then, the quantity of the position shift (Z direction) of the middle point (upward position shift (+), downward position shift (−)) is determined by non-contact type measuring instrument(a laser scale) and as a result, the quantity of the position shift (Z direction) of the middle point of said LED base panel changed as shown in FIG. 9.

Referring to FIG. 9, it is clear that quantity of the position shift gradually increased after all light emitting element were lighted up, to reach maximum −60 μm just before turning off in COMPARISON, while in the first embodiment, the position shifted in very small range (± a few μm) regardless of the timing of turning off, and this quantity is lower in the range of one-digit compared with that of said COMPARISON.

Further, in said LED print head of the first embodiment, besides the action and effect of the above described print head of the third embodiment, since said closing member 4A is composed of said thin cover parts 44A, and one side of said cover parts 44A is fixed to the other side face of said lens array 3A with said adhesive 33A and sealed with LED by said sealing agent, and the other side of said cover parts 44A is fixed to the side wall of said base part 11A with said tape 43A, enough strength is given to said dosing member 4A composed of said thin cover parts to improve reliability of said closing member 4A. Said LED base panel 2A consists of semiconductive chips to emit light on the print base panel and lead wire and the like, in the case where no closing member is used, in said LED print head, as a result, the parts of said LED base panel 2A may be corroded, and dust, toner, and the like may stick to said semi-conductive chips for light-emitting and the light receiving face of said lens array 3A.

Still further, in said LED print head, a closing means is necessary to shut the air that produces blur on the face of lenses of said lens array 3A by invading of carbon dioxide gas, ozone and the like, so that said lens array 3A is sealed by said cover part 44A composing said closing member 4A by using said sealing agent, and said cover parts 44A is fixed to said base part 11A by using said aluminum tape 43A, so that workability is improved and the cost is reduced by using said tape.

Up to now, silicone rubber has been used commonly as a sealing means to seal the fitted part between said base body and said lens array, and the lead wire part to protect corrosion, where said aluminum tape 43A is used to seal said print head simply so that said print head of the first embodiment has advantages in workability and cost compared with the conventional print head.

THE SECOND EXAMPLE

Figure 10:
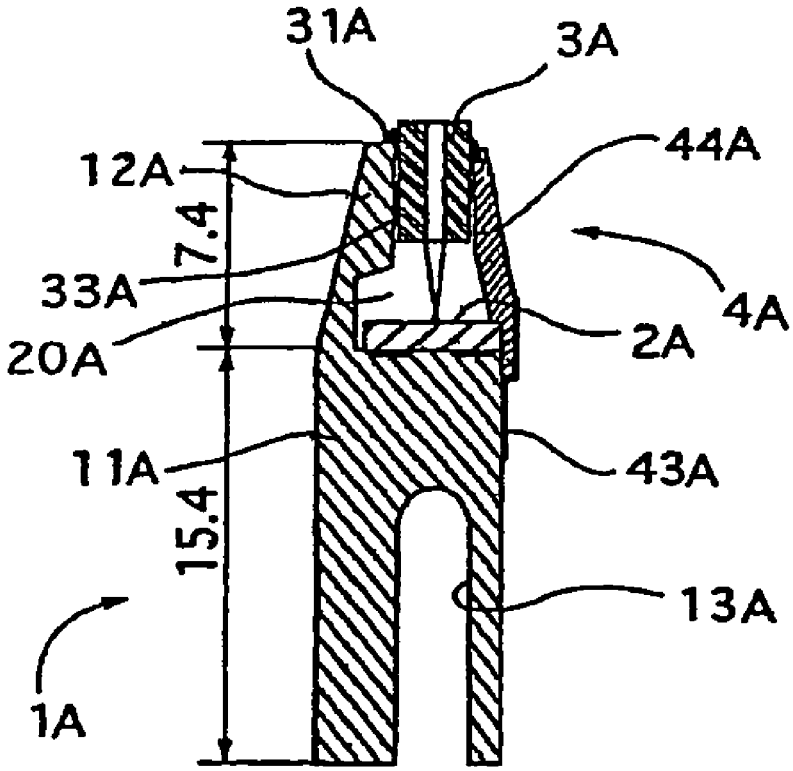
FIG. 10 is a cross-sectional view of the LED print, head in the second example of the present invention.

In said LED print head of the second example, three samples, wherein said base part 11A of said base body 1A of each sample has a different height respectively for the fixed height of said projecting part 12A, were prepared as shown in FIG. 10 and Table 1, and both ends of said base body were supported to determine bending quantity of the middle unit of said base body when the concentrated load was applied on the middle point of each sample as shown in FIG. 8.

TABLE 1

| | Z | |
|---|---|---|
| Vertical length(mm) | μm | ratio |
| 7.5 | 61.3 | 4.8 |
| 15.4 | 12.8 | 1 |
| 30.0 | 3.4 | 0.3 |

Said LED print head of the second example has the same structure as said LED print head of the first example and shape and size of each part are nearly same as said LED print head of the third embodiment and precise description about the structure of said LED print head is omitted.

In said LED print head of the second example, three kinds of samples, having different height of said base part 11A of said base body 1A respectively (7.5 mm, 15.4 mm, 30.0 mm) for the fixed height of said projecting part 12A (7.4 mm) were prepared, and both ends of each sample were supported as shown in FIG. 8 and the concentrated load 0.5 kgf was applied on the middle point of each sample (middle point in a lengthwise direction) and the position shift of the middle point (position separating 150 mm from the end of the sample), said position shift being in Z direction (underside direction in FIG. 8), was determined with the laser scale as a non-contact type measuring instrument and as a result, the shift quantity of the middle point in Z direction, warping quantity (μm), and the ratio (the ratio of the warping quantity when the height of said base part is 15.4 mm is settled to be 1) are shown in Table 1.

Namely, in the case of the height of said base part 11A is 15.4 mm, the warping quantity is 61.3 μm, the ratio is 4.8, in the case of the height of said base part is 15.4 mm the warping quantity is 12.8 μm and the ratio is 1, and in the case of the height of said base part 11A is 30.0 mm, the warping quantity is 3.4 μm and the ratio is 0.3.

As compared with the case wherein the height of said base part 11A is 15.4 mm and the ratio of the warping quantity is 1, in the case where the height of said base part 11A is 7.5 mm (about half of 15.4 mm, the ratio of the warping quantity is 4.5 (about 5 times), and in the case where the height of said base part 11A is 30.0 mm (about twice of 15.4), the ratio of the warping quantity is 0.3 (about ⅓).

In the second example, the minimum height of said base part 11A is preferably 7.5 mm, higher than the height of said projecting part 12A (7.4 mm as described), above and considering above described results, if the height of said base part is 7.5 mm, the warping quantity is 61.3 μm, and assuming that said warping quantity is 1, in the case where the height of said base part is 15.4 mm (about twice of 7.5 mm), the warping quantity is 12.8 μm (about ⅕), and in the case where the height of said base part 11A is 30.0 mm (about 4 times), the warping quantity is 3.4 μm (about 1/20), so that the warping quantity reduces drastically as the height (cross section area) of said base part 11A increases compared with the height (cross section area) of said projecting part 12A, and thermal deformation by heating is suppressed to prevent the degradation of thermal stability and thermal strength, so that the bad influence on image is avoided.

Further, besides the example in that the height of said base part 11A is 15.4 mm to suppress the warping quantity to about ⅕ of 61.3 μm in the case of the height of 7.5 mm, the example in that the height of said base part 11A is 10.5 mm or 12.7 mm to suppress the warping quality to ½ or ⅓ of 61.3 μm in the case of the height of 7.5 mm also comes into effect in the present invention.

Generally, two kinds of said base bodies are illustrated and described in the first embodiment to the third embodiment and the first example and the second example but these embodiments or examples do not limit the scope of the present invention and sizes of said base part and said projecting part, kinds the numbers, situations of said notched dent groove for heat radiation, and the like can be altered if necessary.

Figure 11:
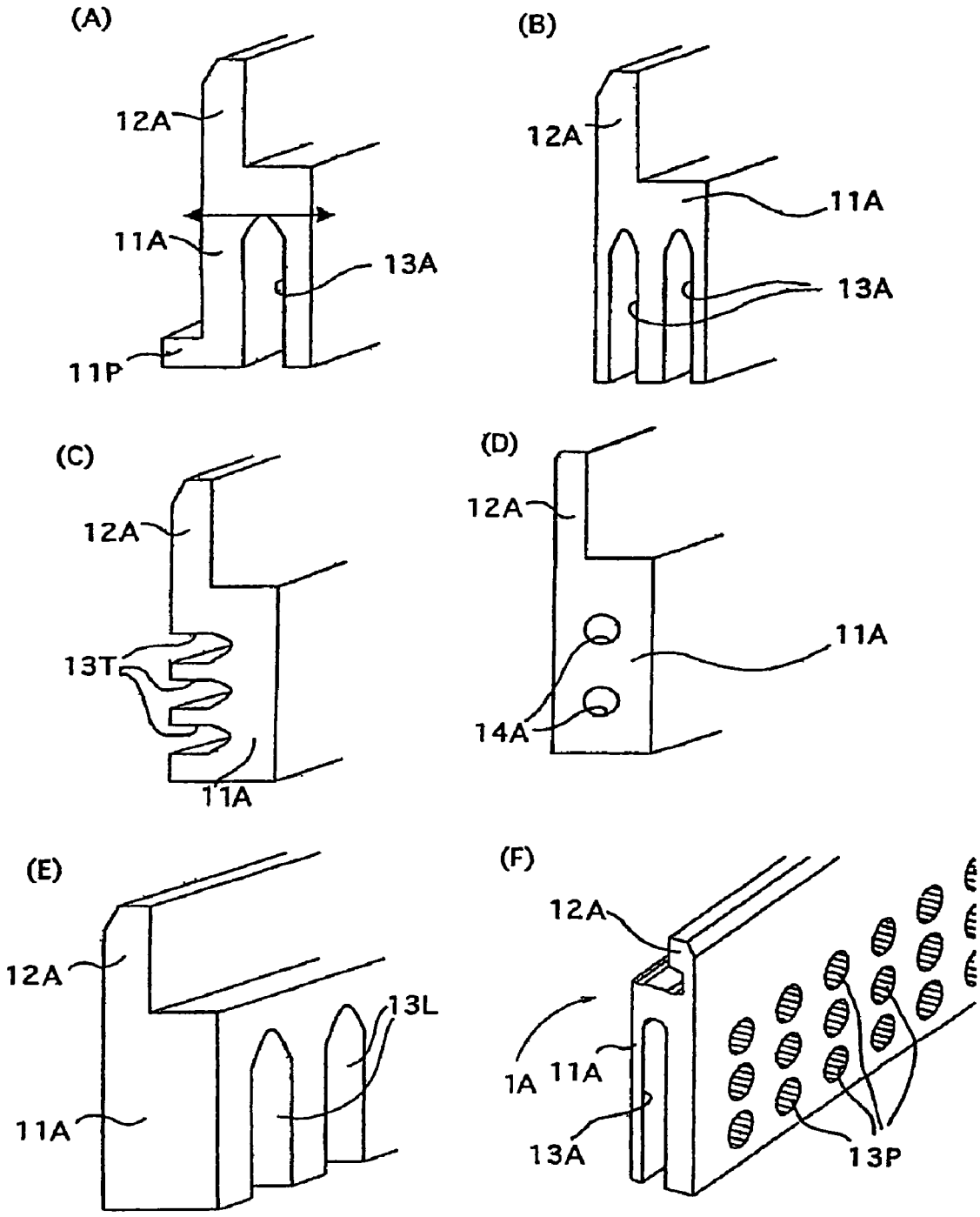
FIG. 11 is a perspective view showing examples of the base body's deformations in the LED print head in the embodiment and the example of the present invention.
Figure 15:
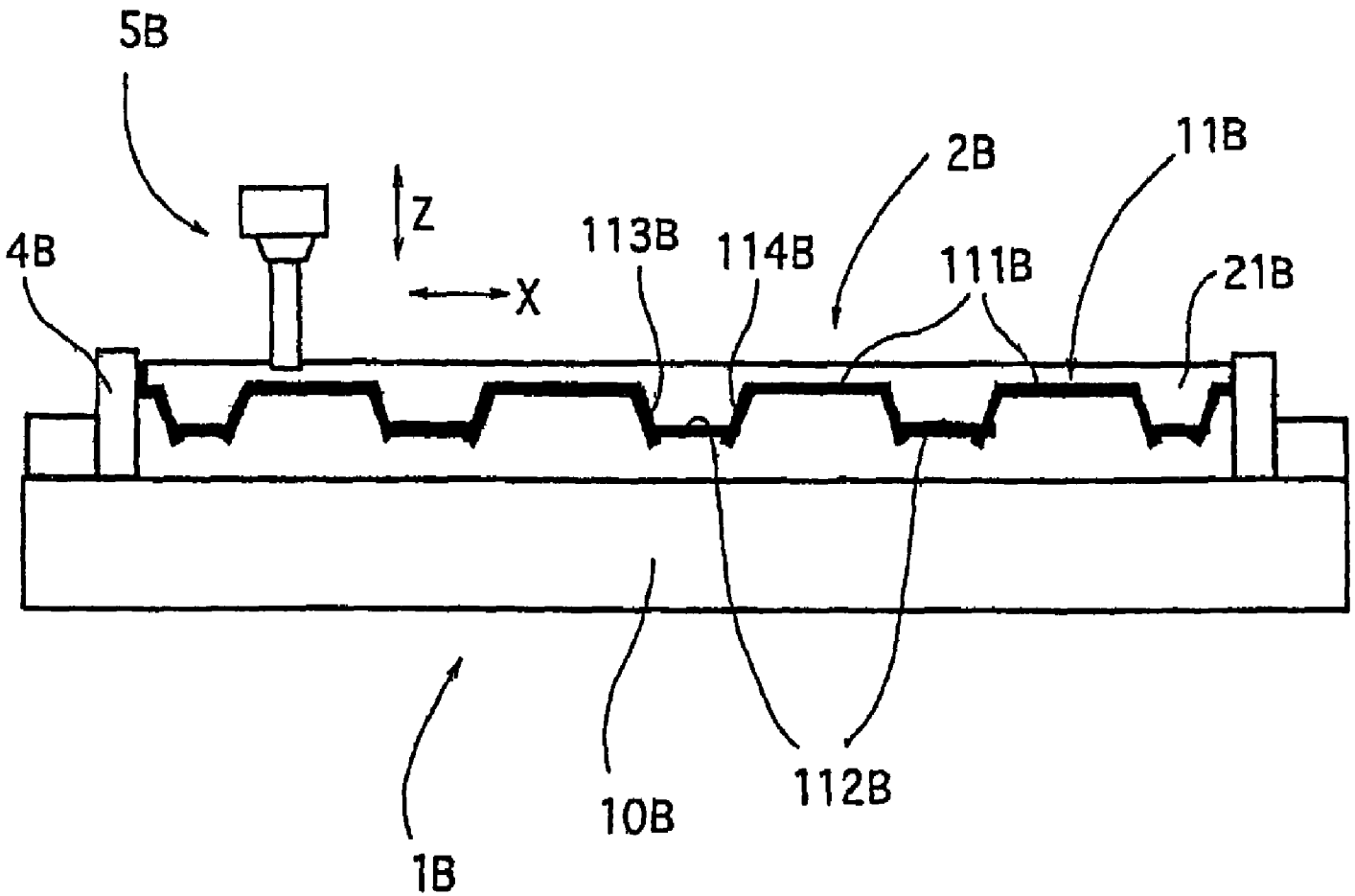
FIG. 15 is an illustration describing the method for manufacturing the LED print head in the fourth embodiment and in the third example according to the present invention.

In an alteration 1 shown in FIG. 11(A), a notched dent 13A for heat radiation is formed from the bottom of a base part 11A, the same as the third embodiment and example above described and further, a lateral protrusion 11P is formed at the lower end of one side wall of said base part 11A to increase the strength of base part 11A in the lateral direction.

In an alteration 2 shown in FIG. 11(B), the plural number of notched dents for heat radiation are formed from the bottom of said base part 11A to increase the heat radiation area, the structure of said base part 11A is the same as the third embodiment and example described above.

In an alteration 3 shown in FIG. 11(C), a plural number of lateral notched dents 13T are formed from one side wall of said base part 11A and said base part 11A can be fitted to the base at its lower face to ensure accuracy of the distance from the lower face of the unit to the focus.

In alteration 4 shown in FIG. 11(D), a plural number of penetrating holes 14A are formed in said base part 11A in the lengthwise direction of said base part 11A and said base part 11A can be fitted to the unit at its lower face to ensure accuracy of the distance from the lower face of the unit to the focus.

In an alteration 5 shown in FIG. 11(E), a plural notched dents 13L are formed from the bottom of said base 11A arranging in the lengthwise direction and penetrating in the crosswise direction corresponding to the convection current of the air to improve the heat radiating property by cooling said notched dents 13L with said convection current of the air accompanied by moving of the photo sensitive body.

In an alteration 6 shown in FIG. 11(F), a notched dent 13A is formed for heat radiation from the bottom of said base part 11A having a height about four times of the height of said projecting part 12A wherein said notched dent 13A has a depth ⅚ of the height of said base part 11A, and further a large numbers of penetrating holes 13P are formed at regular intervals form the side wall of said base part 11A to improve the heat radiation property.

Although some example of said closing member are described in the first embodiment, to the third embodiment and the first example and the second example, the scope of the present invention are not limited by said embodiments and examples and said closing member of said sealing member to close the opening between said LED base panel 2A and said base parts 11A may be composed of a tape such as conductive tape, insulation tape, and shade tape and the like, shade film, a thin panel such as metal panel, synthetic resin panel, glass panel and the like or a synthetic resin such as synthetic resin adhesive, synthetic resin protecting agent, or a fiber sheet such as paper, cloth and the like, shade glass and rubber and the like, or a complex consisting of two or more kinds of said materials and by using said closing member or sealing member, said light-emitting part can be protected without influence on holding lenses.

[The Fourth Embodiment]

In an LED print head and a method for manufacturing said LED print head of the fourth embodiment, as shown in FIGS. 15 to 19, the method comprises bringing a side face 21B of the lens array 2B close to the upper section of the side face 12B of the projecting part 12 of a base body 1A and in the state that the side face 21B of said lens array 2B is adjacent to the side face 12B of upper edge part 11B, said projecting part having crank shaped upper edge 11B consisting of a plural number of upper and lower horizontal edge parts 111B, 112B and a plural number of inclining edges parts 113B, 114B connecting said upper and lower edge parts respectively to form a trapezoid shape, fixing said lens array 2B to the upper part of the side of said projecting part, applying a sealing agent between said lens array 2B and the side of the projecting part 12, said crank shaped upper edge part 11B consisting a plural number of upper and lower side horizontal edge part 111B, 112B and a plural number of inclining edge parts connecting the respective ends of said upper and lower side horizontal edge parts 113B, 114B, forming a trapezoid shape.

A fitting apparatus to manufacture said LED print head and used in said method for manufacturing said LED print head in the fourth embodiment consists of a coating nozzle 5B held inclining at a fixed angle, said coating nozzle coats a sealing agent between the side 12B of said crank shaped upper edge part and the side face of said lens array 2B, a biaxial robot 6B which is the orthogonal type controlling the position of said coating nozzle 5B on X-axis at Z-axis, a robot controller 7B controlling and driving said biaxial robot 6B, a dispenser 8B supplying said sealing agent to be coated to said coating nozzle, a sequencer 9B controlling said dispenser 8B and said robot controller 7B, and an operation panel 90B ordering about operation to said sequencer 9B and performing various information input.

Said base body 1B consists of a base part 10B having a rectangular cross section and a projecting part 13*b* having a rectangular cross section, said projecting part 13*b* being narrower than said base part 10B, and LED base panel 3B is fitted to a side shoulder part 14B in advance and the upper edge 11B of said projecting part 13B has upper side and lower side horizontal edge parts 111B and 112B, and straight inclining edge parts 113B and 114B connecting both sides of said upper side and lower side horizontal edge parts 111B and 112B to form a trapezoid shape, upward trapezoid shapes and down ward trapezoid shapes being arranged mutually at regular intervals to form a crank shaped upper edge 11B.

Said lens array 2B is constructed of a cell fox lens array made of a square pillar having a rectangular cross section Now fitting said lens array 2B to said base body 1B before a sealing agent is coated by using above described fitting apparatus is described below.

Figure 16:
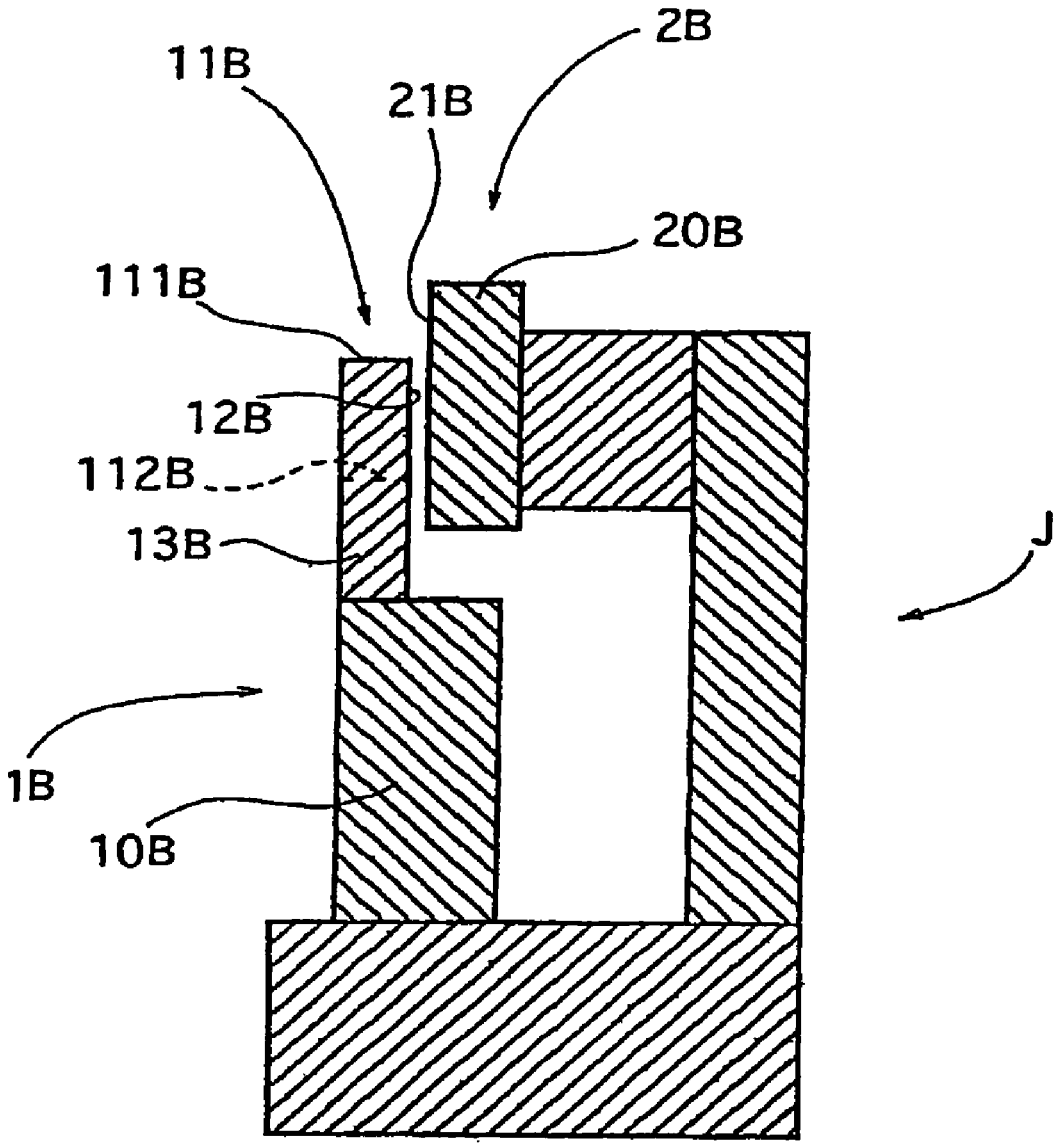
FIG. 16 is a cross-sectional view describing the position adjusting process in the method for the manufacturing the LED print head in the fourth embodiment and in the third example.
Figure 17:
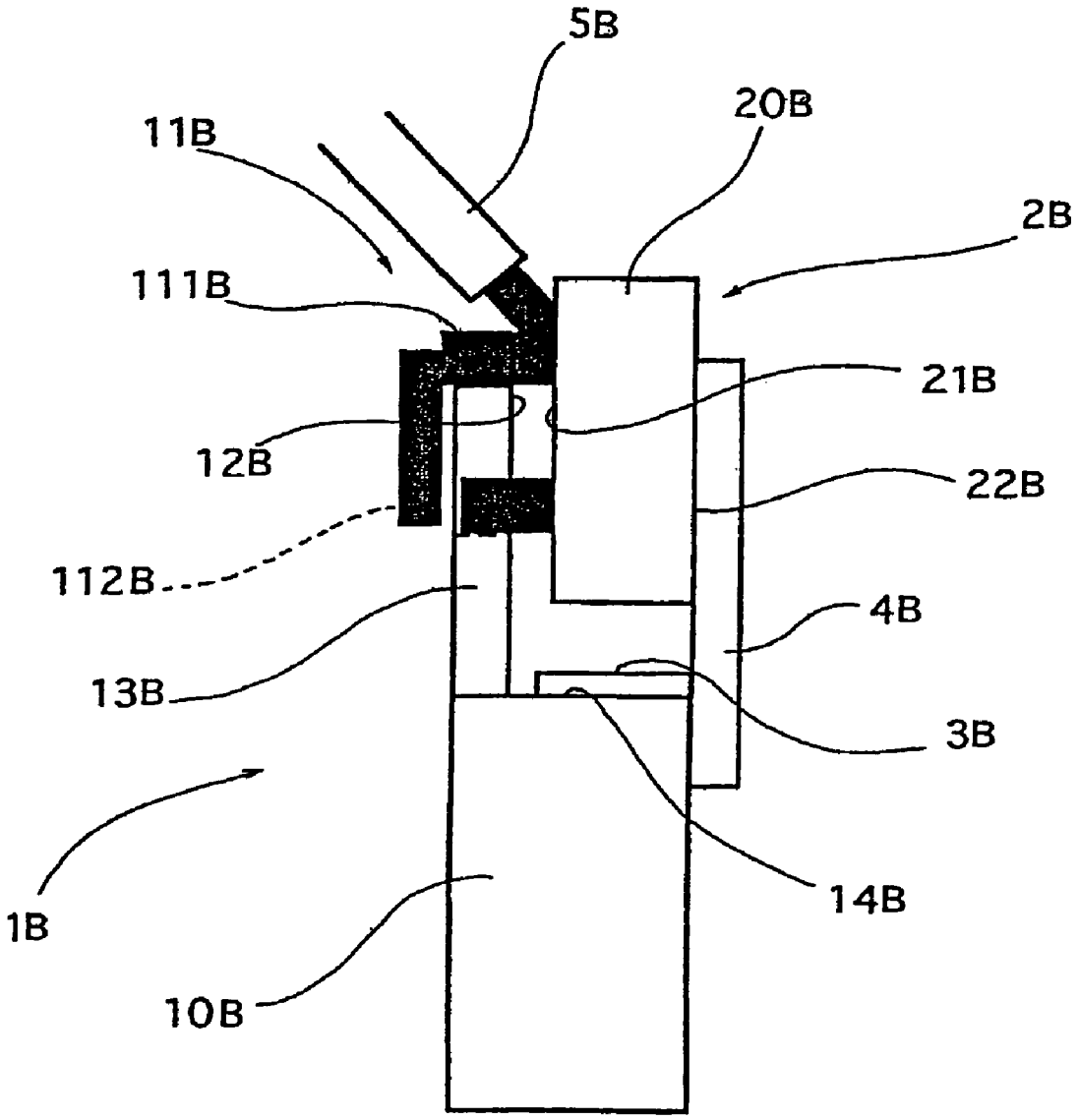
FIG. 17 is a cross-sectional view describing an applying process of a sealing agent in the manufacturing method for manufacturing of LED print head in the fourth embodiment and in the third example.
Figure 18:
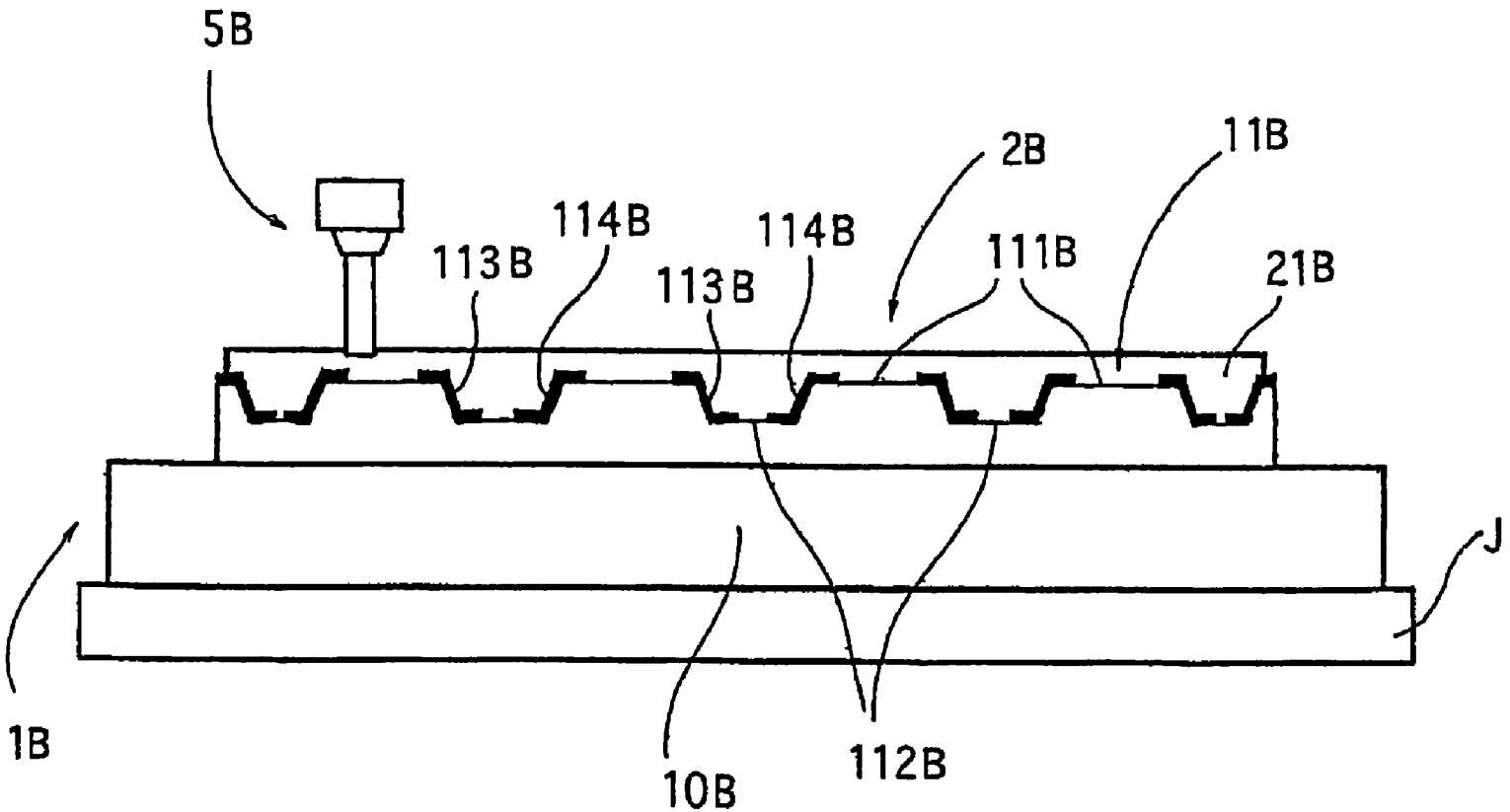
FIG. 18 is an illustration to describe an applying process of an adhesive in the manufacturing method for manufacturing of LED print head in the fourth embodiment and in the third example.
Figure 19:
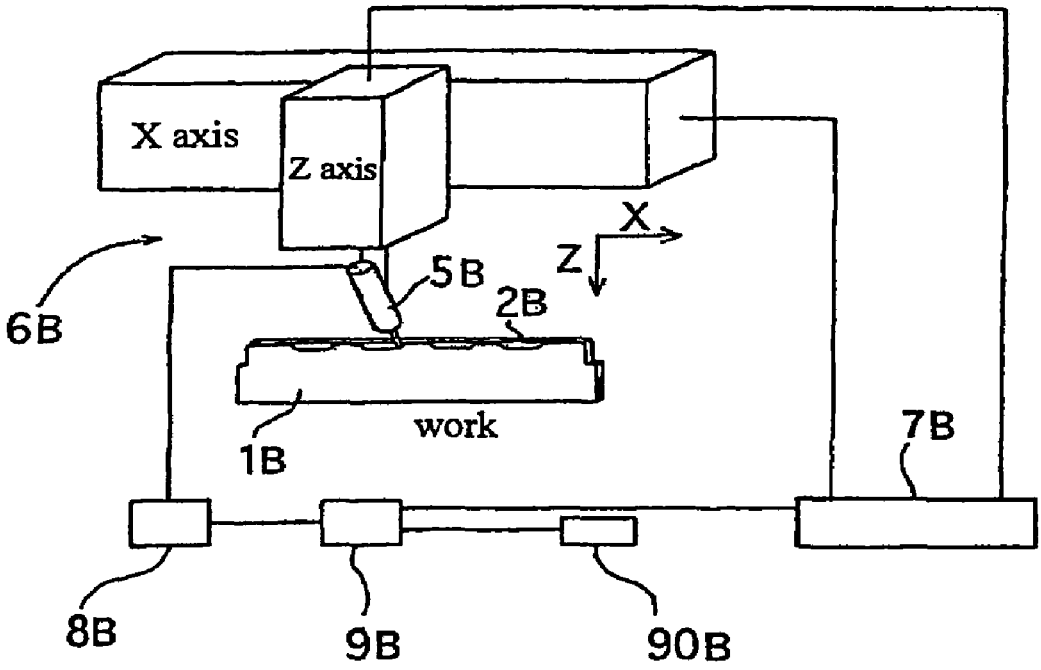
FIG. 19 is a total structural diagram showing an apparatus for fitting of the LED print head in the fourth embodiment and in the third example.
Figure 20:
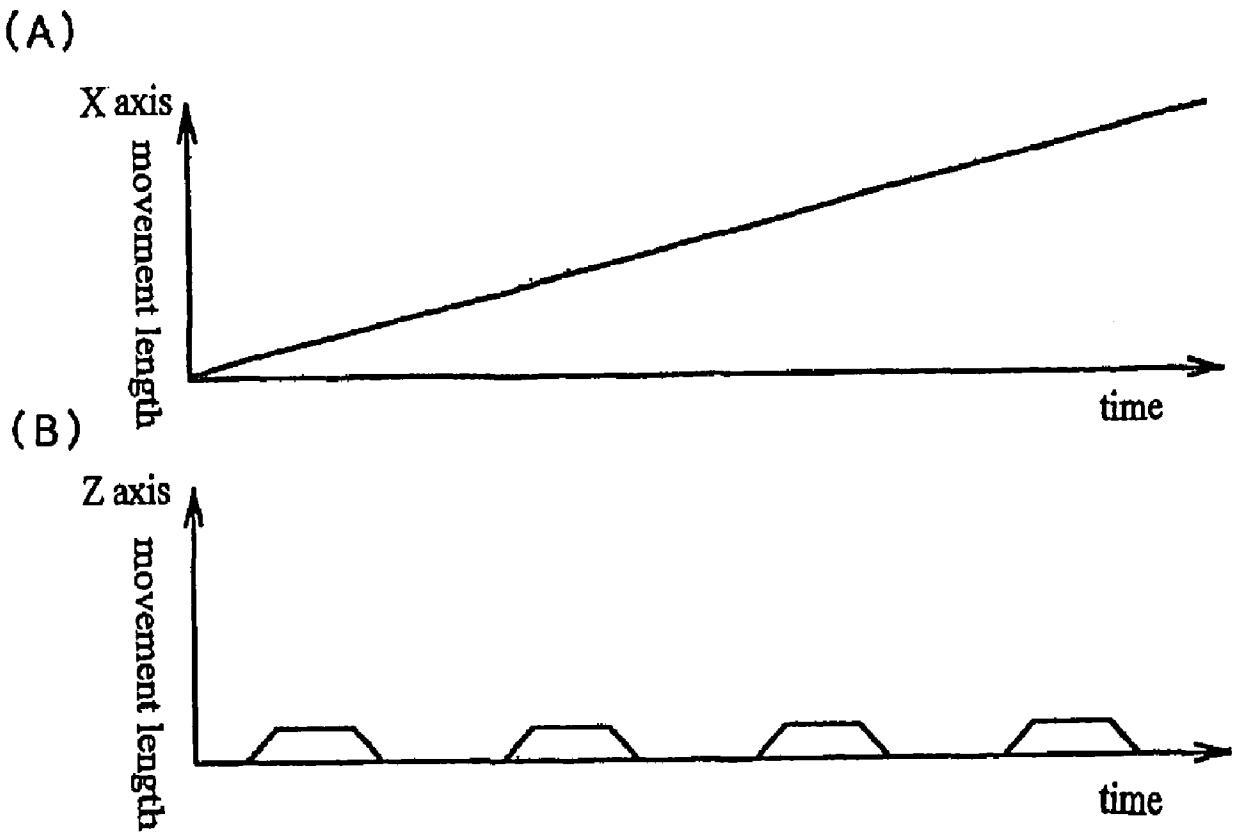
FIG. 20 is a diagrammatic view describing position shifts of a coating nozzle in the fourth embodiment and in the third example.
Figure 21:
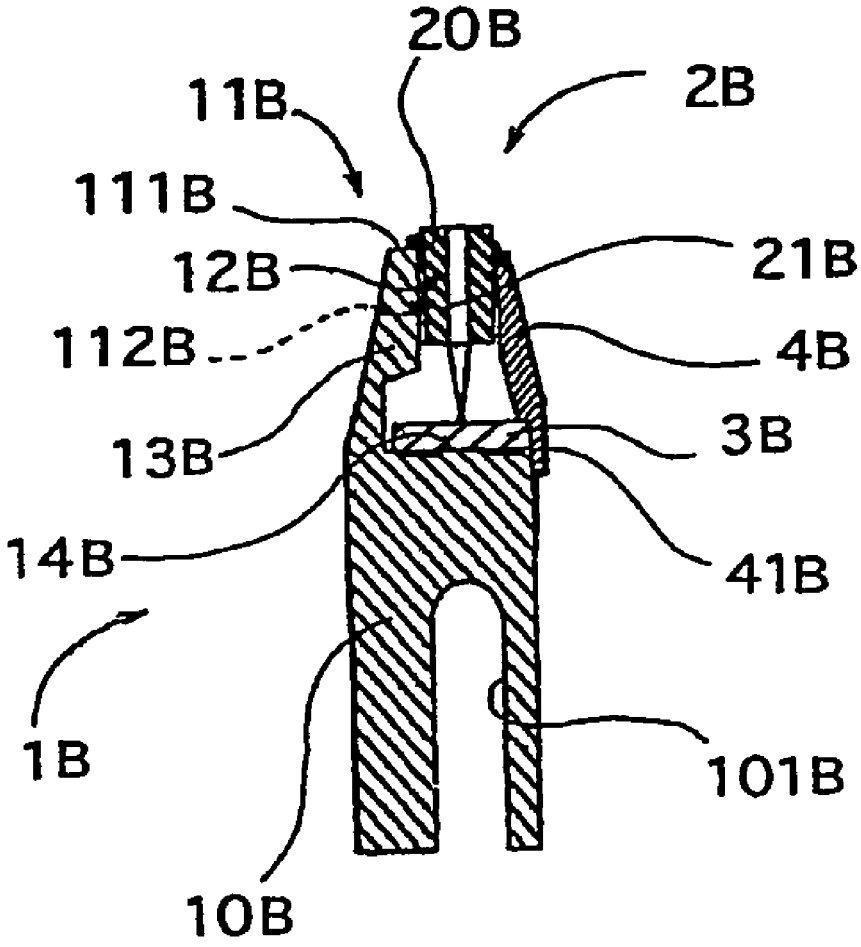
FIG. 21 is a cross-sectional view of the LED print head being fitted.

Positions of said lens array 2B and said base body 1B are optically adjusted by a position adjusting jig J shown in FIG. 16, and then the vertical side face 12B of said base body 1B and the vertical side face 21B of said lens array 2B are brought close respectively at a fixed interval and an adhesive is coated to 10 places (5 trapezoid shape) shown in FIG. 18 fixing mechanically said base body 1B and said lens array 2B to harden said adhesive.

After said adhesive is hardened, fixing by said position adjusting jig J is released and a cover 4B is fitted to the side face 22B of said lens array 2B. A sealing agent is coated to the crevice between the upper end parts of the side face 12B and said base body 1B and the side face 21B of said lens array 2B and the crevice between the side face 22B of said lens array and the upper end part of the side face of said cover 4B.

First how to coat said sealing agent to the crevice between the upper end part of the side face 12 A and the side face 21B of said lens array is described. Namely, said base body 1B has a crank-shaped upper edge 11B consisting of upper side and lower side horizontal edge parts 111B and 112B and straight inclining edge part 113B and 114B connecting both ends of said upper side and lower side horizontal edge parts to form trapezoid shapes, and said sealing agent is coated to the crevice between said crank-shaped upper edge 12B and the side face 21B of said lens array. Said biaxial robot 6B grasps said coating nozzle 5B and controls position of said coating nozzle 5B on X-axis and Z-axis, and said biaxial robot 6B is driven and controlled by a controlling signal from said robot controller B to control said coating nozzle so as to change positions of said coating nozzle on X-axis and Z-axis shown in FIG. (A) and (B).

Accordingly said nozzle 5B moves along the upper side horizontal edge part 111B of the crank-shaped upper edge 11B of said base body 1B and then moves toward the lower side horizontal edge part 112B through the straight inclining edge part 113B downward toward right side and then moves toward the upper side edge part 111B through the straight inclining edge part 113B upward toward right side, and said movement cycle of said coating nozzle 5B is repeated 5 times and as a result, the sealing agent supplied from said dispenser 8B is coated continuously and uniformly along all upper side and lower side horizontal edge parts 111B and 112B and all straight inclining edge parts 113 and 114B at both sides of said upper side and lower side horizontal edge parts 113B and 114B of said crank-shaped upper edge 11B.

Since said LED print head of the fourth embodiment has said base body 1B whose crank-shaped upper edge 111B consists of the upper side and lower side horizontal edge parts 111B and 112B and said inclining edge part 113B and 114B at both sides of said upper side and lower side horizontal edge parts 111B and 112B to form trapezoid shape, said coating nozzle 5B can coat the sealing agent continuously over whole said crank-shaped upper edge without changing angles namely orientation of said coating nozzle 5B, working process and working time can be reduced to reduce the manufacturing cost.

Namely up to now, in the case of coating sealing agent automatically, once the sealing agent is coated to horizontal edge and then the position of said base body is turned at 90° to make to vertical edge be horizontal and the sealing agent is coated again so that many working processes are necessary, while in the fourth embodiment, the sealing agent can be coated in one process without turning the position of said base body by settling edge parts at both side of upper side and lower side horizontal edge part to incline so that mass-productivity is improved.

Further, in the case of conventional rectangular upper edge of said base body, the sealing agent should be coated to two sides of the right triangle making a right angle respectively while in the fourth embodiment the sealing agent is coated to the hypotenuse so that the coating quantity of the sealing agent can be reduced to reduce the raw material cost.

Furthermore, the profile of trapezoid shape of the crank-shaped upper edge 11B of said base body 1B of the fourth embodiment is smoother than the profile of conventional rectangular shape, so that the sealing agent can be filled into whole crevice uniformly along whole length of said upper edge.

Still further, in said LED print head of the fourth embodiment, since said inclining edge parts are respectively straight edge parts, 113B and 114B, the position control (movement) of said coating nozzle become line area so that the position control of said coating nozzle becomes easy and precise.

In addition, in the method for manufacturing said print head of the fourth embodiment, the sealing agent is coated continuously in one process to the crevice between said crank-shaped upper edge 11B and the side for 21B of said lens array 2B by moving said coating nozzle 5B along said crank-shaped upper edge 11B having upper side and lower side horizontal edge parts 111B and 112B and inclining edge parts 113B and 114B at both ends of said upper side and lower side horizontal edge parts and when the sealing agent is coated to said upper side and lower side horizontal edge parts 111B and 112B, said coating nozzle 5B moves in the lengthwise direction of said base body 1B and when the sealing agent is coated to said inclining edge part 113B, said coating nozzle 5B moves along the oblique height of said base body 1B so that working process can be reduced and control to coat the sealing agent becomes regular and simple and angle (orientation) control of said base body 1B is to be not necessary.

In the method for manufacturing LED print head of the fourth embodiment, since said coating nozzle 5B is controlled by said biaxial robot 6B so as to move along said crank-shaped upper edge 11B having a pair of said inclining edge parts 113B and 114B extending from the both ends of said upper side and lower side horizontal edge parts, the sealing agent can be automatically coated to the side face of said crank-shaped upper edge 12B.

In the method for manufacturing LED print head of the fourth embodiment, said sealing agent is coated to said vertical base body 1B by said coating nozzle 5B inclining at an angle about 45° for said base body 1B, said sealing agent can go into the crevice between the side face 12B of said base body 1B and the side face 21B of said lens array 2B, a good sealing efficiency can be obtained.

THE THIRD EXAMPLE

AN LED print head and a method for manufacturing said LED print head of the third example are described referring to FIGS. 15 to 19 and FIGS. 21 and 22.

A base body 1B consists of a base part 10B having a rectangular cross section and projecting part 13B having a rectangular cross section whose width is narrower than the width of said base part 10B, said projecting part 13B extending obliquely upward from one side (in the crosswise direction) of said base part 10B, and LED base panel 3B is fitted to a side shoulder part 4B before hand.

A substantially U shaped notched dent 101B is formed in said base part 10B of said base body 1B to improve the heat radiation property and said base body 1B has wholly substantially h-shaped cross section and the upper edge 11B of said projecting part 13B has a crank-shape consisting of upper side and lower side horizontal edge parts 111B and 112B and inclining straight edge parts 113B and 114B extending to both ends of said upper side and lower side horizontal edge parts 111B and 112B to form a trapezoid profile so that the plural number of said trapezoid reversed profiles arranged alternatively at regular intervals.

Figure 22:
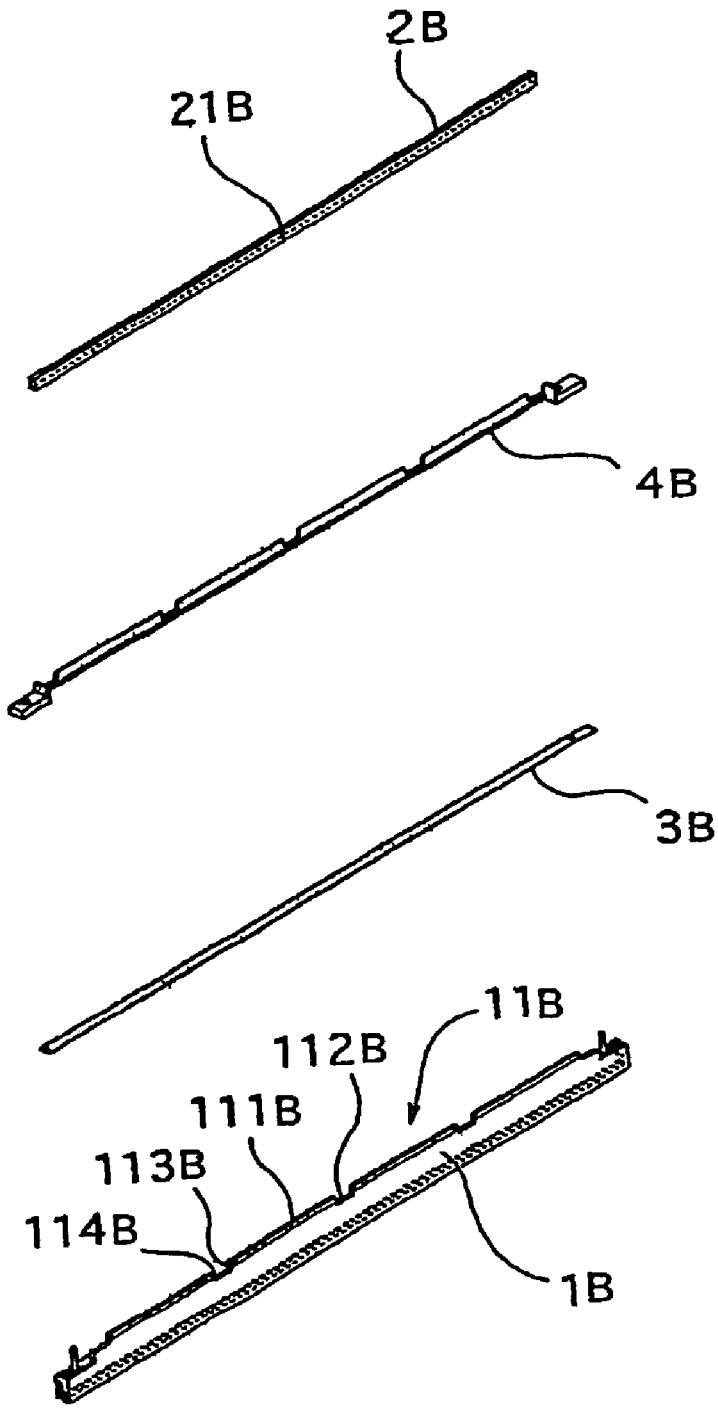
FIG. 22 is a development showing elements composing the LED print head in the third example.
Figure 23:
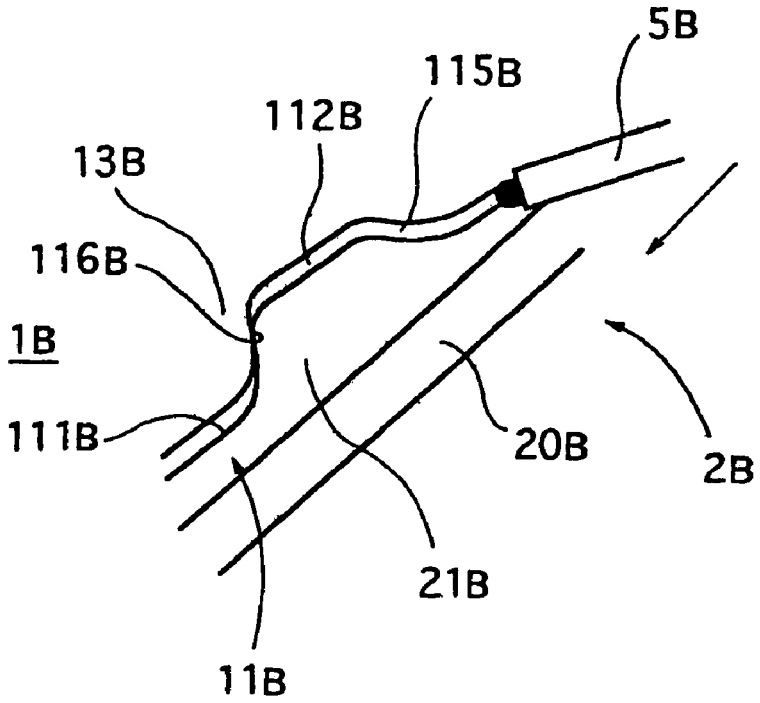
FIG. 23 is a perspective view describing the LED print head in another embodiment.
Figure 24:
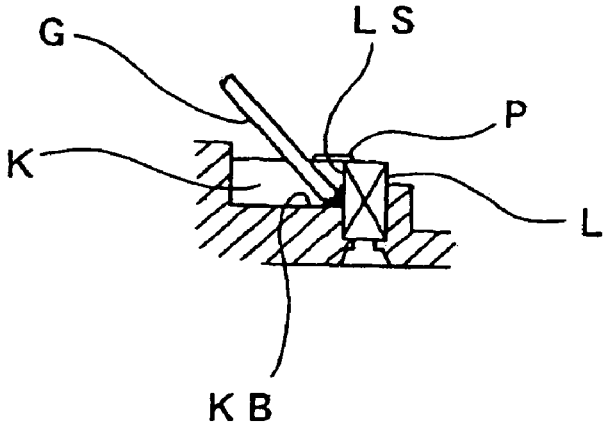
Fig.24 PRIOR ART
FIG. 24 is a partial cross-sectional view showing the main part of fixation structure of a conventional lens array.
Figure 25:
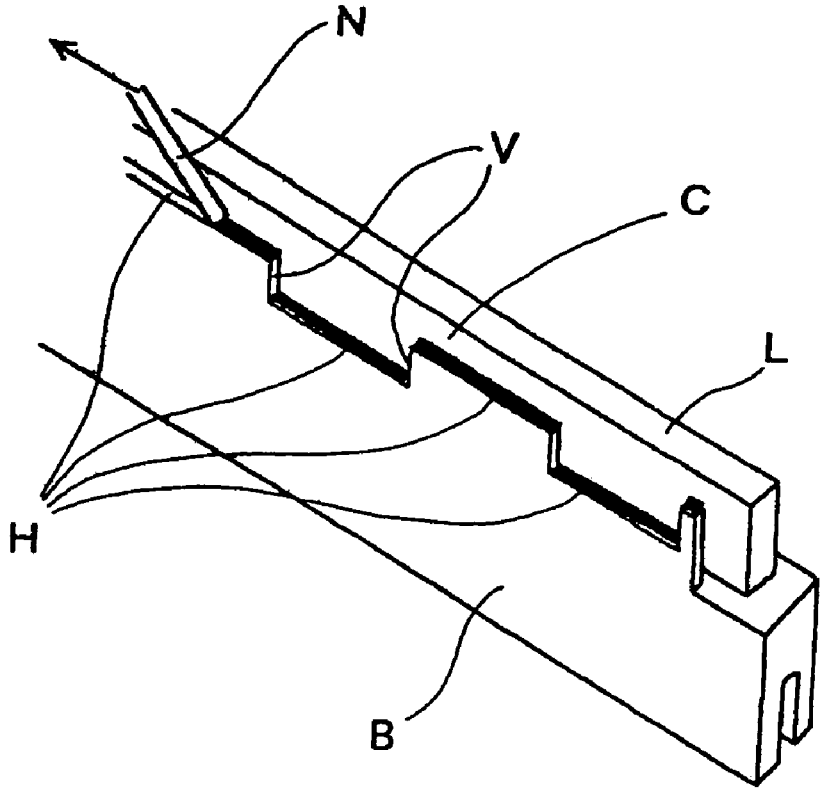
Fig.25 PRIOR ART
FIG. 25 is a perspective view describing an applying process of a sealing agent to horizontal edge parts in a conventional method for fixing a lens array.
Figure 26:
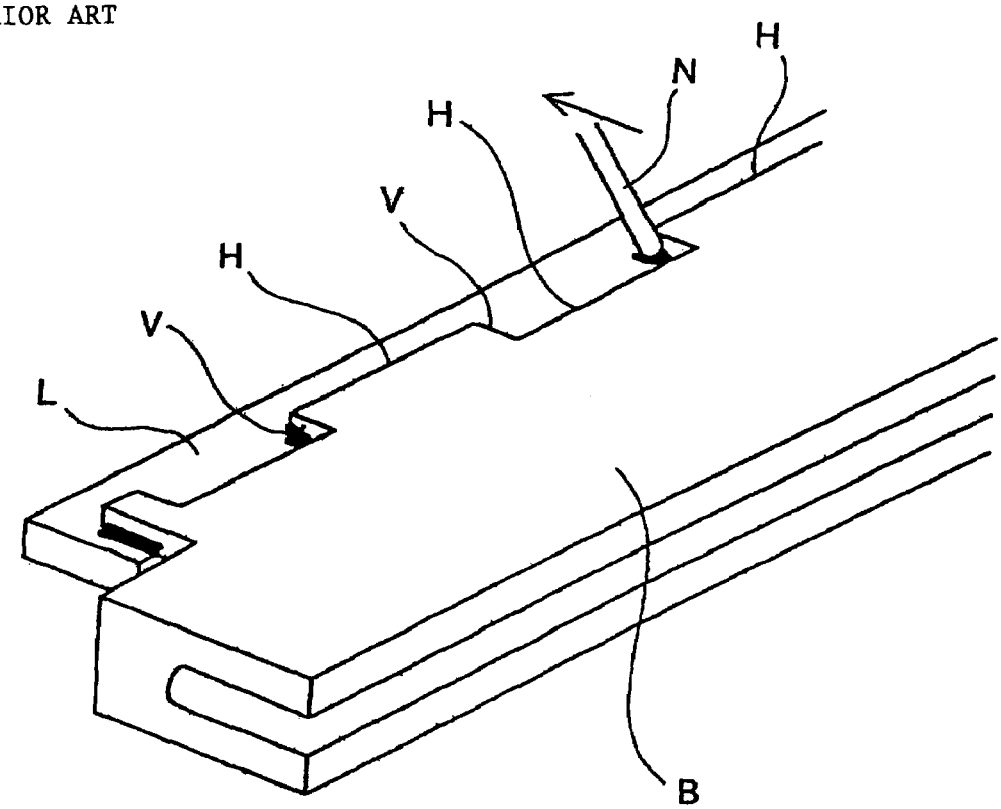
Fig.26 PRIOR ART
FIG. 26 is a perspective view describing an applying process of a sealing agent to vertical edge parts in a conventional method for fixing a lens array.

In the third example, the fitting process to fit said lens array 2B to said base body 1B shown in FIG. 22, the position of said lens array 2B is adjusted by using said adjusting jig J as shown in FIG. 16 and then said lens array 2B is fixed.

Namely said lens array 2B is nipped by the claw of said jig and then said base body 1B is fixed on the base part of said jig.

The position of said lens array 2B is decided so that the crevice between the side face 21B of said lens array 2B and the side face 12B of said base body 1B is to be settled in, the range 0.1 to 0.2 mm and then an UV adhesive is coated to the plural number of positions of said straight inclining edge parts 113B and 114B and said upper side and lower side horizontal edge parts 111B and 112B which forms profile of trapezoid shape (FIG. 18 shows the example that the adhesive is coated to 10 positions (5 profile units of trapezoid shape).

After then, UV light is irradiated to said UV adhesive to harden, and said lens array 2B is fixed to the side face 12B of said base body 1B followed by removing the resulting assembly from said adjusting jig J, and then imaging light is checked. In the coating process of the sealing agent, first said cover 4B is set so that said cover 4B surrounds said LED base panel 3B, and said aluminum tape 41B is stuck to said cover 4B and the shoulder part of said base body 1B.

After then, a silicone type sealing agent is coated with said coating nozzle 5B inclining at a fixed angle to the crevice between said crank-shaped upper edge of said base body 1B and the side face 21B of said lens array 2B, said crank-shaped edge consisting of a plural number of profile units of trapezoid shape consisting of the upper side and lower side horizontal edge parts 111B and 112B and a pair of straight inclining edge parts 113B and 114B extending from both sides of said horizontal edge parts 111B and 112B.

Said sealing agent is coated continuously in one process in the same manner as the fourth embodiment.

Figure 27:
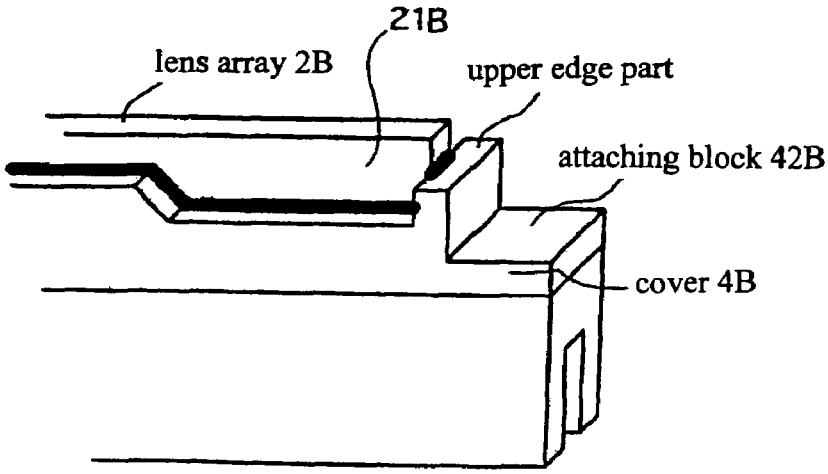
FIG. 27 is a perspective view showing another embodiment of the present invention.

Further, in the present invention, the sealing agent is coated to the crevice between the side face 21B of said lens array 2B and the upper part of the side face of said cover 4B in the same manner as above described and shown in FIG. 27. The sealing agent is also coated to the crevice between both ends (in the lengthwise direction) of said lens array 2B and the upper side part of said cover 4B. Since the space surrounded by said base body 1B, said lens array 2B and said cover 4B is sean LED with the sealing agent and the aluminum tape 41B, dust and toner are prevented from entering said space and from sticking to said lens array 2B and said LED base panel 3B.

As the following process, the resulting assembly is kept in the room temperature for more than 8 hours to harden the sealing agent coated to the crevice between the side face 12B of said base body 1B and the side face 21B of said lens array 2B.

As an inspection process, for said LED print head wherein said lens array 2B is fixed to said base body 1B by the hardened sealing agent, the photo electric test is carried out to check the size.

In the third example, since said edge parts extending from both sides of said horizontal edge parts are settled to incline, the sealing agent can be coated without changing orientatiom angle of said base body and inclining angle of said coating nozzle 5B in a series of movement, the mass-productivity of LED print head is improved.

Further, since said sealing agent is coated to said inclining edge part corresponding to an oblique side of the hypotenuse, the coating quantity of the sealing agent can be saved compared with the case where the sealing agent is coated to two sides of the hypotenuse meeting at right angles in conventional art.

In the fourth embodiment and the third example, the example in which said inclining edge parts extending to both side of said horizontal edge parts is straight to form the profile of trapezoid shape is described, but the present invention is not limited by said embodiment and example, and said inclining edge parts 115B and 116B may be substantially S-shaped. In this case, movement of said coating nozzle 5A to coat the sealing agent to the crevice of said base body 1B arranged horizontally becomes smooth and the problem of drooping of the sealing agent during coating is not necessary to be considered, said drooping arising when the sealing agent is coated to said base body arranged vertically, so that in this embodiment, the sealing agent can be coated stably and uniformly.

[The Fifth Embodiment]

Figure 29:
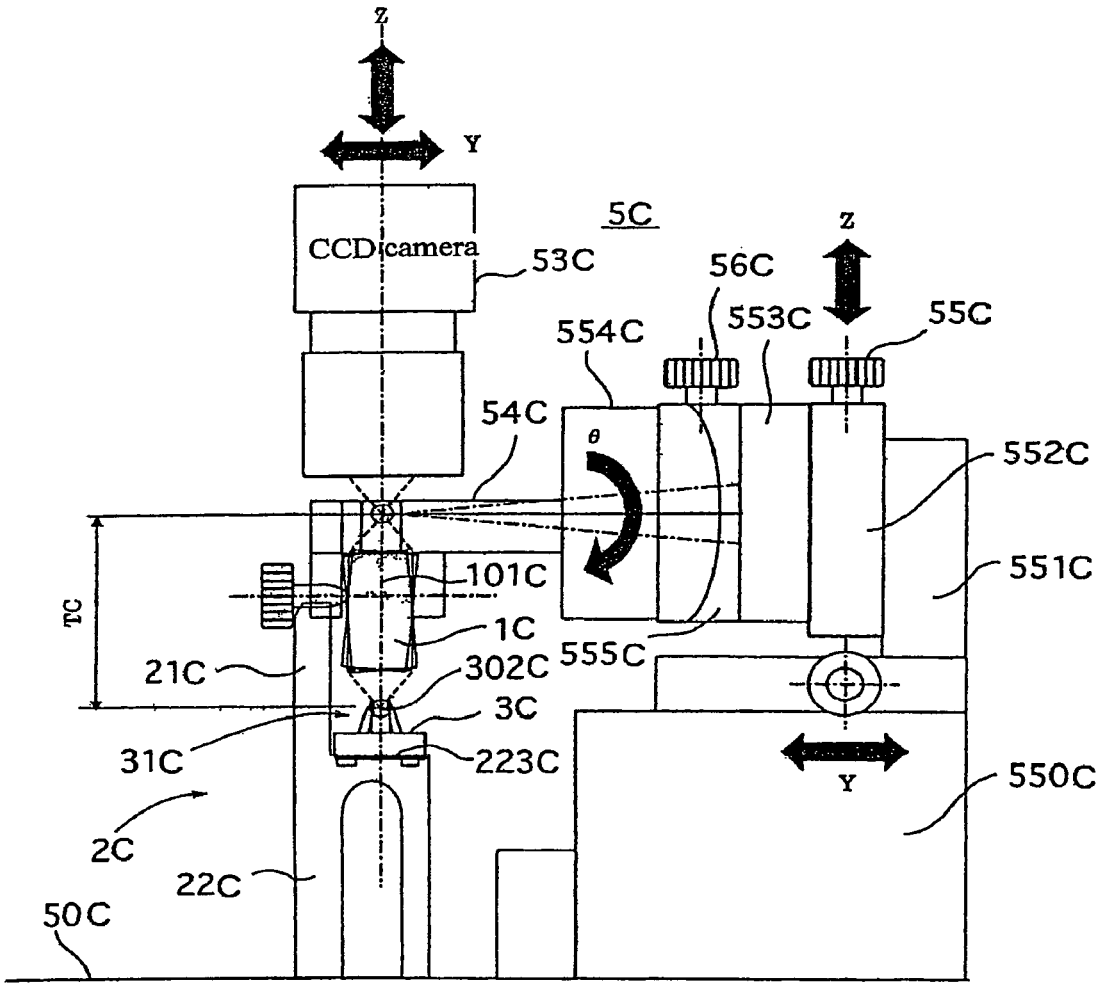
FIG. 29 is a front view showing an apparatus for adjusting used in the fifth embodiment

In a method for manufacturing LED print head of the fifth embodiment wherein a lens array 1C and an LED base panel are fitted to an LED base panel 3C as shown in FIG. 29, when said lens array 1C is fixed to a base body 2C, said lens array 1C is partially warped at a plural number of points of said lens array 1C to correct the fitting position shift of said LED chips 31C on said base panel 3C, the fitting position shift of said LED base panel 3C on said base body 2C, and the imaging point shift of said lens array 1C caused by lens warping of said lens array IC.

Using a position adjusting system 5C as a adjusting jig in the fifth embodiment, said LED base panel 3C is put on the flat face of the step part 223C of said base part 22C of said base body 2C wherein LED chips 31 are arranged on said LED base panel 3C to form an LED array in which the plural number of the light emitting points are arranged in a straight line.

Said lens array 1C is held by five holders 54C wherein said holders 54C are arranged at 5 five positions corresponding to CCD camera positions and said lens array 1C is held by said holders at five positions being along the length distance of said lens array 1C fitted to the upper part of said LED base panel 3C as shown in FIG. 29 and the position of optical axis 101C of each part of said lens array 1C is detected.

The optical axis 101C of said lens array 1C is a substantially the perpendicular line emitted from each light emitting point 302C of said LED base panel 3C and passing though said lens array 1C. In each corresponding position to 5 positions in each position the CCD camera is fitted, positions in Y and Z directions of Y axis table 551C and Z axis table are respectively adjusted by a adjusting screw 55C, based on the detected position of the optical axis of said lens array 1C, said Y axis table 551C moving in Y direction on a base 550 and said Z axis table 553C moving along Z axis guide 552C put on said Y axis table 551C moving in Z axis direction.

Said holder 54C consists of the first element 554C from which said holder 54C is extended and the second element 555C fixed on said Z axis table 55C and arc shaped sliding faces of said first element 554C and said second element 555C rotate respectively and slide relatively by rotation of an adjusting screw 56C to rotate said lens array 1C in θ direction through said holder 54C rotating center being the imaging point of said lens array, to adjust wholly the optical axis shift caused by lens warping of said lens array 1C, and after then said lens array 1C is fixed to said base body 2C by fitting an adhesive between the upper end of a projecting part 21C of said base body 2C and the side wall face of said lens array 1C.

Figure 28:
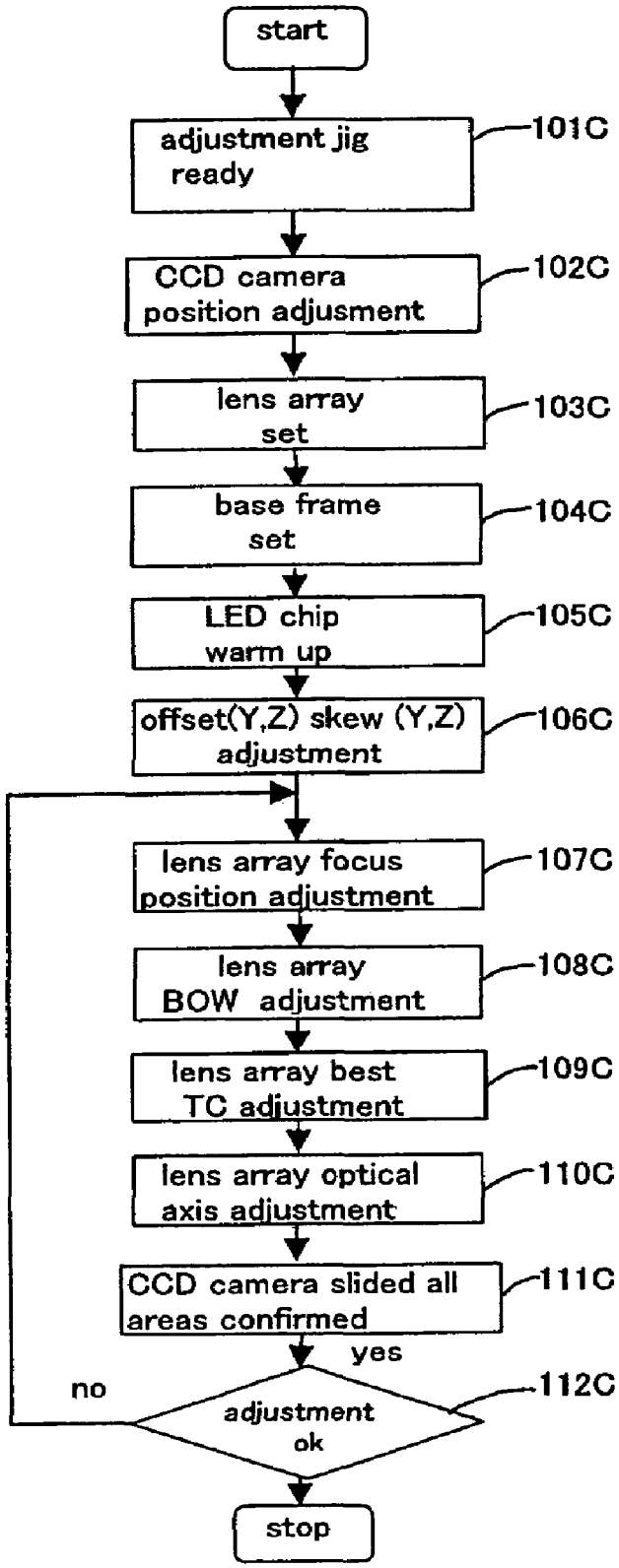
FIG. 28 is a chart diagram showing procedure for adjusting and fixing of the lens array in the fifth embodiment of the present invention.

Adjusting flow of said lens array 1C in the fifth embodiment is described below using FIG. 28 (chart).

At step 101C, the adjusting jig is driven by supplying electric to a plural number of (five) CCD cameras respectively.

At step 102C, positions of said CCD cameras are adjusted respectively. Concretely, standard positions in Z direction and Y direction of a plural number of (five) CCD cameras 53C arranged at a plural number of (five) positions in the lengthwise direction of said lens array 1C are respectively adjusted by using straight edge. The positions of said CCD cameras 53C are between first LED chip and second LED chip, 14th LED chip and 15th LED chip, 30th LED chip and 31st LED chip, 44th LED chip and 45th LED chip, and 57th LED chip and 58th LED chip wherein each position is between the first dot and the last dot.

At the step 103C, said lens array 1C is set to said holder 54C. Concretely, said lens array is cleaned and held by said holder 54C at five positions in the lengthwise direction of said lens array 1C to adjust the position of said lens array 1C in Z direction and Y direction.

At the step 104C, said base body 2C is set on said base 50C. Concretely, said base body 2C is put on said base 50C and the θ direction inclination of send base body 2C is adjusted with a standard pin and only the first bit side of said base body 2C is settled to be fixed while the last bit side of said base body 2C is settled to be unfixed.

At the step 105, said LED chips 31C are light emitted. Concretely said LED base panel 3C is connected to the driving circuit and the switch is turned on.

At the step 106C, observing directly light emitting positions of said light emitting point 302C by said CCD camera 53C, the shift from the standard position which is decided by using said straight edge is corrected by shifting the position of the standard pin of the last bit and said base body 2C is fixed.

At step 107C, the focus position of said lens array 1C in Z direction is adjusted. Concretely, five positions of said lens array 1C in the lengthwise direction are shifted in Z direction to adjust the focus.

At the step 108C, the focus position in θ direction of said lens array 1C is adjusted. Concretely, observing the imaging light through said lens array by said CCD cameras 53C, positions in θ direction of said lens array 1C at five positions in the lengthwise direction of said lens array 1C are respectively adjusted by rotating said lens array around the imaging point of said lens array 1C.

At the step 109 C, said lens array is adjusted so as to fit focus to the predetermined best imaging point of each rod lens in Z direction. Concretely, all CCD cameras 53C are moved from LED light emitting point in Z direction to fit the focus said best imaging point.

At the step 110C, the optical axis shift in Y direction of said lens array 1C is adjusted. Concretely, said lens array 1C is moved in Y direction for ½ of off-set magnitude at five positions in the lengthwise direction of said lens array 1C to correct the optical axis shift.

At the step 111C, said CCD cameras 53C are scanned respectively along whole area of said lens array 1C by sliding said CCD cameras 53C in the lengthwise direction of said lens array 1C.

Concretely, said CCD cameras 53C are slid in X-direction respectively to identify the profile of imaging light between cameras, to confirm that the adjustment is in the range of the specification.

When the adjustment is in the range of the specification in the step 112C, the adjustment is completed and when the adjustment is out of the range of the specification, adjustment of said kens array 1C is repeated going back to the step 107C.

In the method for manufacturing the LED print head of the fifth embodiment, when said lens array is fixed to said base body, said lens array is partially warped at a plural number of positions so that the fitting position shift of said LED chips to said LED base panel, the fitting position shift of said LED base panel to said base body, and the position shift of said imaging point caused by the lens warping of said lens array are corrected.

Further, in the method for manufacturing the LED print head of he fifth embodiment, the shifts of real LED imaging light passing through said lens array 1C from the imaging standard line of LED light in Z-direction (vertical direction) and Y-direction are corrected by moving the position of said lens array at a plural number of positions above described in Z-direction (vertical direction and Y-direction (in the back and forth direction), so that the printing quality can be improved by correcting the position shift of said imaging point in Z-direction and Y-direction. Still further, in the method for manufacturing the LED print head of the fifth embodiment, scattering of angles of a plural number of rod lenses composing said lens array are adjusted by twisting said lens array at a plural number of positions around a fixed point in the middle part of vertical direction of said lens array 1C, such as said lens array is twisted at five positions around the imaging point so that the printing quality can be improved by correcting the position shift of the imaging point of LED light.

[The Sixth Embodiment]

Figure 31:
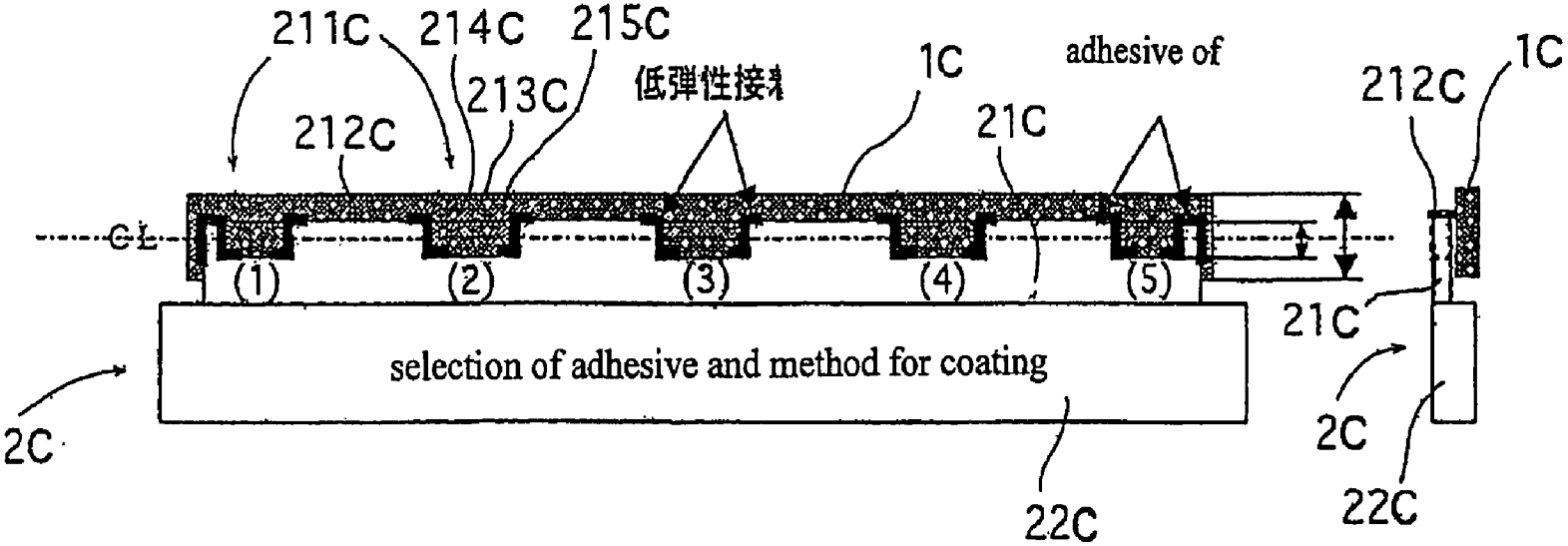
FIG. 31 is a front view and a side view, describing how to apply an adhesive in the sixth embodiment.

In the method for manufacturing the LED print head of the sixth embodiment, the upper edge of said projecting part 21C of said base body 2C of said lens array 1C whose position shift of said imaging point is corrected has a plural number of the notched parts 221C, each notched parts 221C consisting of the upper side and lower side horizontal parts 212C and 213C and the connecting part 214C and 215C connecting the both ends of said upper side and lower side horizontal parts 212C and 213C respectively and said notched parts 221C are arrayed at regular intervals as shown in FIG. 31.

An adhesive such as UV curing type adhesive is continuously coated between the sidewall of said lens array 1C and the upper edge of said projecting part 21C of said base body 2C, concretely said adhesive is coated continuously to the hook shaped edge consisting of the upper side and the lower side horizontal parts 212C and 213C and said connecting part 214C and then said adhesive to is hardened (cured) by such as irradiating the ultraviolet rays.

Figure 30:
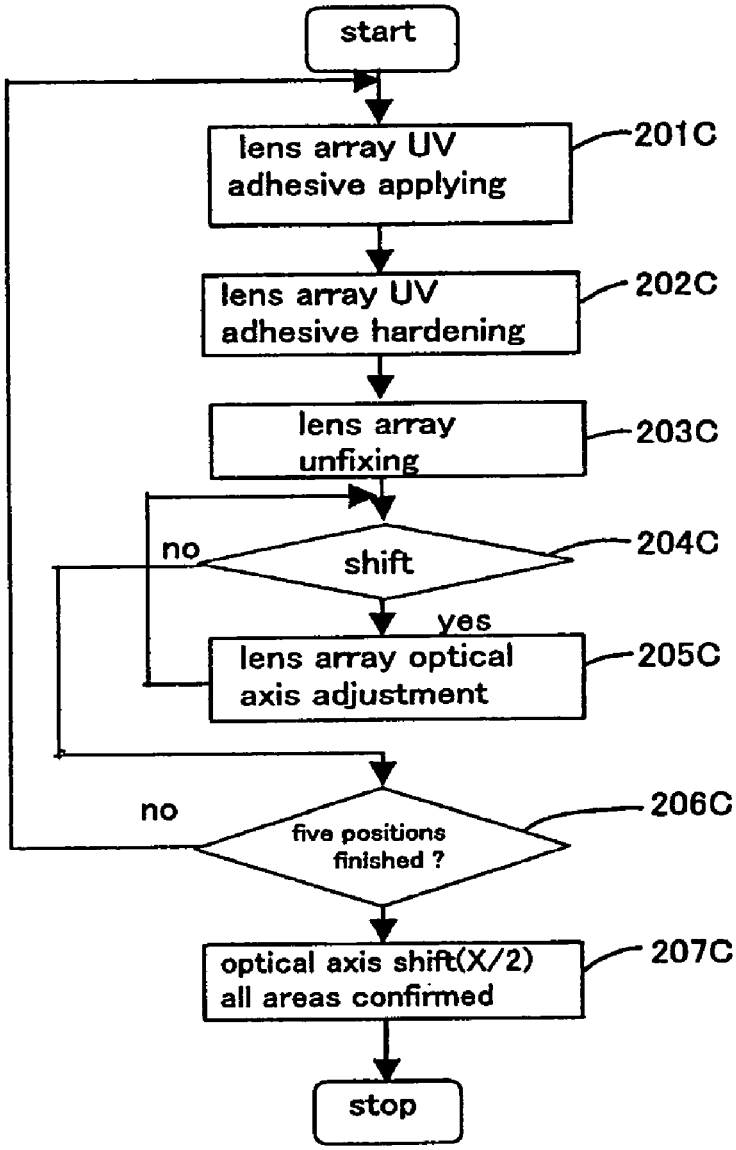
FIG. 30 is a chart diagram showing a procedure for adjusting and fixing of the lens array in the sixth embodiment.

Fixing process flow of said lens array 1C of the sixth embodiment is described below referring FIG. 30 (chart).

At the step 201C, an UV adhesive is coated between the sidewall of said lens array 1C and the upper side of said base body 2C. Concretely said adhesive is first coated to the position of the third camera put inside of said notched part 211C formed on said base body 2C, said notched part 211C being located in the middle of the lengthwise direction and then said adhesive is coated to each position appointed in sequence. For instance, the coating order of the adhesive is such as the position of the third camera and next the position of the fourth camera put inside of said notched part 211C formed at one end of the lengthwise direction of said lens array.

The next position of the position of the fourth camera, is the position of the second camera put inside of said notched part formed at the other end side of the lengthwise direction of said lens array.

The next position of the position of the second camera is the position of the fifth camera put inside of said notched part 211C formed at one end side of the lengthwise direction of said lens array.

The next position of the position of the fifth camera is the position of the first camera put inside of said notched part 211C formed at the other end side of the lengthwise direction of said lens array. To fix the both ends of said base body 2C and said notched parts 211C located at both ends, the adhesive having a higher elasticity after hardening is used and to fix said notched part 211C located in the middle, the adhesive having a lower elasticity after hardening is used. Namely in the position of the third camera, the lower elasticity adhesive is used and in other positions, the higher elasticity adhesive is used.

At the step 202C, the UV adhesive coated between the sidewall of said lens array 1C and the upper side of said projecting part 21C of said base body 2C is cured by irradiating UV-light for a fixed time.

At the step 203C, after the UV adhesive is cured, gripping said lens array 1C with said holder 54C is released.

At the step 204C, after gripping said lens array is released, whether the shift exists or not is confirmed. Namely, whether the shift of the optical axis beyond the range appointed in the specification exists after releasing or not is confirmed.

At the step 205C, in the case where the optical axis shift beyond the range appointed in the specification exists the optical axis is adjusted along Z and Y-directions. Namely, in the case where the optical axis shift beyond the range appointed in the specification exists, the optical axis of unfixed part of said lens array is adjusted to the position giving the best straight degree of whole lens array.

At the step 206C, whether the above described confirmation completes or not about five (all) positions of the lengthwise direction of said lens array is checked and when the above described confirmation completes about five (all) positions, the optical axis shift of said lens array 1C along Z and Y-directions are confirmed over whole area. Namely after said lens array is fixed at said five positions, said CCD camera is slid in a very slow speed in the lengthwise direction of said lens array 1C to check wholly the optical axis shift of said lens array.

At step 206C, when the above described confirmation does not complete about five (all) positions, process returns to the step 201C. Sequence of the steps 201C to 206C is the third camera position, the fourth camera position the second camera position, the fifth camera position, and the first camera position as described in the step 201C.

In the method for manufacturing the LED print head of the sixth embodiment, a plural number of said notched part 211C consisting of said upper side and lower side horizontal edge parts 212C and 213C and said connecting edge parts 214C and 215C connecting both ends of said upper side and lower side edge parts 212C and 213C are arranged at regular intervals in the upper edge of said projecting part 21C, and an UV curing type adhesive is coated to the sidewall of said lens array 1C and hook shaped upper edge of said projecting part 21C, said upper edge consisting of said upper side and lower side horizontal edge parts 212C and 213C, and after then UV light is irradiated to cure said adhesive to fix said bonding part so that said adhesive can be easily and continuously coated, and said lens array 1C is certainly fixed to said projecting part 21C of said base body 2C to avoid said lens array 1C's shifting in θ-direction.

Further, in the method manufacturing the LED print head of the sixth embodiment, a notched part located in the middle of the upper edge of said projecting part 21C of said base body 2C is first fixed, a plural number of said notched parts being arranged at regular intervals in the upper edge of said projecting parts, and then said notched parts located on both sides of said middle notched part are fixed in sequence and finally said notched parts located at the both ends of the upper edge of said projecting part so that the position shift, dissymmetry of position shift at the both ends of said lens array is solved.

Furthermore, in the method of manufacturing the LED print head of the sixth embodiment, every time when one notched part 211C of said projecting part 21C of said base body 2C is fixed, the position shift is re-adjusted so that the position shift of said lens array 1C is adjusted in whole lengthwise direction.

Still further, the method of manufacturing the LED print head of the sixth embodiment, an adhesive having a lower elasticity after hardening is used to fix said middle notched part of said base body 2C and an adhesive having a higher elasticity after hardening to fix another notched part except for said middle notched part, so that when the shift of said lens array 1C in the lengthwise direction occur, said partial position shift is in the direction of both ends of said lens array and the center position of said lens array in the lengthwise direction does not change.

[The Seventh Embodiment]

The method for manufacturing the LED print head of the seventh embodiment is described below comparing with conventional method and referring to FIGS. 31 to 36. The seventh embodiment is characterized by using automatic machine tool in the methods for manufacturing the LED print head of the fifth embodiment and the sixth embodiment.

To obtain a good optical property in the LED print head, it is important that in the situation wherein the focus is adjusted uniformly to the imaging face, the position of said lens array is adjusted and after said adjustment, said position is fixed without shaking but actually the position shift is caused by affecting various strain on said lens array. The seventh embodiment improves this disadvantage.

Figure 32:
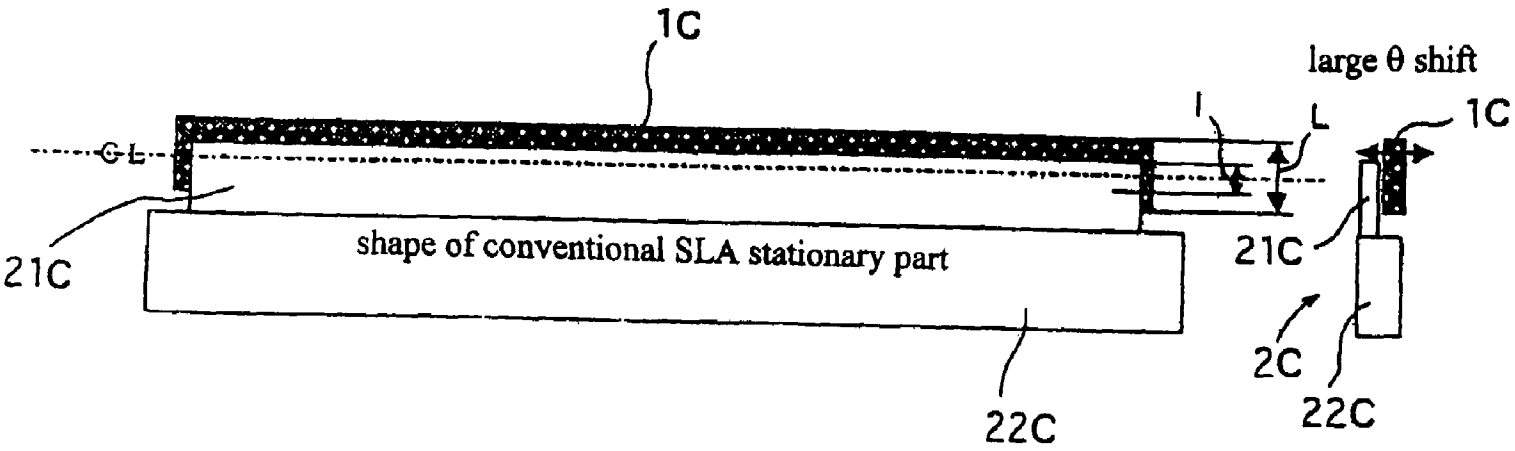
Fig.32 PRIOR ART
FIG. 32 is a front view and a side view showing the relationship between a conventional lens array and base body, which relationship is to be compared with that in the seventh embodiment of the present invention wherein a lens array is adjusted and fixed.

In the case of one side supporting structure wherein only one side of said notched part 211C formed along the upper edge of said projecting part 21C of said base body 2C is fixed to the side face of said projecting part 21C of said base body 2C as shown in FIG. 32, the fixing strength is lower than that of both sides supporting structure wherein both sides of said lens array 1C is fixed so that the fixing position of said lens array is shifted by heat generation of said LED chips or the surrounding temperature change, causing imaging position change.

Figure 33:
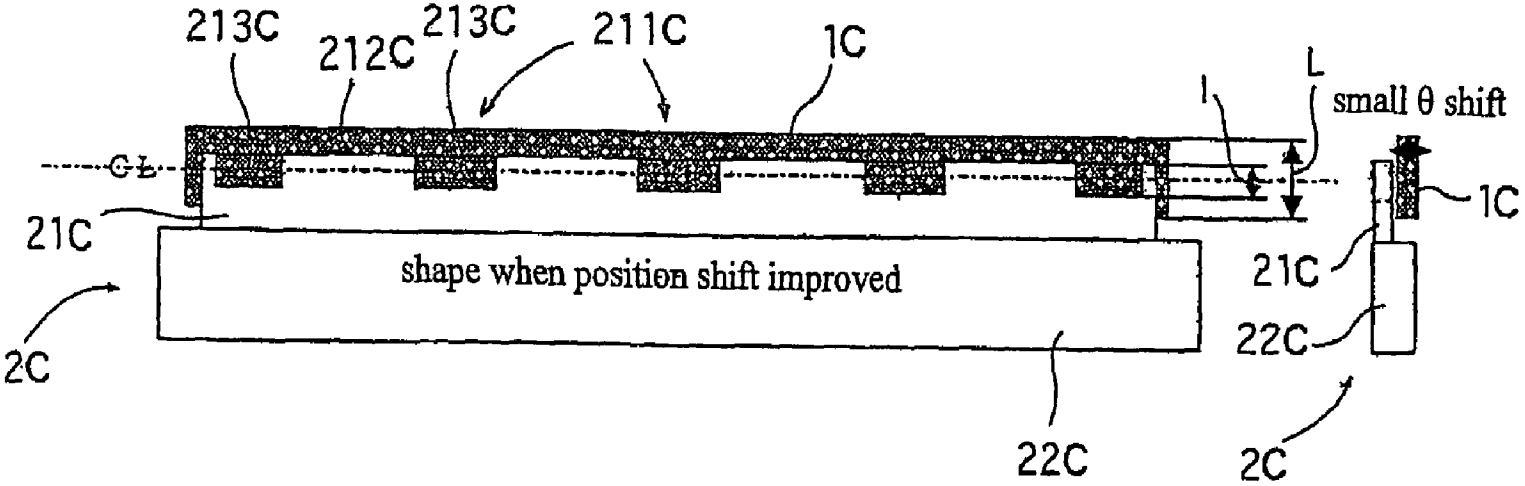
FIG. 33 is a front view and a side view showing the relationship between the lens array and the base body in the seventh embodiment of the preset invention.

To solve above described problem, in the seventh embodiment, the center of the height L of said lens array is settled to overlap with the center of the height of said notched part I as shown in FIG. 33 to give a face symmetrical structure. Further, the coating trace of the adhesive is settled to be hook-shaped (crank-shaped) to give the uniform bonding strength in the vertical direction of said lens array so that the position shift of said lens array is reduced.

In the case where said lens array 1C and said base body 2C are bonded rigidly together by using the adhesive having a low elasticity as shown in FIG. 31, separation of said adhesive by the thermal stress is feared, said thermal stress being caused by the difference of the coefficients of thermal expansion between said lens array 1C and said base body 2C and produced by heat shock so that to solve above described problem in the selection of the adhesive and the coating method of the adhesive, center-position is selected from plural positions, for instance, five fixing positions and fixed by using an adhesive having a higher elasticity, and other four positions are fixed by using an adhesive having a lower elasticity.

Figure 34:
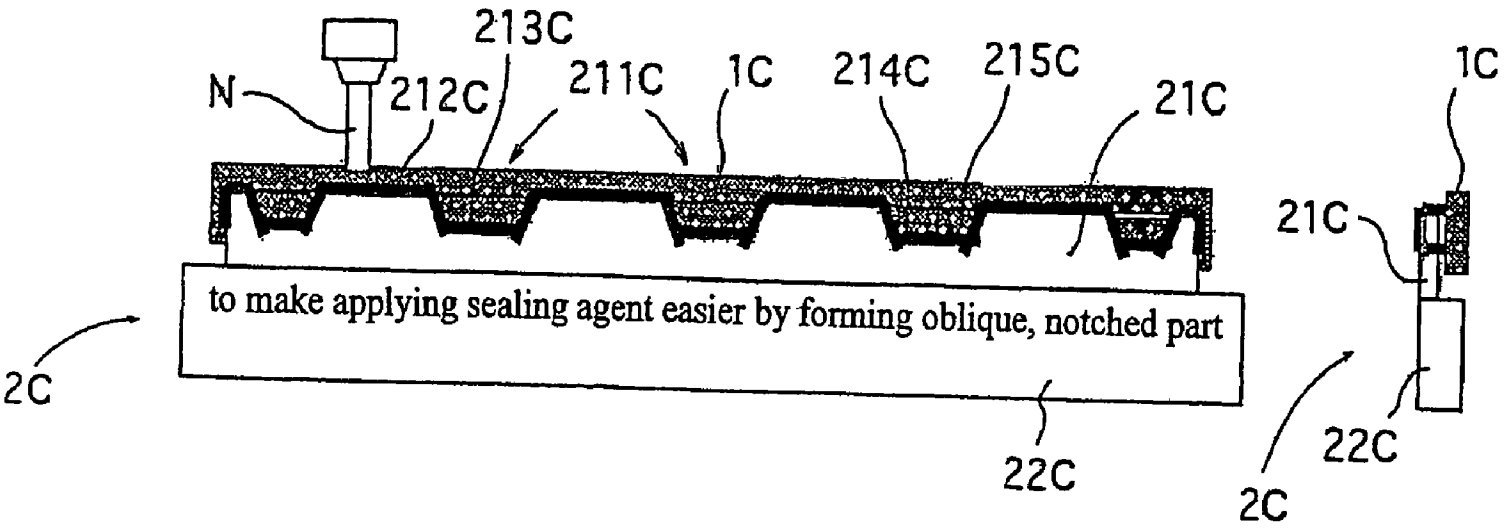
FIG. 34 is a front view and a side view describing how to apply an adhesive to an oblique and notched part in the seventh embodiment of the present invention.

In the case of notched shape shown in FIG. 31, in the case where the adhesive is coated to the crevice between said lens array 1C and said base body 2C by using the coating nozzle N of the automatic machine tool, the adhesive should be coated in the horizontal direction and then coated in the vertical direction again turning said base body 2C at 90°, so that the coating adhesive is a troublesome process. Accordingly the shape of said notched part along the upper edge of said projecting part 21C of said base body is settled to be oblique as shown in FIG. 34, so that the adhesive can be coated at one process to improve mass productivity.

Figure 35:
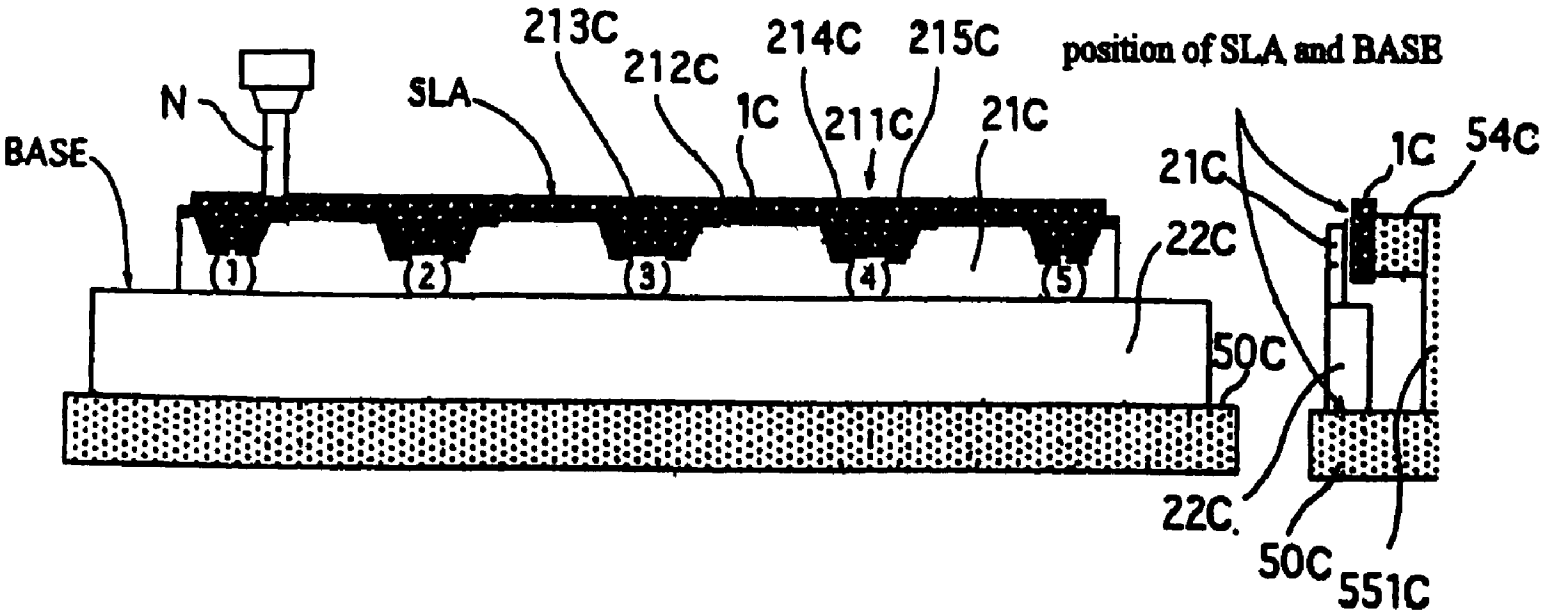
FIG. 35 is a front view and a side view describing a process of applying an adhesive to a notched part in the seventh embodiment of the present invention.
Figure 36:
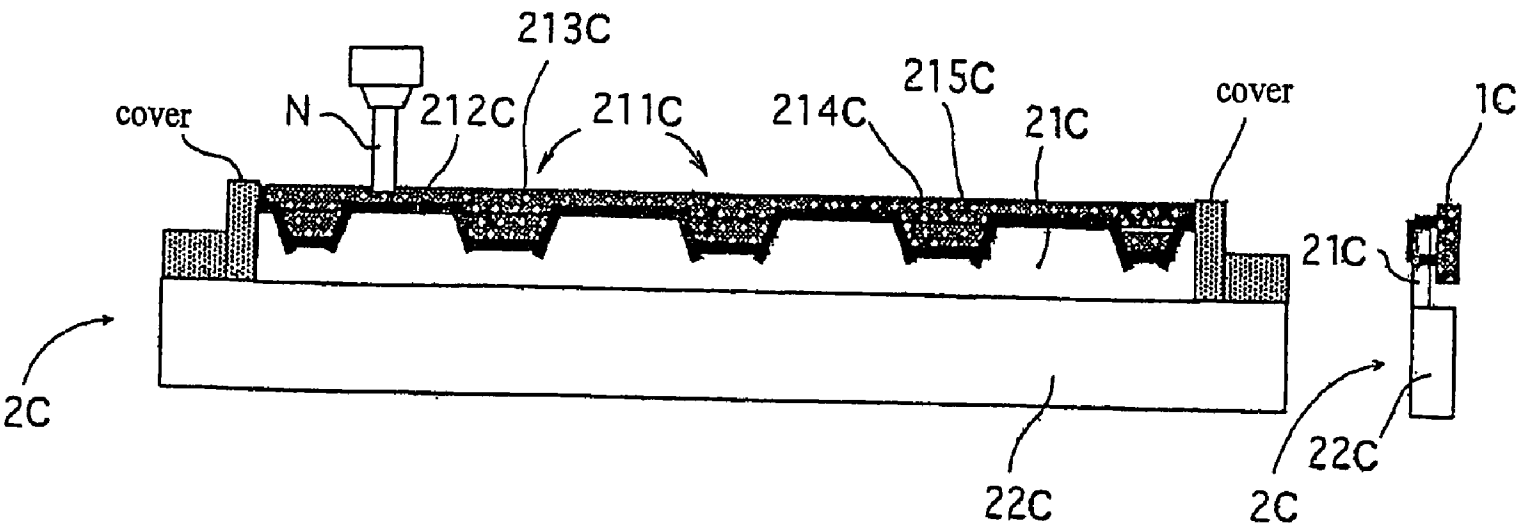
FIG. 36 is a front view and a side view describing how to apply a sealing agent in the seventh embodiment of the present invention.
Figure 37:
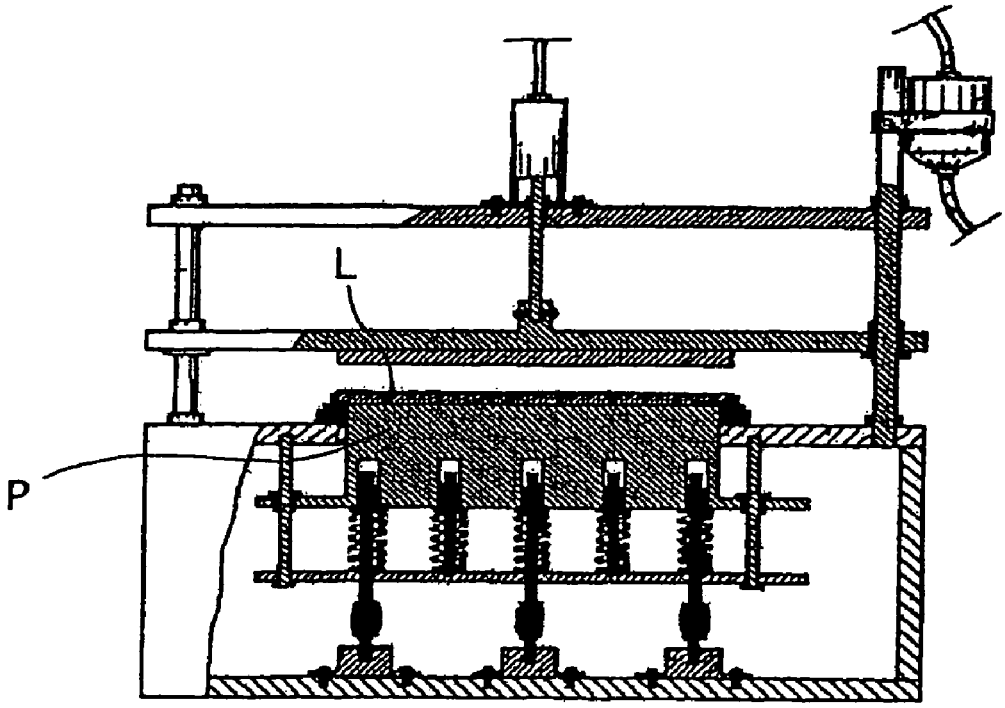
Fig.37 PRIOR ART
FIG. 37 is an illustration describing a conventional method for adjusting and fixing a lens array.
Figure 38:
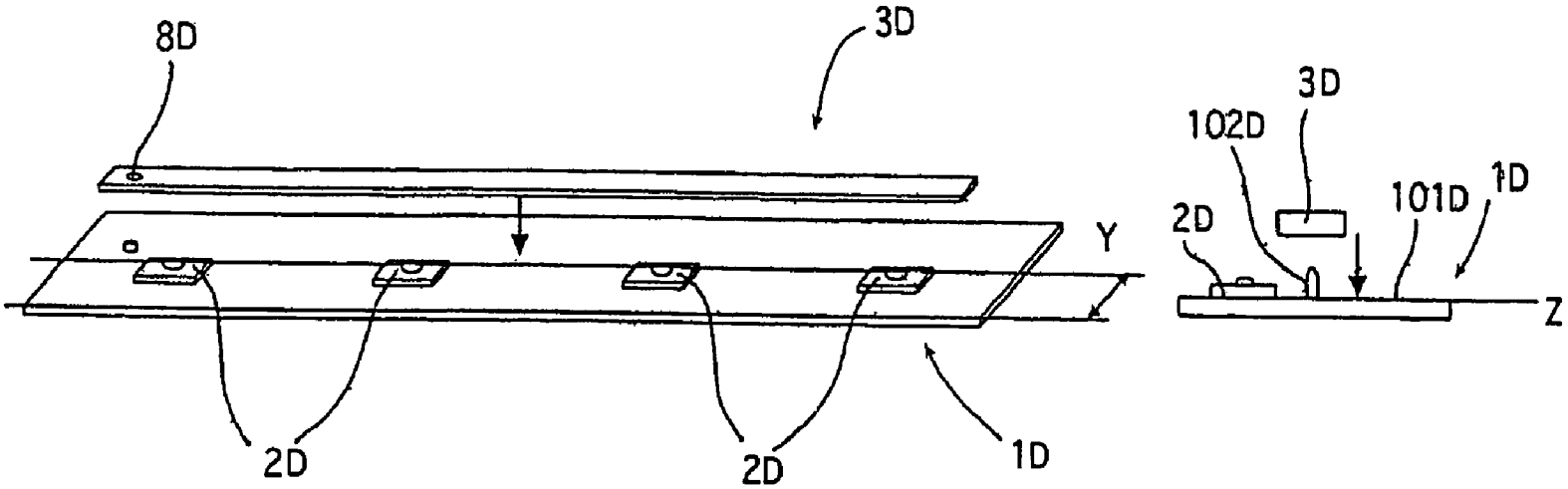
FIG. 38 is a perspective view and a side view describing how to adjust the LED base panel in Y direction with a position adjusting board in the method for sticking the LED base panel in the eighth embodiment of the present invention.

After the optical position adjustment of said lens array 1C and said base body 2C, said lens array and said base body are respectively fixed mechanically, the adhesive is coated at ten positions shown in FIG. 35, to harden.

Further, assuming the order of fixing points of said lens array 1C to said base body 2C are such as (1), (2), (3), (4), (5) from the first dot of LED light emitting points, said fixing points are fixed in sequence (3)→(4)→(2)→(5)→(1) or (3)→(2)→(4)→(1)→(5) and wherever one point of said fixing points is fixed, holding of said low array is released at this position and the position shift at another position where said lens array is held is adjusted and after then this point is fixed in sequence. For instance, point (3) is fixed and holding at point (3) position is released and when the position shift is produced about any of points (1), (2), (3), (4), (5), said position shift is re-adjusted. Next, point (4) is fixed and holding at point (4) position is released and when the position shift is produced about any of points (1), (2), (5), said position shift is re-adjusted.

As described above, said re-adjustment is carried out until all holdings are released.

After the adhesive hardens, a pair of covers are attached to both ends of said lens array 1C in the lengthwise direction, and the sealing agent is coated to the crevice between said lens array 1C and said base body 2C.

In the case where the automatic machine tool is used in said two processes, up to now, the sealing agent should be coated once in the horizontal direction and then the vertical direction turning said base body 2C at 90° so that the troublesome process is necessary. In the seventh embodiment, said notched parts 211C along the upper edge of said projecting part 21C of said base body 2C is settled to be oblique, so that said base body 2C or said coating nozzle is not necessary to turn, and accordingly the sealing agent is easily coated, to improve mass-productivity. At the same time, as compared with the conventional right-angled shape of said notched part, bonding area increases in the seventh embodiment to improve the bonding strength between said lens array and said base body 2C. In the seventh embodiment described above, the optical property is improved by improving focus uniformity and center shift of lens as shown in Table 2 (typical values are shown in Table 2).

TABLE 2

| | conventional | the present invention |
|---|---|---|
| Focus uniformity | 100 μmP-P | 30 μmP-P |
| BOW | 100 μmP-P | 40 μmP-P |
| Center shift of lens | 100 μmP-P | 10 μmP-P |

[The Eighth Embodiment]

In the method for manufacturing the LED print head of the eight embodiment, a plural number of the position adjusting boards 2D are arranged as the position adjusting parts in the crosswise direction on the horizontal face 101D of LED chips fitting jig 1D as LED chips fitting base wherein said position adjusting boards 2D are put on a plural number of positions in the lengthwise direction (X-direction) of a base strip 3D (base panel) to adjust position in Y direction and the standard pin 102D as the position adjusting parts in the lengthwise direction is put in the horizontal face 101D of said jig 1D to adjust the position in X-direction of said base strip 3D and a standard hole 8D as the position adjusting means to adjust the position in X-direction is formed at the end of X-direction of said base strip 3D as shown in FIGS. 38 to 43. Said standard pin 102D of said jig 1D is inserted into said standard hole 8D of said base strip 3D contacting the standard side of said base strip 3D with said position adjusting boards 2D respectively to set said base strip 3D on said jig 1D. Said base strip 3D is fixed in said jig 1D by a pressing panel 4D as a pressing parts toward said position adjusting boards 2D, said pressing panel 4D being arranged opposite to said position adjusting boards 2D to correct the warping of said base strip 3D in Y-direction.

Said position adjusting board 2D is fixed with screws at a plural number of points in X-direction, so that the standard side of said base strip 3D can be pressed against said position adjusting board 2D. Said position adjusting boards 2D is settled to be thin so that said position adjusting board 2D does not interfere with fitting said LED chips.

The bottom side of said LED fitting jig 1D is the mechanical standard side and a plural number of said positions adjusting boards 2D are fixed on the horizontal face 101D of said jig 1D substantially at regular intervals.

To adjust the position in X-direction, said standard pin 102D is put in one end of the horizontal face 101 of said LED chips fitting jig 1D and said standard hole 8D is formed at the end of said base strip 3D.

Figure 39:
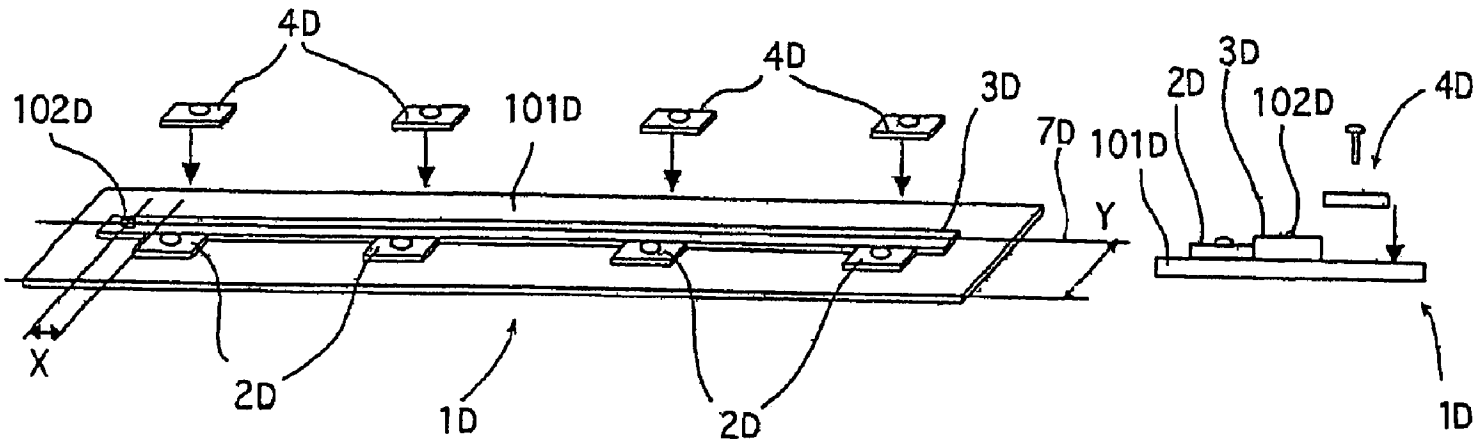
FIG. 39 is a perspective view and a side view describing how to adjust the LED base panel in X direction and Y direction with a position adjusting board and a pressing panel in the method for sticking the LED base panel in the eighth embodiment of the present invention.
Figure 40:
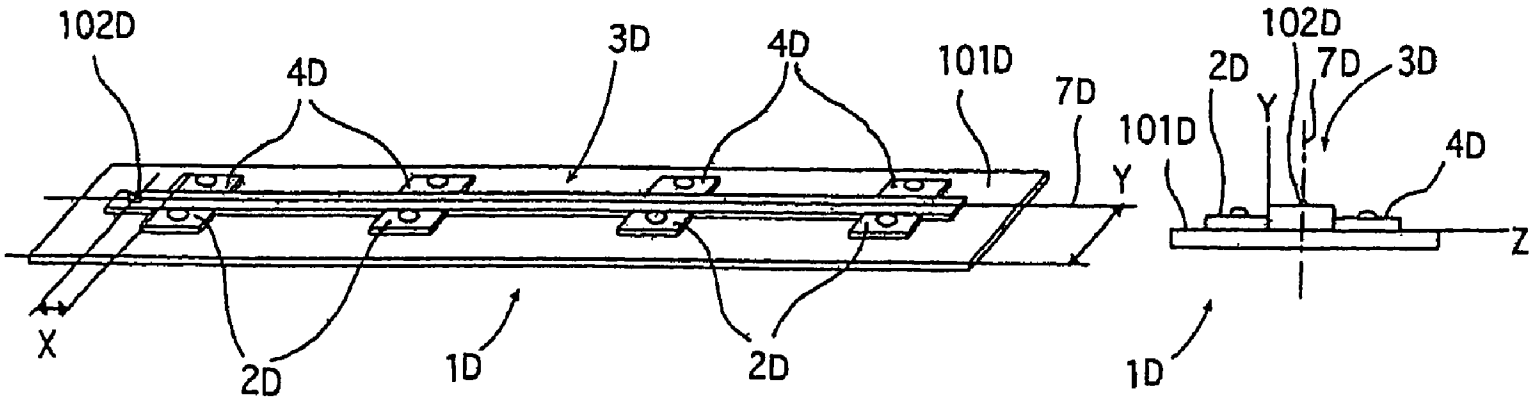
FIG. 40 is a perspective view and a side view describing how to adjust the LED base panel in X direction and Y direction with a position adjusting board and a pressing panel in the method for sticking the LED base panel in the eighth embodiment of the present invention.
Figure 41:
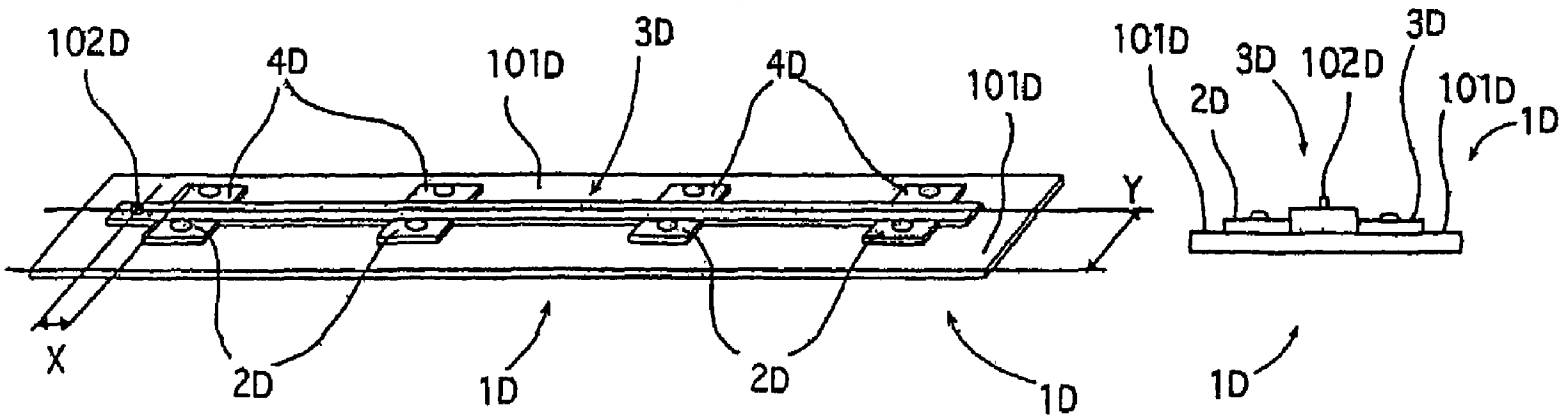
FIG. 41 is a perspective view and a side view describing how to adjust the LED base panel in X direction and Y direction with a position adjusting board and a pressing panel in the method for sticking the LED base panel in the eight embodiment of the present invention.
Figure 42:
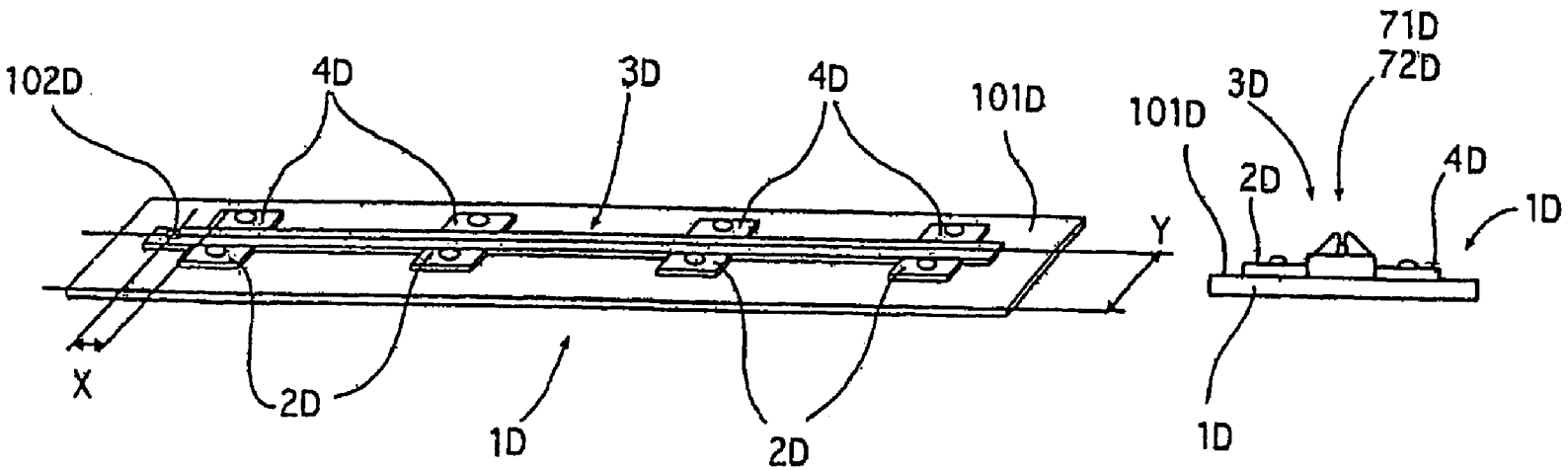
FIG. 42 is a perspective view and a side view describing how to fit LED chips to the adjusted base panel in the method or sticking the LED base panel in the eight embodiment.

As shown in FIGS. 39 and 40, said standard pin 102D is inserted in said standard hole 8D and said base strip 3D which is set contacting with said position adjusting board 2D is fixed with screws being pressed by said pressing panel 4D to correct the warping of said base strip 30 in Y-direction. Said pressing panel 4D is settled to be thinner than the thickness of said base strip 3D and substantially the same as the thickness of said position adjusting board.

Figure 43:
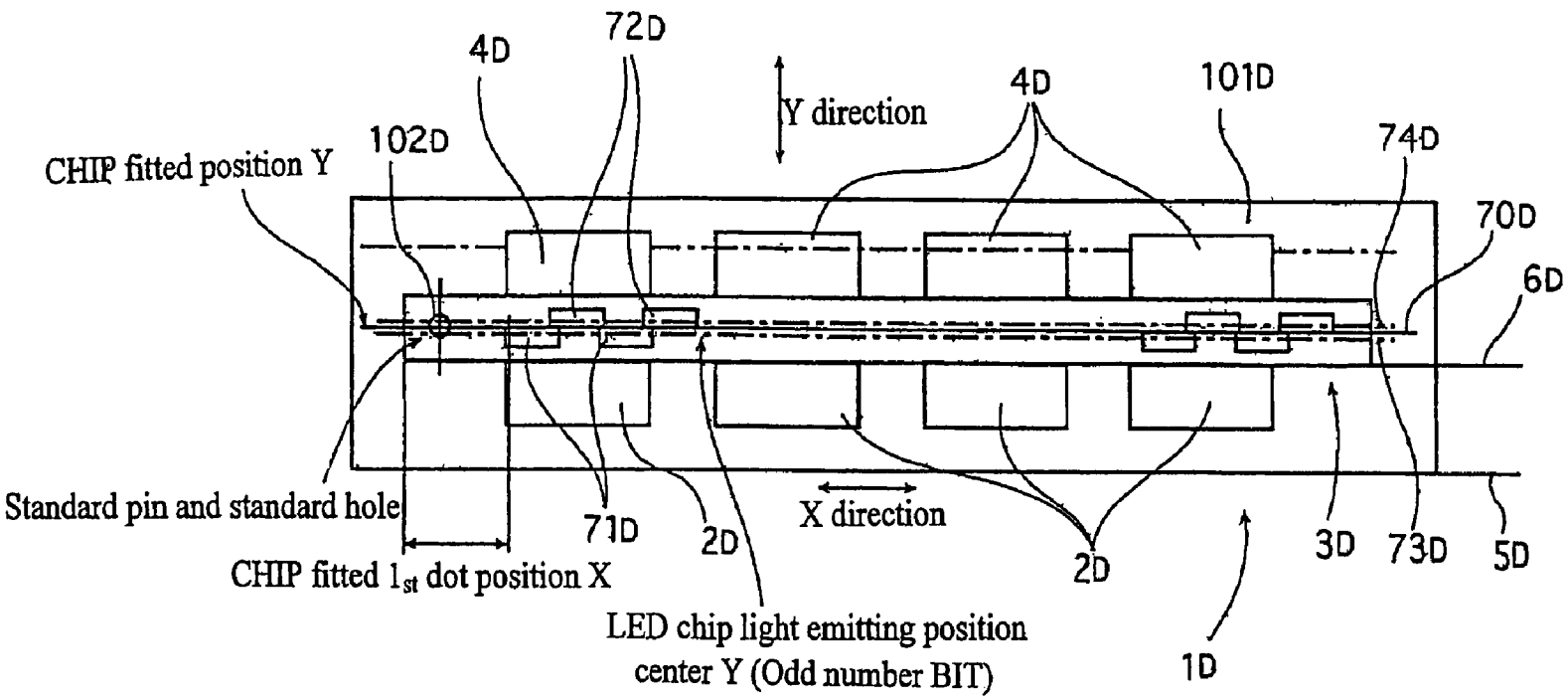
FIG. 43 is a plan view describing how to adjust the LED base panel in X-direction and Y direction with a position adjusting board and a pressing board in the method for a sticking the LED panel in the eighth embodiment of the present invention.

As shown in FIG. 43, LED chips to be put at odd number positions and LED chips to be put at even number positions are arranged alternately in a zigzag pattern, intermediating a fitting line 70 D extending in X-direction from the one end of said base strip 3D whose warping in Y-direction has been corrected.

Namely, LED chips to be put at odd number positions and LED chips to be put at even number positions are fitted alternately intermediating a fitting line 70D extending in X-direction at the center emitting light positions on a straight line.

Figure 52:
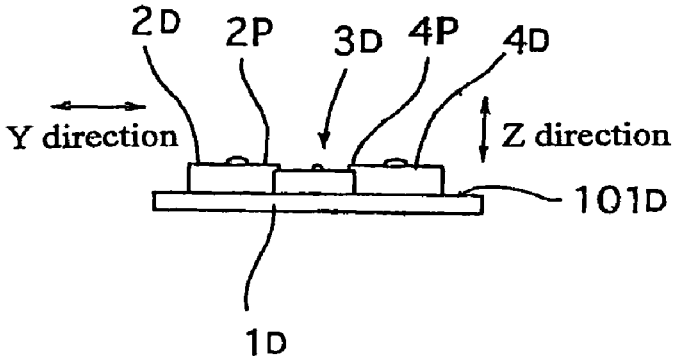
FIG. 52 is a side view showing another embodiment of a position adjusting board and a pressing board according to the present invention.
Figure 53:
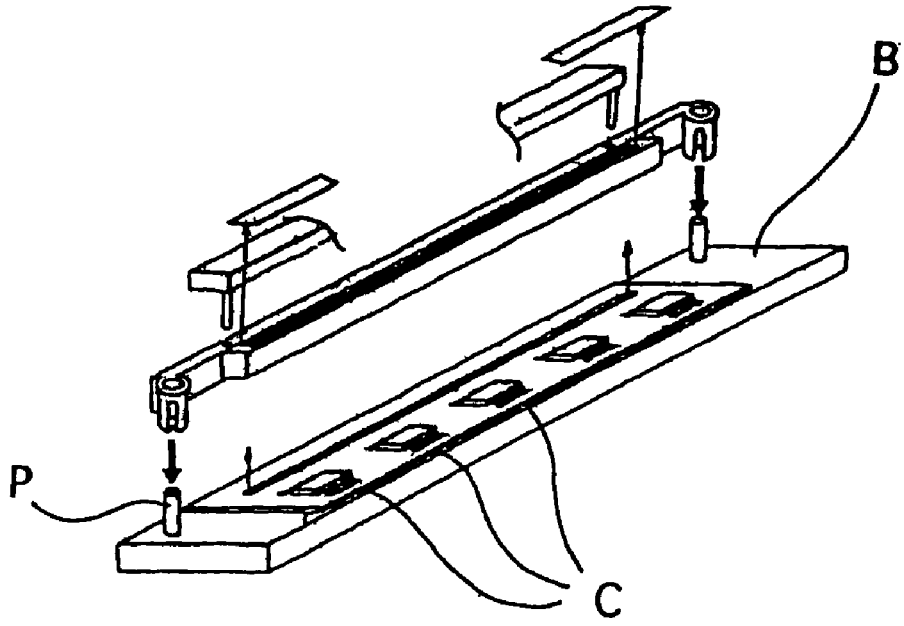
Fig.53 PRIOR ART
FIG. 53 is a perspective view describing a conventional method for sticking the LED panel.

As shown in FIG. 52, said base strip 3D is pressed with the pressing parts in Z-direction (vertical direction) on said horizontal face 101D to fit to said horizontal face 101D and the warping of said base strip 3D in Z-direction is corrected. Said pressing parts is made of said position adjusting board 2D and said pressing panel 4D being settled to be partially thicker and on whose shoulder part small projection 2D and 4D are formed.

In the method for manufacturing the LED base panel of the eighth embodiment, said position adjusting board 2D contacting with the standard side 6D of said base strip 3D to set said base strip 3D and said base strip 3D is fixed by pressing said pressing panel 4D to correct the warping of said base strip 3D in Y-direction so that the fitting accuracy of said LED chips 71D and 72D can be improved by adjusting the positions by said positions adjusting means when said LED chips 71D and 72D are fitted.

Further, in the method for manufacturing the LED base panel of the eighth embodiment, the warping of said base strip 3D in Y-direction is corrected and said LED chips 71D to be put on odd positions and said LED chips 72D to be put on even positions are alternately fitted intermediating said fitting line 70D extending from one end of said base strips 3D in X-direction and said base strip 3D is pressed in Z-direction (vertical direction) to the horizontal face 101D of said jig 1D with the pressing parts to correct the warping of said base strip 3D in Z-direction so that the fitting accuracy of said LED chips 71D and 72D can be improved.

[The Ninth Embodiment]

In the method for sticking the LED base panel of said LED print head, as shown in FIGS. 44 to 51, said base strip (LED base panel) on which said LED chips 71D and 72D are fitted is fixed on the upper face 201D of a sticking base (jig) 200D directing LED chips 71D and 72D toward underside, and a base body 20D is put on said base strip 3D, an adhesive being coated to the base panel fitting part 21D of said base body 20D, and after adjusting positions in X and Y-direction, said base body 20D is pressed to fix on said base strip 3D.

In the ninth embodiment, said base body 20D is stuck to said LED base panel 3D on which said LED chips 71D and 72D are fitted in a manner shown in FIGS. 44 to 51.

A denting ditch 204D is formed on the upper face 201D of said sticking base 200D to avoid contacting with said LED chips 71D and 72D fitted on said base panel (strip) 3D and the inside of said denting ditch 204D is sucked with a vacuum passage 205D so that said base panel 3D is sucked and fixed to said upper face 201D.

Figure 50:
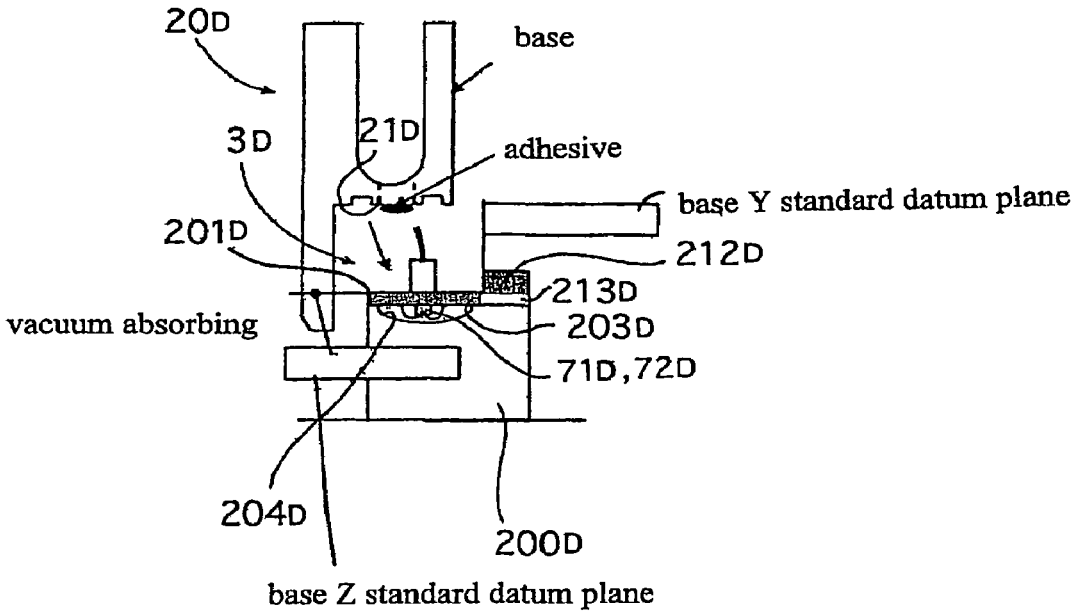
FIG. 50 is a perspective view and side view describing a state wherein the base panel fitted with LED chips is mounted on the sticking base and the base body is just to be mounted, in the method for sticking the LED panel in the ninth embodiment of the present invention.
Figure 51:
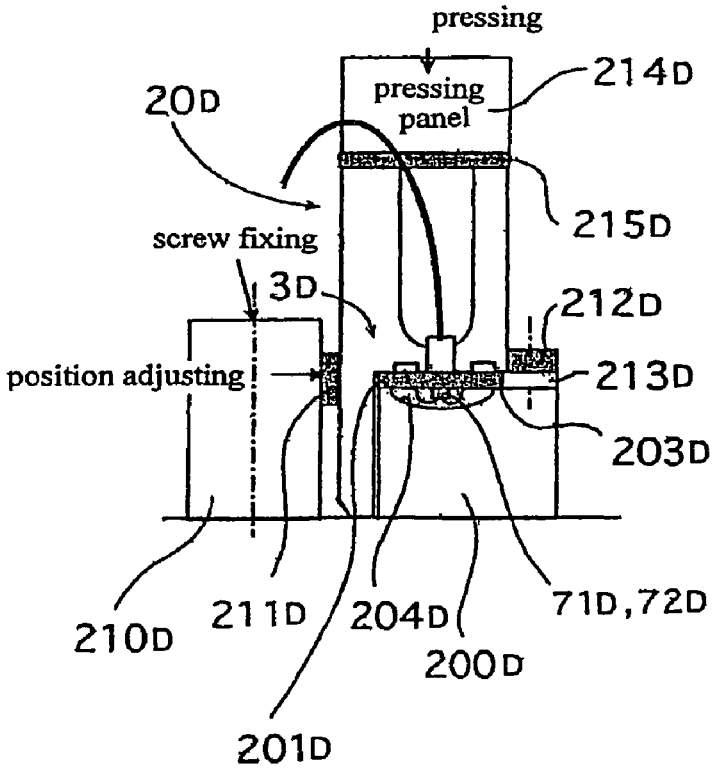
FIG. 51 is a perspective view and a side view describing a state wherein the base body is mounted, adjusted and pressed, for the LED base which is mounted on the sticking base, in the method for sticking LED panel in the ninth embodiment of the present invention.

As shown in FIGS. 50 and 51, said base body 20D has a configuration so as to avoid contacting with the flexible print base panel and other attachments which are attached to said base panel 3D on which LED chips 71D and 72D are filled.

Figure 44:
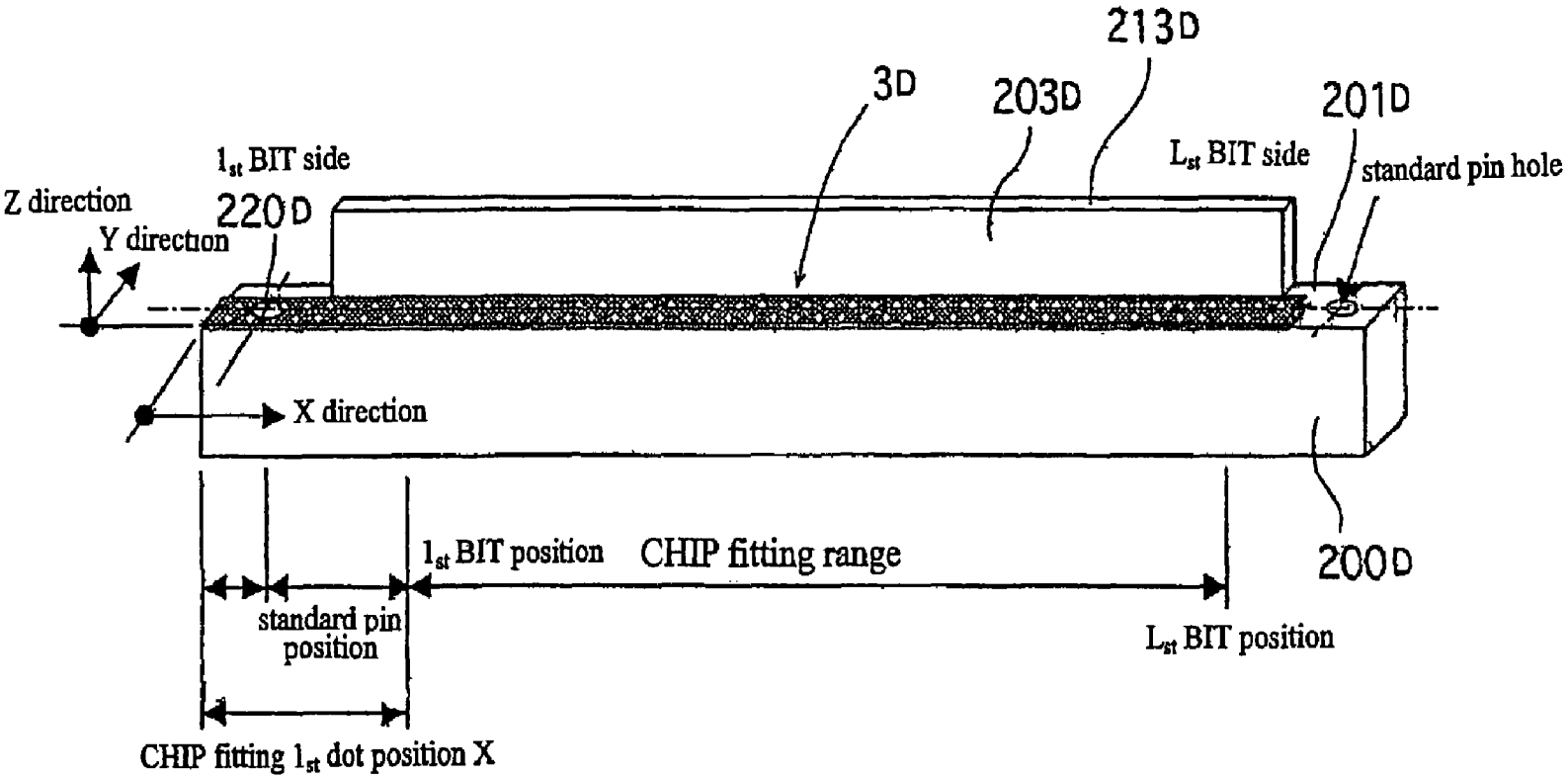
FIG. 44 is a perspective view and a side view describing how to mount the base panel fitted with LED chips on the sticking base in the method for sticking the LED panel in the ninth embodiment of the present invention.
Figure 45:
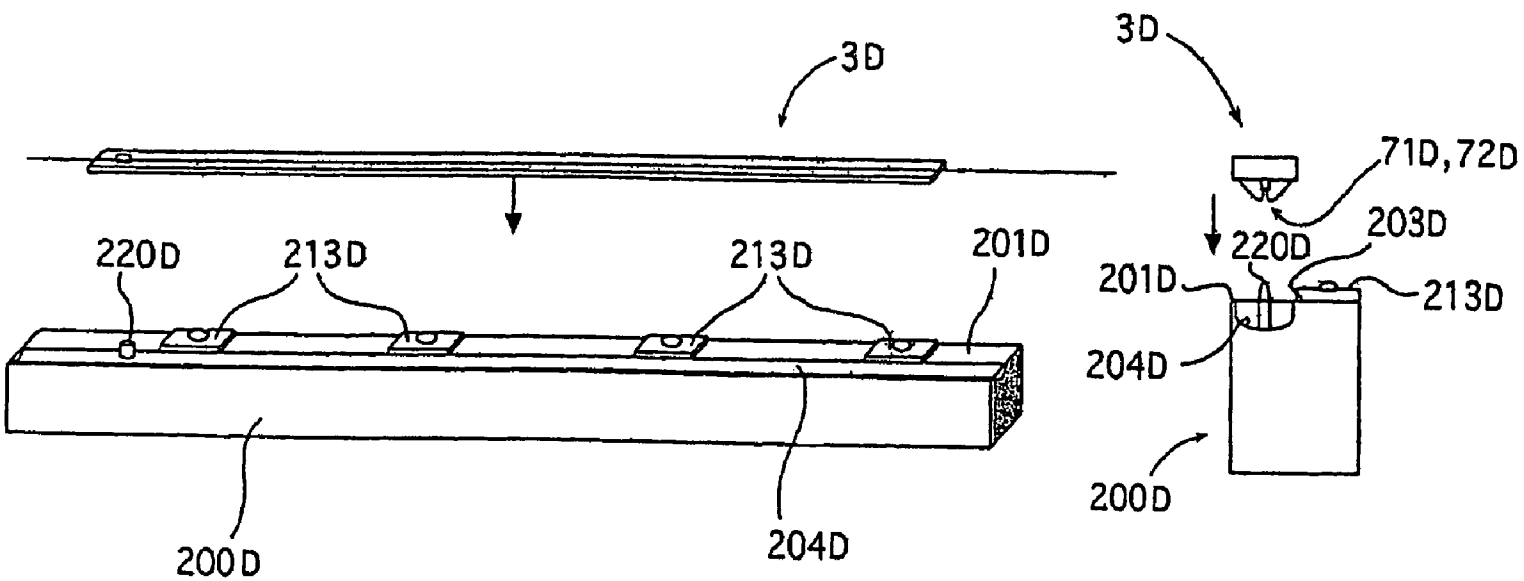
FIG. 45 is a perspective view and a side view describing how to mount the base panel fitted with LED chips on the sticking base in the method for sticking the LED panel in the ninth embodiment of the present invention.
Figure 46:
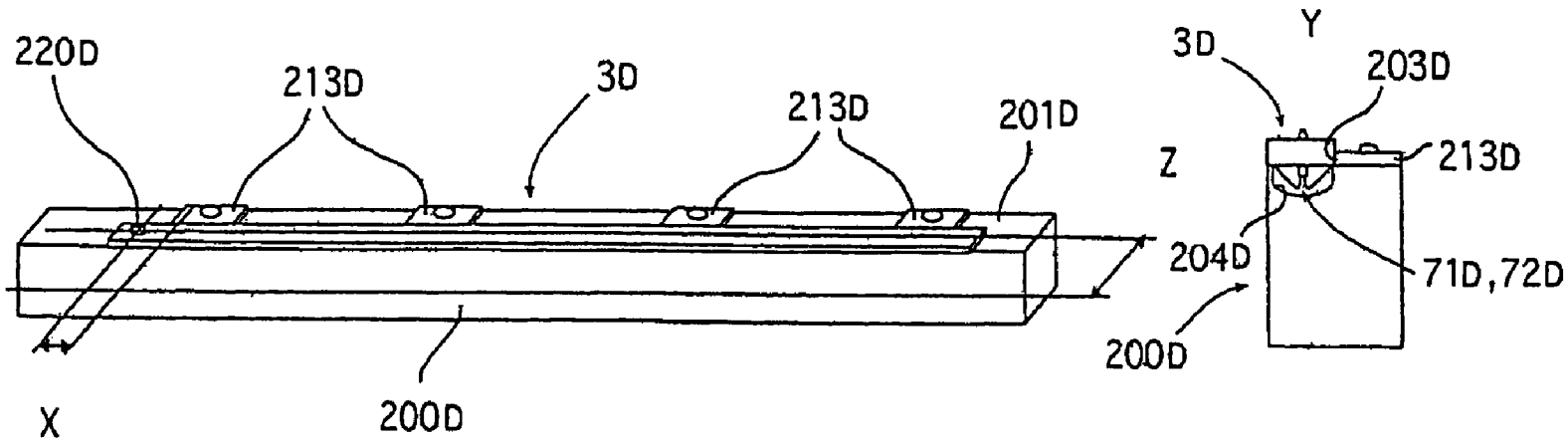
FIG. 46 is a perspective view and a side view describing how the base panel fitted with LED chips is mounted on the sticking base in the method for sticking the LED base panel in the ninth embodiment of the present invention.
Figure 47:
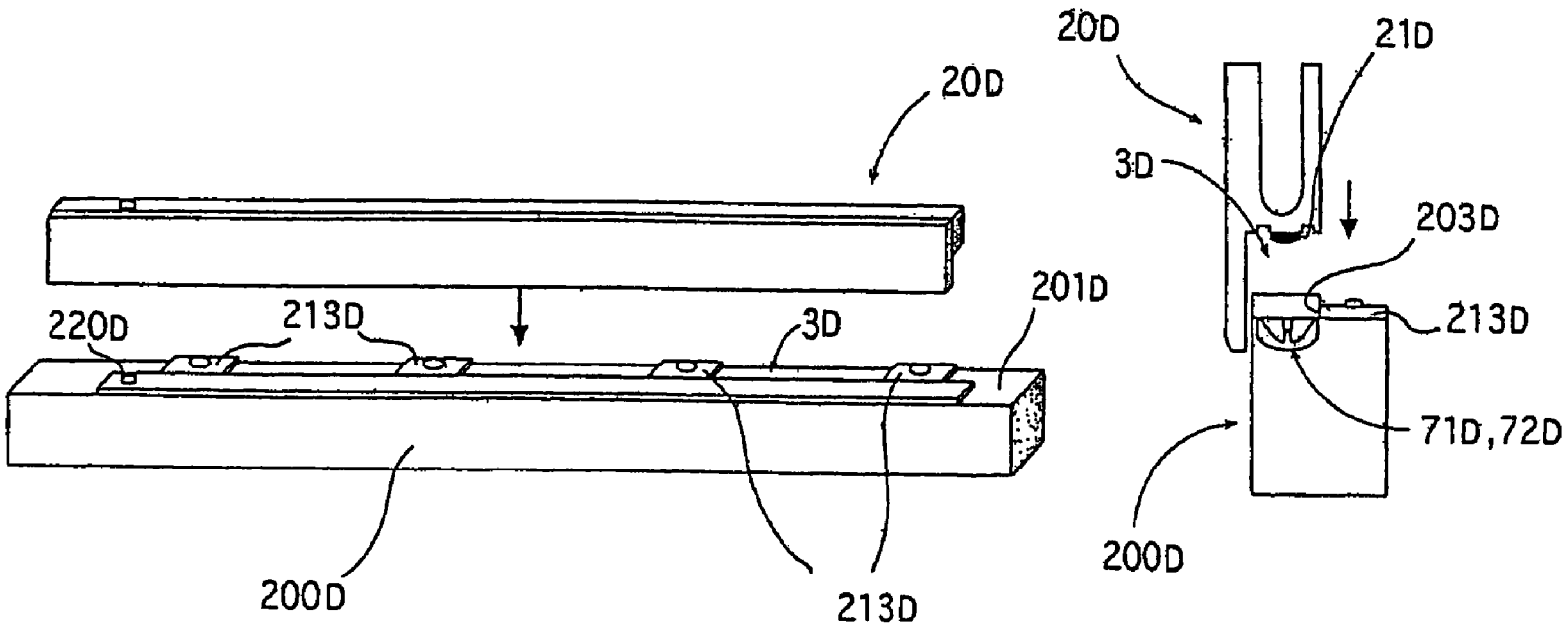
FIG. 47 is a perspective view and a side view describing how to mount the LED base panel mounted on the sticking base onto the base body in the method for sticking the LED base panel in the ninth embodiment of the present invention.
Figure 48:
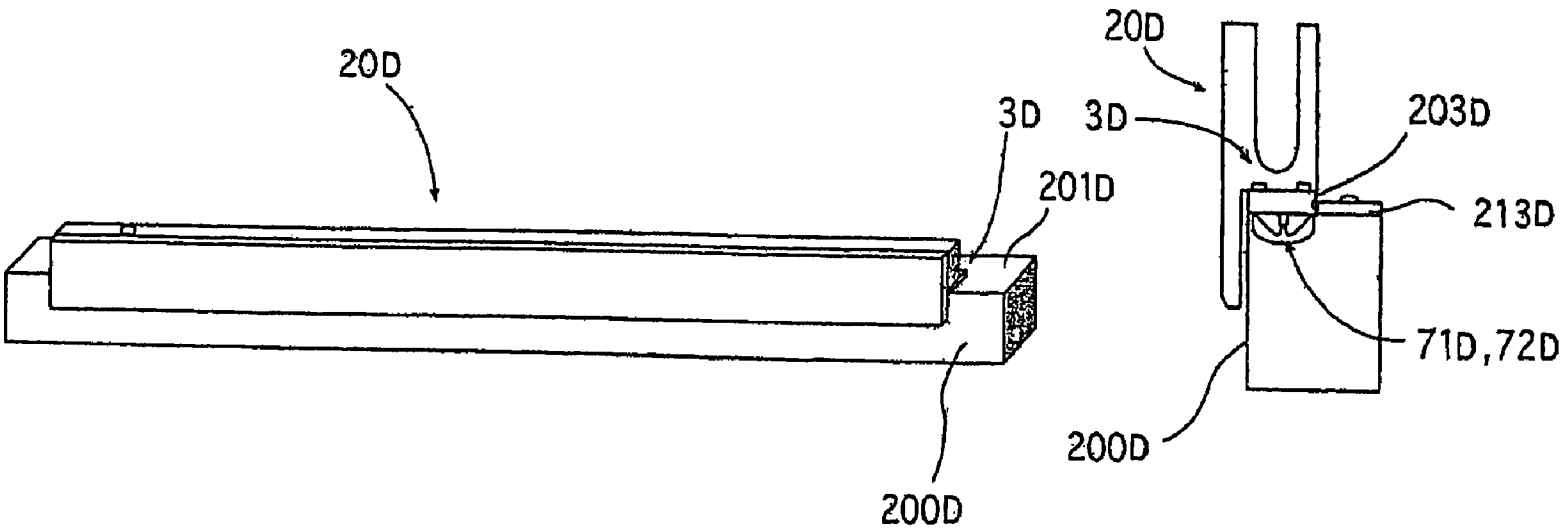
FIG. 48 is a perspective view and a side view describing how the LED vase panel mounted on the sticking base is mounted on the base body in the method for sticking the LED base panel in the ninth embodiment of the present invention.
Figure 49:
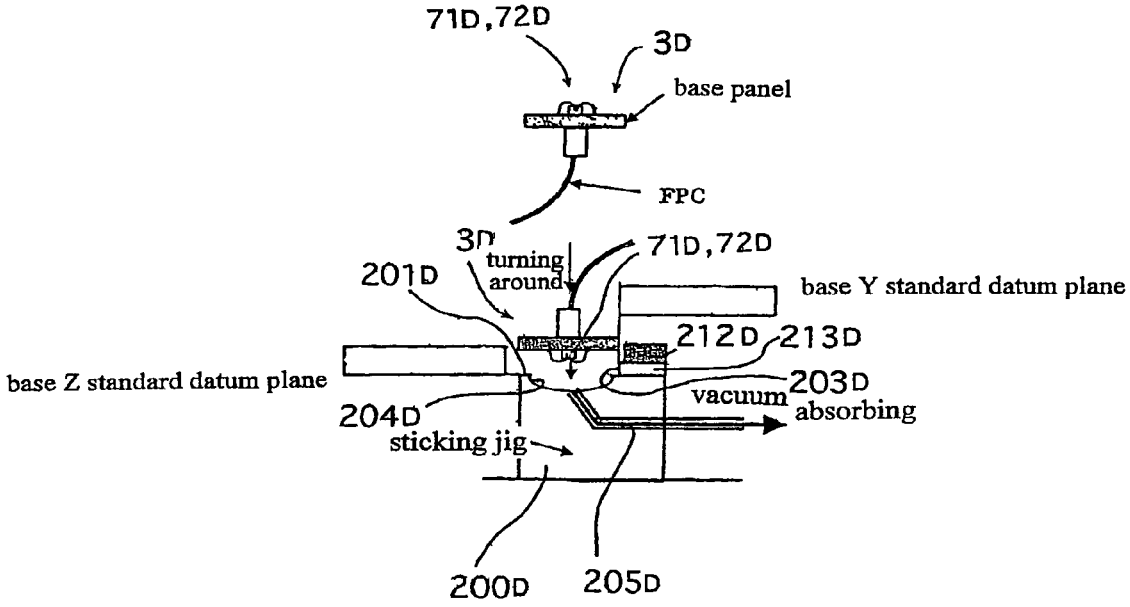
FIG. 49 is a perspective view and a side view describing a state wherein the base panel fitted with LED chips is just to be mounted on the sticking base, in the method for sticking the LED panel in the ninth embodiment of the present invention.

First, as shown in FIG. 44, a standard hole 8D of said base panel 3D, said standard hole 8D being a position adjusting parts in the lengthwise direction, is put on a pin 220D which is put in the upper face 201D of said sticking base 200D, said upper face 201D being a standard face in Z direction and the standard side of said base panel 3D is fit to the standard are 203D of said position adjusting boards 213D as the position adjusting parts in the crosswise direction fixed with screws to adjust the position of said base panel 3D, and said base panel 3D is fixed on the upper face. 201D of said sticking base 200D by vacuum sucking.

At that moment, the shape of said standard face 203D of said sticking jig in Y-direction is settled to be substantially the same as the shape of the standard side of said position adjusting boards 2D put on the horizontal face 101D of said LED chip fitting jig 1D so that when said LED base panel 3D is stuck to said base body 20D, position adjusting accuracy of LED chips when said LED chips are fitted to said LED base panel is ensured and the position shift of each LED chip against said base body can be reduced. Further, the contacting position of said base strip 3D (base panel) to the Y-direction standard side 203D of said sticking jig, said LED chips being fitted on said base panel 3D, is settled to be substantially the same as the contacting position of said base panel 3D to the standard sides of said position adjusting boards 2D put on the horizontal face 101 of said LED chip fitting jig 1D so that in said base body, the position adjusting accuracy of said LED chips when said LED chips are fitted on said LED base panel is ensured and the position shift of LED chips can be substantially removed.

Still further, said LED base panel 3D is fixed on the standard face 201D of said sticking base 200D in Z-direction by vacuum sucking through said vacuum passage 205D, the warping of said LED base panel 3D is corrected.

As shown in FIGS. 50 and 51, said base body 20D on which the adhesive is coated is put on said LED base panel 3D which is fixed directing said LED chips downward and the position of said base body 20D is adjusted in X and Y-directions by said base body position adjusting parts 210 D and 211D fixed with the screws and the base body position adjusting parts 212D fixed to the parts forming the Y-direction standard face 203D of said sticking base 200D with screws, and after then said base body 20D is pressed by the pressing plate-214D intermediating a silicon rubber plate 215D to fix said LED base panel 3D to said base body 20D.

Various kinds of adhesives are used depending on the positions of said base body fitting part 21D in the lengthwise direction.

Namely to fix the middle part of said base panel fitting part 21D of said base body 20D, the adhesive having the lower elasticity after hardening is used and to fix both sides of said base panel fitting part 21D, the adhesive having a higher elasticity after hardening is used. In the middle the lower elasticity adhesive, and at other parts, both sides of the middle part, the higher elasticity adhesive are used.

In the method for sticking the LED base panel of said LED print head, said base strip 3D (LED base panel) on which said LED chips 71D and 72D are fitted is fitted to the standard face 203D in Y-direction engaging said base panel 3D with said pin 220D, and said base panel 3D is fixed on said standard face 201D of said stickling base 200D in Z-direction by sucking to correct the warping of said LED base panel 3D in Z-direction so that the fitting accuracy of said LED chips to said base plate can be improved.

Further, in the method for sticking the LED base panel of said LED print head of the ninth embodiment, said base body 20D having the base panel fitting part 210 to which the adhesive is coated is put on said LED base panel fixed on the upper face 201D of said sticking base and after position adjusting in X and Y-directions, said base body 20D is fixed by pressing by pressing so that LED base panel is bonded and fixed on base plate in a high accuracy, ensuring correction of said LED base panel.

Furthermore, in the method for sticking the LED base panel of said LED print head, the position of said base strip 3D (LED base panel) is adjusted in Y-direction by fitting substantially said position adjusting boards 213D of said sticking base 200D to said position adjusting boards 2D of said LED fitting jig 1D and the position of said base panel 3D is further adjusted in X-direction by putting said standard hole 8D of said base strip 3D (LED base panel) on said standard pin 102 and said pin 220D, so that position reproducibility when said LED chips are fitted on said LED base panel is improved to prevent the fitting position shift of the light emitting points after said base panel is fitted and printing quality of said LED print head can be improved.

Still further, in the method for sticking the LED base panel of said LED print head, since said base body 20D has a configuration to inhibit said base body 20D from contacting with attachments attached to said base panel 3D on which said LED chips 71D and 72D are fitted, the position shift of LED base panel when said LED base panel is stuck to said base body can be removed.

Namely, in the process wherein said LED base pane 3D is stuck and fixed to said base body 20D, by setting the configuration of said base panel fitting part 21 of said base body 20D on which said LED base panel 3D is stuck as described above, the position shift of said LED chips 71D and 72D when said LED base panel 3D is stuck to said base body 20D can be removed.

In addition, the method for sticking the LED base panel of said LED print head, since adhesives having different physical properties are used depending on positions of said base panel fitting part 21D, the warping of said base body 20D and said LED base panel caused by heat generation when said LED chips 71D and 72D emit light is suppressed to reduce the position shift of said LED chips 71D and 72D.

Namely the warping produced when said LED base panel and said base body having different co-efficiencies of thermal expansion respectively are rigidly bonded together can be suppressed and the position shifts of said LED chips are reduced.

Possibility of Industrial Use

In the LED print head of the present invention, the occupied angle for the photosensitive body can be reduced and a thinner colorized print head can be provided.

Further, said LED print head is useful in electrophotographic copying machines or printers since heat generated thermal deformation can be suppressed.

Furthermore, the LED print head and the method for manufacturing the LED print head of the present invention are useful in the electrophotographic copying machine and the method for manufacturing thereof since the coating of the sealing agent can be constantly controlled to simplify and uniform coating of the sealing agent become possible and further angle control of the base body can be omitted to reduce working processes and working time so as to reduce the production cost.

Still further, the method for manufacturing the LED print head of the present invention is useful in the electrophotographic copying machines, and printers since the LED print head producing high quality prints can be achieved by correcting the position shift of the imaging point.

In addition, the method for manufacturing the LED base panel of the LED print head, and the method for attaching the LED base panel are useful in electrophotographic copying machines and printers since the printing quality can be improved by preventing the position shift of light emitting point during the manufacturing process of LED print head.

What is claimed is:

1. An LED print head, wherein said LED print head arranged opposite to a photosensitive body and comprising a base body comprising a large volume base part arranged so as to be parallel to an axis of said photosensitive body and having an opposite upper face opposite to said photosensitive body, and a narrow and small volume projecting part extending upward from a section of said opposite upper face of said base part, said projecting part being connected to said base part; an LED base panel arranged on said opposite upper face of said base part, and a lens array arranged on said projecting part in a position between the opposite face of said photosensitive body and an upper face of said LED base panel, wherein the height of said base part is settled to be sufficiently greater as compared with the height of said projecting part and the height of said base body is settled to be sufficiently greater as compared with the width of said base body consisting of said base part and said projecting part, wherein notched part is formed along the bottom of said base part, giving said whole base body an essentially h-shaped cross section and the side face of said lens array is fixed to the side face of said projecting part and said projecting part extends upward from one side of said opposing upper face in a crosswise direction and the width of said projecting part is settled to be sufficiently narrower as compared with the width of said base part.

2. An LED print head in accordance with claim 1, wherein the depth of said notched part formed on the underside said base part measures more than 50% of the vertical length of said base, at which point there is settled to be at least one heat radiating part, to increase the heat radiating area.

3. An LED print head in accordance with claim 1, wherein said projecting part has a crank shaped upper edge consisting of a plural number of upper and lower side horizontal edge parts, and a plural number of inclining edge parts connecting the respective ends of said upper and lower side horizontal edge parts to form a trapezoid shaped unit and the side of said lens array is fixed to the side face of said projecting part by the adhesive coated to a plural number of parts, the both end parts of the upper and lower horizontal sides and said inclining edge parts continuously, and the sealing agent is applied between the side face of the crank shaped upper edge of said projecting part, and at the crank-shaped upper edge part of said projecting part, the center line of the vertical difference between the upper and lower side horizontal edges and the vertical center line of said lends array are matching.

4. An LED print head in accordance with claim 3, wherein said inclining edge parts are straight line shaped.

5. An LED print head in accordance with claim 3, wherein said inclining edge parts are essentially s-shaped respectively.

6. An LED print head, wherein said LED print head is arranged opposite to a photosensitive body and comprising a base body comprising a large volume base part arranged so as to be parallel to an axis of said photosensitive body and having an opposite upper face opposite to said photosensitive body, and a narrow and small volume projecting part extending upward from a section of said opposite upper face of said base part, said projecting part being connected to said base part; an LED base panel arranged on said opposite upper face of said base part, and a lens array arranged on said projecting part in a position between the opposite face of said photosensitive body and an upper face of said LED base panel, wherein the height of said base part is settled to be sufficiently greater as compared with the height of said projecting part and the height of said base body is settled to be sufficiently greater as compared with the width of said base body consisting of said base part and said projecting part, wherein both ends of a closing member made of a thinner material than said projecting part are fixed to the outside of said lens array and the side wall of said base part respectively to close the space between said, and wherein the joint between one end of said closing member and the outside of said lens array is sealed with a sealing agent and the joint between the other end of said closing member and the side wall of said base part is sealed with tape.

7. A method for manufacturing an LED print head comprising bringing a lens array close to an upper section of the side of a projecting part of a base body, and applying an adhesive to a plural number of upper and lower side horizontal and inclining edge parts continuously and in a state such that a side face of said lens array is adjacent to a side face of said upper edge part, said projecting part has a crank shaped upper edge consisting of a plural number of upper and lower side horizontal edge parts, and a plural number of inclining edge parts connecting said upper and lower side horizontal edge parts respectively to form a trapezoid shape, fixing said lens array to an upper part of a side of said projecting part,and applying a sealing agent between said lens array and the side of said projecting part, said sealing agent being applied by a coating nozzle moved at an angle along said crank shaped upper edge of said projecting part in a one-step process, said upper edge consisting of a plural number of upper and lower side horizontal edge parts, and a plural number of inclining edge parts connecting the respective ends of said upper and lower side horizontal edge parts, to form a trapezoid shape.

8. A method for manufacturing an LED print head wherein a lens array and LED base panel on which a plural number of LED chips are fitted are assembled, at the time when said lens array is fixed to a side of a projecting part of a base body, fitting a position shift of said LED chips to said LED base panel, fitting a position shift of said LED base panel to a base part of a the base body and imaging a point position shift caused by warping of said lens array are corrected by partially warping said lens array at a plural number of points of said lens array, wherein a plural number of notched part comprising the upper and lower side horizontal edge parts and a connecting edge part joining the both ends of said upper and lower side horizontal edge parts, are arranged at regular intervals along the upper edge of said projecting part of said base body, and an adhesive is applied continuously in a hook shaped trace to the side wall of said lens array, said upper and lower horizontal edge parts, and connecting edge part, after which it hardens, fixing said lens array.

9. A method for manufacturing an LED print head in accordance with claim 8, wherein said notched part located in the middle of a plural number of notched parts, arranged at a regular intervals along the upper edge of said projecting part of said base body, is first fixed to the side wall of said lens array, after which said notched parts located on both sides of said middle notched part, are fixed in sequence, finally fixing both ends.

10. A method for manufacturing an LED print head in accordance with claim 9, wherein each time when one of said notched parts is fixed, the position shift of said notched parts of said projecting part of said base body is readjusted.

11. A method for manufacturing an LED print head in accordance with claim 10, wherein an adhesive having a lower elasticity after hardening is used to fix said notched part at the middle of said projecting part of said base body, and an adhesive having a higher elasticity after hardening is used to fix said notched parts excepting said middle notched part.

* * * * *